US012662901B2

(12) United States Patent
Gunasekaran et al.

(10) Patent No.: US 12,662,901 B2
(45) Date of Patent: Jun. 23, 2026

(54) DOWNHOLE TOOL INCLUDING A FREQUENCY FILTER BASED SWITCH SYSTEM CONFIGURED TO FILTER POWER BETWEEN A FIRST DOWNHOLE DEVICE AND A SECOND DOWNHOLE DEVICE

(71) Applicant: Halliburton Energy Services, Inc., Houston, TX (US)

(72) Inventors: Mohan Gunasekaran, Al-Khobar (SA); Michael Linley Fripp, Singapore (SG); Deepesh Upadrashta, Singapore (SG); David Dockweiler, Singapore (SG); Ibrahim El Mallawany, Dhahran (SA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/062,903

(22) Filed: Feb. 25, 2025

(65) Prior Publication Data

US 2025/0270897 A1 Aug. 28, 2025

Related U.S. Application Data

(60) Provisional application No. 63/559,047, filed on Feb. 28, 2024, provisional application No. 63/559,031, (Continued)

(51) Int. Cl.
*E21B 34/06* (2006.01)
*E21B 23/00* (2006.01)

(52) U.S. Cl.
CPC ..... *E21B 34/066* (2013.01); *E21B 23/00* (2013.01)

(58) Field of Classification Search
CPC ..... E21B 34/066; E21B 23/00
See application file for complete search history.

(56) References Cited

U.S. PATENT DOCUMENTS 4,523,194 A * 6/1985 Hyde ..... E21B 17/003 340/855.9
5,751,895 A 5/1998 Bridges
(Continued)

FOREIGN PATENT DOCUMENTS

EP 1236862 A2 9/2002
WO 2020041056 A1 2/2020

OTHER PUBLICATIONS

PCT_ISR (Year: 2025).*
PCT_WO (Year: 2025).*

*Primary Examiner* — Steven A Macdonald
(74) *Attorney, Agent, or Firm* — Scott Richardson; Parker Justiss, P.C.

(57) ABSTRACT

Provided is a downhole tool, a well system, and a method. The downhole tool, in one aspect, includes a first downhole device. The downhole tool, in one aspect, further includes a switch system electrically coupled with the first downhole tool, the switch system including: 1) an input coupleable to a power source; 2) an output coupled to a first electrical component of the first downhole device and coupleable to a second electrical component of a second downhole device; and 3) a frequency filter, wherein the output is coupled to the first electrical component of the first downhole device via the frequency filter or the output is coupleable to the second electrical component of the second downhole device via the frequency filter, the frequency filter configured to filter power to one of the first downhole device or the second downhole device upon switching a signal of the power source.

26 Claims, 46 Drawing Sheets

Related U.S. Application Data filed on Feb. 28, 2024, provisional application No. 63/559,011, filed on Feb. 28, 2024.

(56) References Cited

U.S. PATENT DOCUMENTS

| | | | | |
|---|---|---|---|---|
| 8,453,749 | B2 | 6/2013 | Vick, Jr | |
| 8,919,730 | B2 | 12/2014 | Vick, Jr. | |
| 11,248,441 | B2 | 2/2022 | Vick, Jr. et al. | |
| 2002/0039465 | A1* | 4/2002 | Skinner | H04J 14/0213 385/24 |
| 2005/0024174 | A1 | 2/2005 | Kolb et al. | |
| 2005/0029476 | A1* | 2/2005 | Biester | H02J 1/06 251/58 |
| 2008/0053662 | A1 | 3/2008 | Williamson et al. | |
| 2013/0032355 | A1* | 2/2013 | Scott | E21B 34/066 166/373 |
| 2013/0206387 | A1* | 8/2013 | Deville | E21B 47/12 166/66.4 |
| 2016/0006481 | A1* | 1/2016 | Rendusara | H04B 3/546 340/854.9 |
| 2016/0265309 | A1 | 9/2016 | Vick, Jr. | |
| 2017/0051608 | A1 | 2/2017 | Boyanapally et al. | |
| 2017/0350197 | A1* | 12/2017 | Sugiura | H02J 50/402 |
| 2019/0071960 | A1* | 3/2019 | James | E21B 43/25 |
| 2019/0195028 | A1* | 6/2019 | Fripp | H01R 13/15 |
| 2020/0095843 | A1 | 3/2020 | Vick, Jr. et al. | |
| 2021/0111589 | A1* | 4/2021 | Fripp | H02J 50/80 |
| 2023/0018892 | A1 | 1/2023 | Chouzenoux et al. | |
| 2023/0037547 | A1 | 2/2023 | Newton | |
| 2023/0399919 | A1 | 12/2023 | Passmore | |

* cited by examiner

190b

190f 200
202
204
205
206
208
210
212
214
216
218
220
222
223
224
225
226
228
230
232
234
240
242
250
251
252
254
257
258
260
270
272
274

DOWNHOLE TOOL INCLUDING A FREQUENCY FILTER BASED SWITCH SYSTEM CONFIGURED TO FILTER POWER BETWEEN A FIRST DOWNHOLE DEVICE AND A SECOND DOWNHOLE DEVICE

CROSS-REFERENCE TO RELATED APPLICATION

This application claims the benefit of U.S. Provisional Application Ser. No. 63/559,011, filed on Feb. 28, 2024, entitled "A WIRELINE RETRIEVABLE SAFETY VALVE EMPLOYING A MECHANICAL CONNECTING APPARATUS HAVING ONE OR MORE PERMANENT MAGNETS," U.S. Provisional Application Ser. No. 63/559,047, filed on Feb. 28, 2024, entitled "A WIRELINE RETRIEVABLE SAFETY VALVE EMPLOYING A MAGNETIC FLUX AND FLUX PATH OF AN ELECTROMAGNET TO ENGAGE WITH A MECHANICAL CONNECTING APPARATUS HAVING A FERROMAGNETIC TARGET," and U.S. Provisional Application Ser. No. 63/559,031, filed on Feb. 28, 2024, entitled "A WIRELINE RETRIEVABLE SAFETY VALVE EMPLOYING RADIALLY COUPLED PERMANENT MAGNETS AND AN ELECTROMAGNET AXIALLY COUPLED TO A TARGET," all of which are commonly assigned with this application and incorporated herein by reference in their entirety.

BACKGROUND

Downhole devices, such as subsurface safety valves (SSSVs) are well known in the oil and gas industry and provide one of many failsafe mechanisms to prevent the uncontrolled release of subsurface production fluids, should a wellbore system experience a loss in containment. In certain instances, SSSVs comprise a portion of a tubing string, the entirety of the SSSVs being set in place during completion of a wellbore. In other instances, the SSSVs are wireline deployed/retrieved. Although a number of design variations are possible for SSSVs, the vast majority are flapper-type valves that open and close in response to longitudinal movement of a flow tube.

Since SSSVs typically provide a failsafe mechanism, the default positioning of the flapper valve is usually closed in order to minimize the potential for inadvertent release of subsurface production fluids. The flapper valve can be opened through various means of control from the earth's surface in order to provide a flow pathway for production to occur. What is needed in the art is an improved SSSV that does not encounter the problems of existing SSSVs.

BRIEF DESCRIPTION

Reference is now made to the following descriptions taken in conjunction with the accompanying drawings, in which:

FIGS. 1H and 1I illustrate an alternative embodiment of a switch system designed, manufactured and/or operated according to one or more embodiments of the disclosure, as might be used in the well system of FIG. 1A;

Figure 1A:
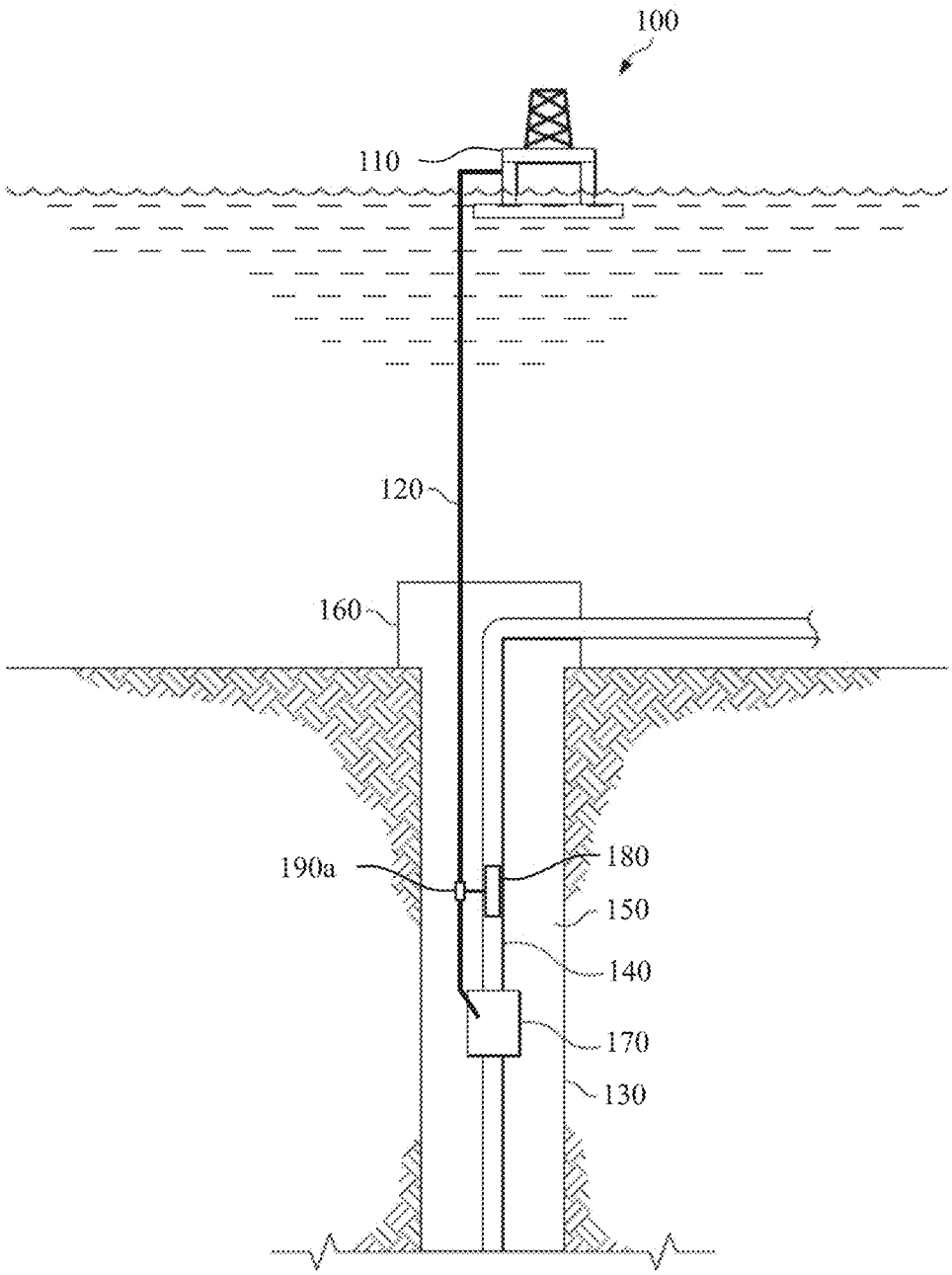
FIG. 1A illustrates a well system designed, manufactured and/or operated according to one or more embodiments of the disclosure.

FIGS. 3A through 3D illustrate different views of a safety valve designed, manufactured and/or operated according to one or more alternative embodiments of the disclosure; and FIGS. 4A through 9D illustrate various different installation states, each with various different views, of a safety valve designed, manufactured and/or operated according to one or more alternative embodiments of the disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Furthermore, unless otherwise specified, use of the terms "up," "upper," "upward," "uphole," "upstream," or other like terms shall be construed as generally toward the surface of the subterranean formation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Additionally, unless otherwise specified, use of the term "subterranean formation"

shall be construed as encompassing both areas below exposed earth and areas below earth covered by water such as ocean or fresh water.

Various values and/or ranges are explicitly disclosed in certain embodiments herein. However, values/ranges from any lower limit may be combined with any upper limit to recite a range not explicitly recited. Similarly, values/ranges from any lower limit may be combined with any other lower limit to recite a range not explicitly recited. In the same way, values/ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited. Similarly, an individual value disclosed herein may be combined with another individual value or range disclosed herein to form another range.

The term "substantially XYZ," as used herein, means that it is within 10 percent of perfectly XYZ. The term "significantly XYZ," as used herein, means that it is within 5 percent of perfectly XYZ. The term "ideally XYZ," as used herein, means that it is within 1 percent of perfectly XYZ. The monicker "XYZ" could refer to parallel, perpendicular, alignment, or other relative features disclosed herein.

The present disclosure has acknowledged that offshore wells are being drilled at ever increasing water depths and in environmentally sensitive waters, and thus safety valves (e.g., including subsurface safety valves (SSSVs)) are necessary. The present disclosure has further acknowledged that SSSVs have parts that can wear or erode, and thus from time to time may need servicing and/or replacing. In fact, occasionally the tubing retrievable safety valve (TRSV) (e.g., electrically actuated TRSV) will fail, and then a wireline retrievable safety valve (WLRSV) will be run in hole. Unfortunately, each of the TRSV and the WLRSV require their own power source, such as individual tubing encapsulated conductors (TECs).

The present disclosure has further developed an improved WLRSV. In at least one embodiment, the WLRSV includes a first portion that is run-in-hole with the TRSV and second and third portions that are run-in-hole after the TRSV is no longer working properly and/or has failed. The first portion of the WLRSV, in at least one embodiment, includes a safety valve sub (e.g., WLRSV sub) that would be run-in-hole along with another safety valve sub (e.g., TRSV sub), and for example the tubing string. In at least one embodiment, the safety valve sub would be located above the TRSV sub. In at least one other embodiment, the safety valve sub would include an electromagnetic assembly (e.g., including one or more coils) (e.g., coupleable to the electric control line (e.g., single TEC) via the aforementioned switch system) located in an pocket of the safety valve sub, as well as one or more radial outer magnetic targets and a magnetic target additionally located in the pocket, the magnetic target positioned between the one or more radial outer magnetic targets and the electromagnetic assembly. In at least one embodiment, the first portion additionally includes a fluid isolation sleeve that isolates the electromagnetic assembly, one or more radial outer magnetic targets, magnetic target and pocket from fluid and/or debris within the wellbore. In at least one embodiment, the fluid isolation sleeve is a fixed fluid isolation sleeve, and thus does not readily move once positioned downhole.

The WLRSV, in one or more embodiments, further includes the second portion of the WLRSV, which is run-in-hole after the TRSV is no longer working properly and/or has failed. The second portion of the WLRSV, in accordance with one or more embodiments, may be run-in-hole within the TRSV, for example using a latch mechanism to axially fix the second portion of the WLRSV within the TRSV. The second portion of the WLRSV, in one or more embodiments, may include a bore flow management actuator and a valve closure mechanism, and may be located below the first portion of the WLRSV including the electromagnetic assembly and the fluid isolation sleeve. The second portion of the WLRSV may additionally include a power spring and/or nose spring, as will be further discussed below The WLRSV, in one or more embodiments, further includes a third portion that is run-in-hole after the second portion of the WLRSV is latched downhole (e.g., latched within the TRSV or first portion of the WLRSV). In another embodiment, the third portion is run-in-hole after the second portion is run-in-hole on a separate wellbore operation, such as a separate wireline trip or a separate slickline trip. In another embodiment, the third portion is run-in-hole after the second portion in the same wellbore operation, such as on the same wireline trip or the same slickline trip. The third portion, in one or more embodiments, includes a mechanical connecting apparatus. For example, in accordance with one or more embodiments of the disclosure, once the second portion of the WLRSV is latched in place, the mechanical connecting apparatus may be run-in-hole and coupled with the flow tube of the second portion. In at least this one embodiment, the mechanical connecting apparatus is located radially inside of the electromagnetic assembly and/or the fluid isolation sleeve of the first portion. The mechanical connecting apparatus, in one or more embodiments, includes one or more radial inner magnetic targets associated therewith (e.g., coupled thereto or forming a part thereof). The one or more radial inner magnetic targets, in this embodiment, are configured to magnetically couple with the one or more radial outer magnetic targets in the pocket of the first portion (e.g., through the fluid isolation sleeve). Accordingly, in at least one embodiment, at least one of the one or more radial inner magnetic targets or the one or more radial outer magnetic targets are one or more permanent magnets. For example, in at least one embodiment, the one or more radial inner magnetic targets are one or more permanent magnets and the one or more radial outer magnetic targets are not permanent magnets. In at least one other embodiment, the one or more radial outer magnetic targets are one or more permanent magnets, and the one or more radial inner magnetic targets are not one or more permanent magnets. In even yet another embodiment, the one or more radial inner magnetic targets and the one or more radial outer magnetic targets are both one or more permanent magnets. In essence, the mechanical connecting apparatus may be run-in-hole to axially fix the one or more radial inner magnetic targets of the third portion with the flow tube of the second portion. Accordingly, any axial movement of the flow tube would result in the same axial movement of the one or more radial inner magnetic targets, and vice-versa. Similarly, as the one or more radial inner magnetic targets arc coupled (e.g., magnetically coupled) with the one or more radial outer magnetic targets in the pocket of the first portion, the axial movement of the one or more radial inner magnetic targets (e.g., through the movement of the flow tube) also axially slides the one or more radial outer magnetic targets of the first portion (e.g., and the magnetic target) toward the electromagnetic assembly of the first portion. Ultimately, when the magnetic target and the electromagnetic assembly of the first portion are positioned proximate one another, and the electromagnetic assembly is energized, the magnetic target and the electromagnetic assembly of the first portion are held together, thereby holding the mechanical connecting apparatus and bore flow management actuator of the second portion in the open position as long as the electromagnetic assembly is energized. The above is discussed in the context of the second portion and the third portion being run-in-hole at different times. Other embodiments may exist wherein the second portion and the third portion are run-in-hole in a single trip (e.g., already coupled with one another).

In operation, once the mechanical connecting apparatus is in place, fluid pressure (e.g., from within the tubular below the valve closure mechanism) may urge the bore flow management actuator toward the valve closure mechanism. Typically, the bore flow management actuator is unable to move past the valve closure mechanism until a pressure differential across the valve closure mechanism is reduced/eliminated. Once the pressure differential across the valve closure mechanism is reduced/eliminated, for example by pumping fluid down the wellbore toward an uphole side of the valve closure mechanism, the bore flow management actuator may be urged past the valve closure mechanism, for example using one or more springs (e.g., power springs and/or nose springs). As the one or more radial inner magnetic targets are axially fixed to the flow tube, the axial movement of the flow tube also axially moves the one or more radial inner magnetic targets. As the one or more radial inner magnetic targets are coupled to the one or more radial outer magnetic targets (e.g., and the magnetic target) of the first portion, the axial movement of the flow tube also axially moves the one or more radial outer magnetic targets (e.g., and the magnetic target). Therefore, this axial movement of the flow tube brings the one or more radial outer magnetic targets and magnetic target of the first portion proximate the electromagnetic assembly of the first portion. Accordingly, when the electromagnetic assembly is energized (e.g., before, during or after the one or more radial outer magnetic targets approach the electromagnetic assembly) and located proximate the magnetic target of the first portion, the one or more radial outer magnetic targets of the sliding sleeve, one or more radial inner magnetic targets of the mechanical connecting apparatus, and thus the flow tube axially fixed thereto, may be held in the flow state. The one or more radial inner magnetic targets of the mechanical connecting apparatus and the associated flow tube will be held in this flow state until such time as the electromagnetic assembly is no longer energized, such as when power is turned off to or cut from the electromagnetic assembly. When this happens, the one or more springs (e.g., power springs and/or nose springs) are allowed to return the flow tube, and the associated flapper valve, to the closed state.

The present disclosure has, for the first time, further developed a switch system (e.g., mechanical, electrical, etc.) that will allow a single electric control line (e.g., single TEC) to operate two different downhole tools, such as the TRSV (e.g., electrically actuated TRSV) and/or WLRSV (e.g., a WLRSV that may be electrically maintained in an open position), or to operate redundant downhole tools, such as a wet connection or an actuator. For example, the switch system could shift power between two different electrical devices (e.g., electromagnetic coils, electric motor or pump, piezoelectric actuator, solenoid valve, etc.) of the two different downhole tools. As another example, the switch system could shift power between an electrical device that has failed to a redundant device that has not been powered. Thus, in at least one embodiment, the single electric control line (e.g., single TEC) could be run downhole from the surface to the switch system, and then the switch system would toggle the power between the TRSV and the WLRSV, as necessary. In at least one embodiment, the switch system would toggle the power from the TRSV to the WLRSV as the WLRSV is ready to be run-in-hole, as the WLRSV is being run-in-hole, or after the WLRSV has been run-in-hole.

Accordingly, a switch system designed, manufactured and/or operated according to one or more embodiments of the disclosure reduces the need to run additional electric control lines, for example in contingency operations, such as when the TRSV fails and a WLRSV is necessary. This reduces the complexity in running completions, electric control line protection, tubing hanger penetration, and the overall cost to the customer.

FIG. 1A illustrates a well system 100 designed, manufactured and/or operated according to one or more embodiments of the disclosure. The well system 100, in at least one embodiment, includes an offshore platform 110 connected to a first downhole device 170 (e.g., first SSSV, such as a TRSV) insert within a wellbore 130 (e.g., the wellbore extending through one or more subterranean formations) and a second downhole device 180 (e.g., second SSSV, such as a WLRSV) insert within the wellbore 130 via an electric control line 120 (e.g., primary electric control line, single electric control line, TEC, etc.). In at least one embodiment, the second downhole device 180 is an electrical connection for a WLRSV. For example, the electrical connection may be an inductive coupling, a capacitive coupling, or a conductive coupling with direct electrical contact, among others. An annulus 150 may be defined between walls of the wellbore 130 (e.g., extending through a subterranean formation) and a conduit 140. A wellhead 160 may provide a means to hand off and seal conduit 140 against the wellbore 130 and provide a profile to latch a subsea blowout preventer to. Conduit 140 may be coupled to the wellhead 160. Conduit 140 may be any conduit such as a casing, liner, production tubing, or other oilfield tubulars disposed in a wellbore. The first downhole device 170, or at least a portion thereof, may be interconnected with the conduit 140 (e.g., disposed in line with the conduit 140) and positioned in the wellbore 130. The second downhole device 180, or at least a portion thereof, may be interconnected with the conduit 140 (e.g., positioned within an ID or OD of the conduit 140) and positioned in the wellbore 130. In the illustrated embodiment, the second downhole device 180 is illustrated uphole of the first downhole device 170 (e.g., a portion of it being run-in-hole with the first downhole device 170 and another portion of it being run-in-hole after the first downhole device 170 has failed), but other embodiments may exist wherein the second downhole device 180 is located downhole of the first downhole device 170.

The electric control line 120 may extend into the wellbore 130 and may be connected to the first downhole device 170 and the second downhole device 180. The electric control line 120 may provide actuation power to the first downhole device 170 and the second downhole device 180. As will be described in further detail below, power may be provided to first downhole device 170 or the second downhole device 180 to actuate or de-actuate the first downhole device 170 or the second downhole device 180. Actuation may comprise opening the first downhole device 170 or the second downhole device 180 to provide a flow path for subsurface production fluids to enter conduit 140, and de-actuation may comprise closing the first downhole device 170 or the second downhole device 180 to close a flow path for subsurface production fluids to enter conduit 140. While the embodiment of FIG. 1A illustrates only the first downhole device 170 and the second downhole device 180, other embodiments exist wherein more than two downhole devices according to the disclosure are used.

In accordance with one embodiment of the disclosure, the well system 100 may further include a switch system 190*a* positioned between the electric control line 120 and each of the first downhole device 170 and the second downhole device 180. The switch system 190*a*, as discussed above, is configured to switch the incoming power from the electric control line 120 between the first downhole device 170 and the second downhole device 180, depending on which of the first downhole device 170 or the second downhole device 180 that the operator intends to operate (e.g., actuate). In at least one embodiment, the first downhole device 170 includes a first electrical devices (e.g., electromagnetic coils, electric motor or pump, piezoelectric actuator, solenoid valve, etc.) and the second downhole device 180 includes a second electrical devices (e.g., electromagnetic coils, electric motor or pump, piezoelectric actuator, solenoid valve, etc.), and the switch system 190*a* is configured to switch the incoming power from the electric control line 120 between the first electrical device of the first downhole device 170 and the second electrical device of the second downhole device 180.

While the embodiment of FIG. 1A employs a single electric control line 120 and the switch system 190*a*, other embodiments of the disclosure could use two or more different electric control lines with or without the switch system 190*a*. Although the well system 100 is depicted in FIG. 1A as an offshore well system, one of ordinary skill should be able to adopt the teachings herein to any type of well, including onshore or offshore. In the embodiment of FIG. 1A, the first downhole device 170 is a TRSV, and the second downhole device 180 is a WLRSV.

Figure 1B:
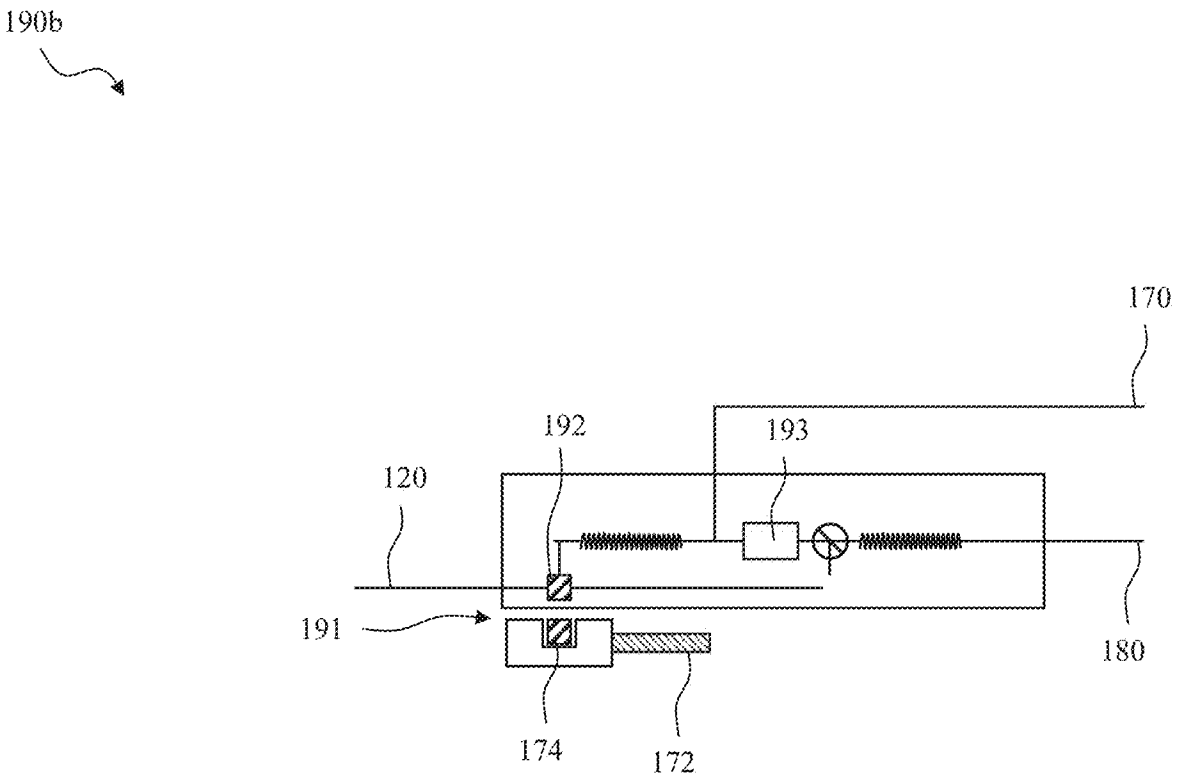
FIGS. 1B and 1C illustrate one embodiment of a switch system designed, manufactured and/or operated according to one or more embodiments of the disclosure, as might be used in the well system of FIG. 1A.
Figure 1C:
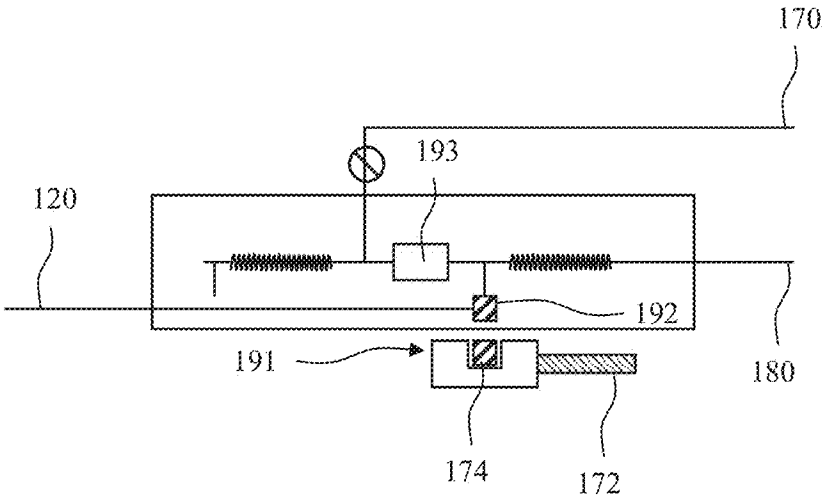

Turning to FIGS. 1B and 1C, illustrated is one embodiment of a switch system 190*b* designed, manufactured and/or operated according to one or more embodiments of the disclosure, as might be used in the well system 100 of FIG. 1A. The switch system 190*b*, in the illustrated embodiment, is a mechanical switch system. In the illustrated embodiment, the switch system 190*b* includes a mechanically activated switch 191, the mechanically activated switch 191 having an input thereof coupled to the electric control line 120, and a first output thereof coupled to the first downhole device 170 and a second output thereof coupled to the second downhole device 180. Accordingly, the mechanically activated switch 191 switches the input power from the electric control line 120 between the first downhole device 170 (e.g., FIG. 1B) and the second downhole device 180 (FIG. 1C), as necessary.

While a number of different embodiments for mechanical switch systems may be used, in the illustrated embodiment, a sliding sleeve 172 of the first downhole device 170 includes a magnetic target 174 thereon. Similarly, the switch system 190*b* includes a related magnetic target 192 therein, for example coupled to the mechanically activated switch 191 (e.g., two or more magnetic features). In at least one embodiment, at least one of the magnetic target 174 or the magnetic target 192 is a magnet (e.g., permanent magnet or electromagnet). Furthermore, the switch system 190*b* may include an insulator 193 separating the first output and the second output. Accordingly, the related magnetic target 192 will couple with (e.g., decouple from) the magnetic target 174 to switch the power between the first downhole device 170 and the second downhole device 180, in this instance as the sliding sleeve 172 moves, as shown in FIGS. 1B and 1C. In at least one embodiment, the sliding sleeve 172 is configured to move when the second downhole device 180 is being run-in-hole. Again, while one or more magnetic targets 174 are illustrated in FIGS. 1B and 1C for shifting the switch, in one or more other embodiments the switches are directly shifted as opposed to magnetically shifted.

While not illustrated in FIGS. 1B and 1C, another embodiment may exist wherein a reed switch is employed to switch between the first downhole device 170 and the second downhole device 180. In such an embodiment, one or more of the magnetic targets 192 could be exchanged for a reed switch. Thus, as the magnetic target 174 passes over the reed switch, the reed switch will switch the power between the first downhole device 170 and the second downhole device 180. In at least one embodiment, ones of the one or more reed switches are single pole single-throw reed switches and/or single pole double-throw reed switches. Those skilled in the art appreciate how such reed switches would be configured to achieve the desires stated herein.

Figure 1D:
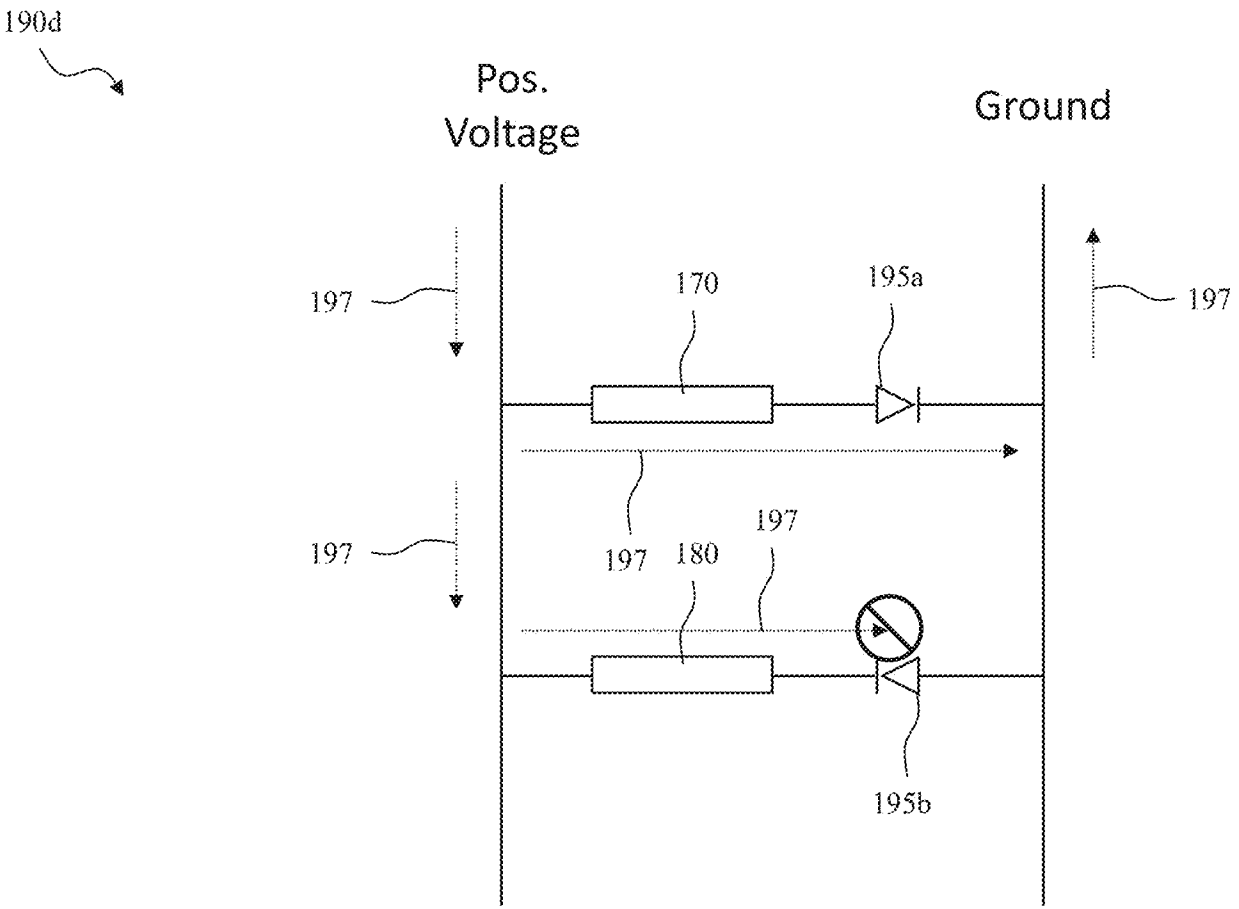
FIGS. 1D and 1E illustrate an alternative embodiment of a switch system designed, manufactured and/or operated according to one or more embodiments of the disclosure, as might be used in the well system of FIG. 1A.
Figure 1E:
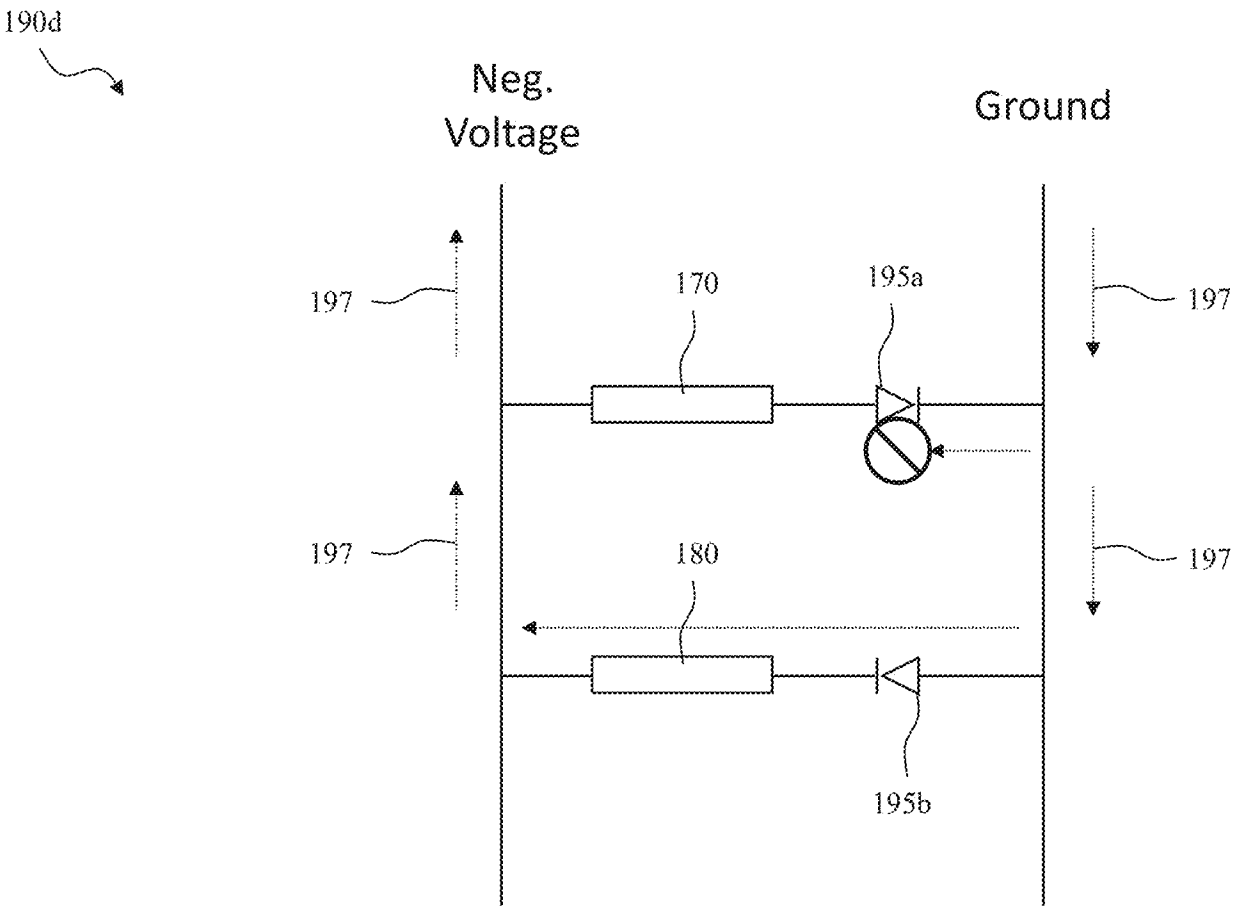

Turning to FIGS. 1D and 1E, illustrated is one embodiment of a switch system 190*d* designed, manufactured and/or operated according to one or more embodiments of the disclosure, as might be used in the well system 100 of FIG. 1A. The switch system 190*d*, in the illustrated embodiment, is an electrical switch system, for example including an electrically activated switch. In the illustrated embodiment, the switch system 190*d* includes two or more oppositely oriented diodes 195*a*, 195*b* coupled between the electric control line 120 and each of the first downhole device 170 and the second downhole device 180, respectively. The term "diode," as used herein, includes all electronics that have an asymmetric conductance, including semiconductor diodes, thermionic diodes, and multichip modules that have asymmetric conductance. Thus, for example, if a positive voltage is applied to the electric control line 120, the first diode 195*a* would allow the current 197 to pass therethrough and thus would establish a closed circuit, and therefore the first downhole device 170 would be powered. However, the second diode 195*b* would not allow the current 197 to pass there through and thus would establish an open circuit, and thus the second downhole device 180 would not be powered. In contrast, if a negative voltage is applied to the electric control line 120, the first diode 195*a* would not allow the current 197 to pass therethrough and thus would establish an open circuit, and therefore the first downhole device 170 would not be powered. However, the second diode 195*b* would allow the current 197 to pass therethrough and thus would establish a closed circuit, and thus the second downhole device 180 would be powered. Thus, by toggling the voltage between a positive voltage (e.g., preset positive voltage) and a negative voltage (e.g., preset negative voltage), the switch system 190*d* powers different ones of the first downhole device 170 and the second downhole device 180.

Figure 1F:
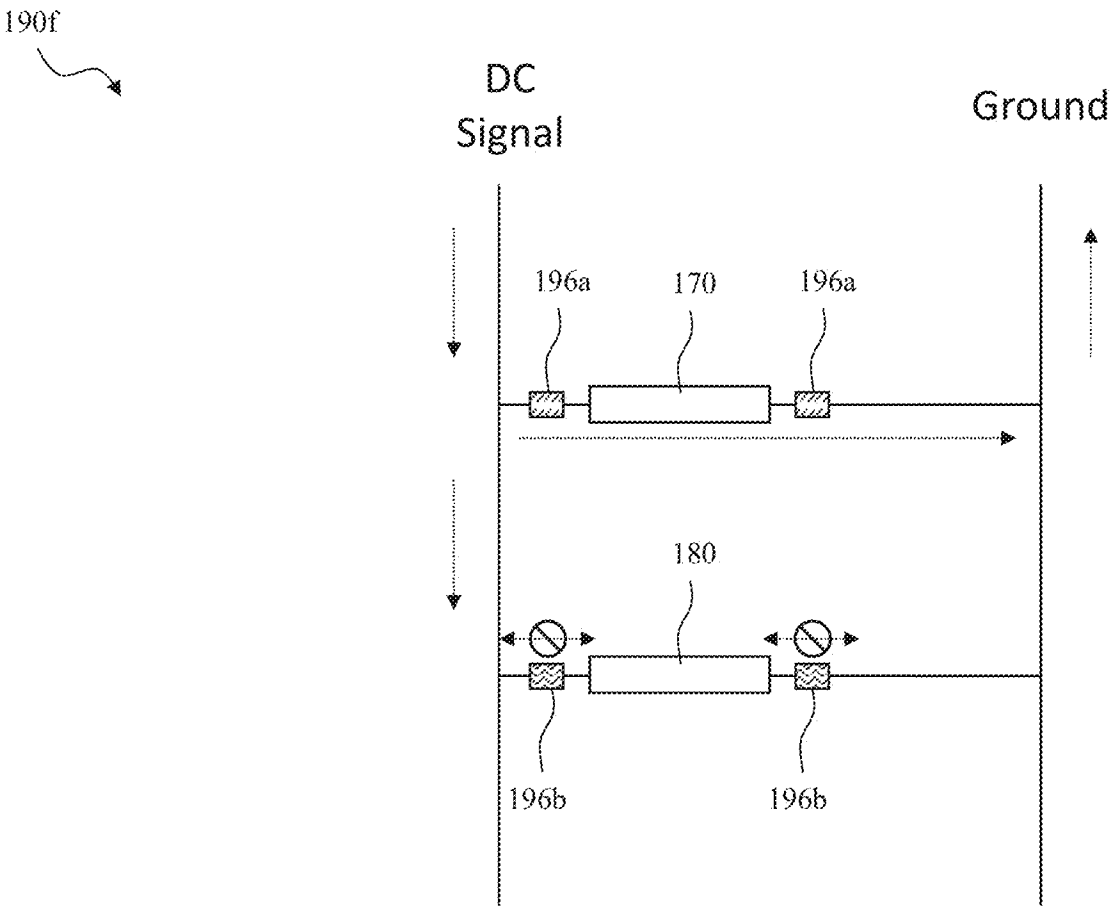
FIGS. 1F and 1G illustrate an alternative embodiment of a switch system designed, manufactured and/or operated according to one or more embodiments of the disclosure, as might be used in the well system of FIG. 1A.
Figure 1G:
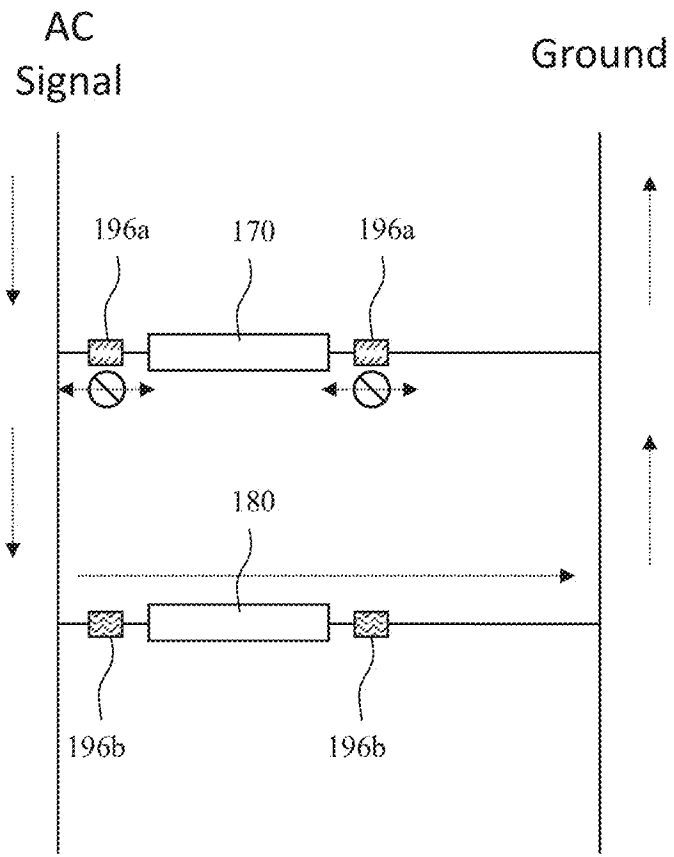

Turning to FIGS. 1F and 1G, illustrated is one embodiment of a switch system 190*f* designed, manufactured and/or operated according to one or more embodiments of the disclosure, as might be used in the well system 100 of FIG. 1A. The switch system 190*f*, in the illustrated embodiment, is an electrical switch system. In the illustrated embodiment, the switch system 190*f* includes low frequency/high frequency filters coupled between the electric control line 120 and the first downhole device 170, and/or high frequency/low frequency filters coupled between the electric control line 120 and the second downhole device 180. In this scenario, the low frequency filters would be configured to pass a low frequency signal of a power source (e.g., and block the high frequency signal of a power source), and the high frequency filters would be configured to pass the high frequency signal of the power source (e.g., and block the low frequency signal of the power source). Accordingly, by switching the frequency of the power source, one of the first downhole device 170 or second downhole device 180 will receive power, while the other of the second downhole device 180 or the first downhole device 170 will not receive power.

In the embodiment of FIGS. 1F and 1G, a low frequency filter 196*a* surrounds the first downhole device 170 and a high frequency filter 196*b* surrounds the second downhole device 180. Accordingly, as shown in FIGS. 1F and 1G, the low frequency signal will only power the first downhole device 170 and the high frequency signal will only power the second downhole device 180. Thus, by switching the frequency of the power source, different ones of the first downhole device 170 and second downhole device 180 will be powered.

It should be noted that the phrases "low frequency signal" and "high frequency signal" are relative to one another and not limited by any specific values. Nevertheless, in at least one embodiment, the low frequency signal is less than 100 Hz and the high frequency signal is greater than 100 Hz, and in even yet another embodiment greater than 10,000 Hz. In even yet another embodiment, the frequency of the high frequency signal is at least 50% higher (e.g., at least 50% more cycles per second) than the frequency of the low frequency signal. In even yet another embodiment, a DC signal is a subset of a low frequency signal.

It should additionally be noted that the phrase "frequency filter" includes all known or hereafter discovered frequency filters that could be used for the intended purpose disclosed herein. For example, the frequency filter could be a linear continuous-time filter, such as an elliptic filter, a Butterworth filter, or a Chebyshev filter, among others. The frequency filter can also be an analog filter or a digital filter, and can be a passive or active filter. In one example embodiment, the frequency filter is a passive analog filter. In even another embodiment, the frequency filter may include nonlinear electrical components, such as one or more electrical switch (e.g., like a field effect transistor or FET) and AC to DC power converters. In some embodiment, the frequency filter will induce the electrical switch to open or to close based on the frequency content of the input signal. In another embodiment, the output from the high-pass frequency filter is converted to a DC signal with an AC to DC converter. In other words, in at least this one embodiment the electrical power will only be delivered when the input signal is a high frequency signal. However, the electrical power that is delivered to the load 170, in this embodiment, will consist of DC power.

In at least one embodiment, the first downhole device 170 is a sensor and the second downhole device 180 is a safety valve, such as a WLRSV. In at least this one embodiment, there is a desire to still power and/or communicate with the sensor even if the second downhole device 180 (e.g., WLRSV) is installed, and thus a frequency filter (e.g., high frequency filter) could be installed with the sensor. Accordingly, in this one embodiment, a first signal including DC power would be used to power the sensor, and when the second downhole device 180 (e.g., WLRSV) is installed, the first signal would be switched to a second signal including the DC power and AC power, such that the second downhole device 180 (e.g., WLRSV) and the sensor are powered. This approach might be used when separate power cables are employed for the TRSV and the sensor (e.g., downhole pressure/temperature sensor), and there is a need to drop in the WLRSV and provide power to it. Greater reliability may be achieved in this embodiment, given the fact that the second downhole device 180 (e.g., WLRSV) receives power along the same electric control line as the sensor.

It should further be noted that while the embodiment of FIGS. 1F and 1G employ only two downhole devices (e.g., first downhole device 170 and second downhole device 180), and thus two frequency filters (e.g., low frequency filter 196*a* and high frequency filter 196*b*), other embodiments may exist wherein more than two downhole devices and more than two frequency filters are employed. For example, another embodiment might exist wherein the downhole tool includes first, second and third downhole devices, along with a low frequency filter, medium frequency filter and high frequency filter to achieve the same purpose as disclosed above. This idea could be expanded to any number of downhole devices and frequency filters.

Figure 1H:
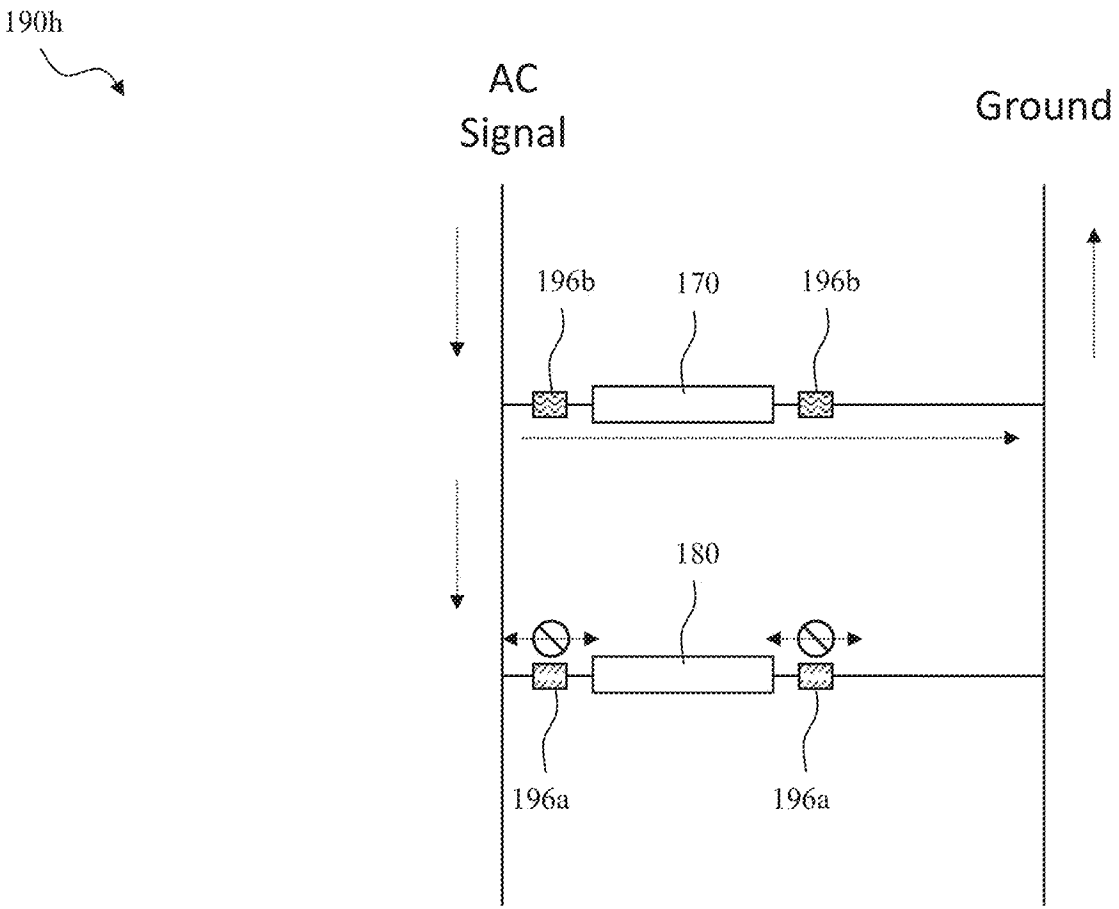
Figure 11:
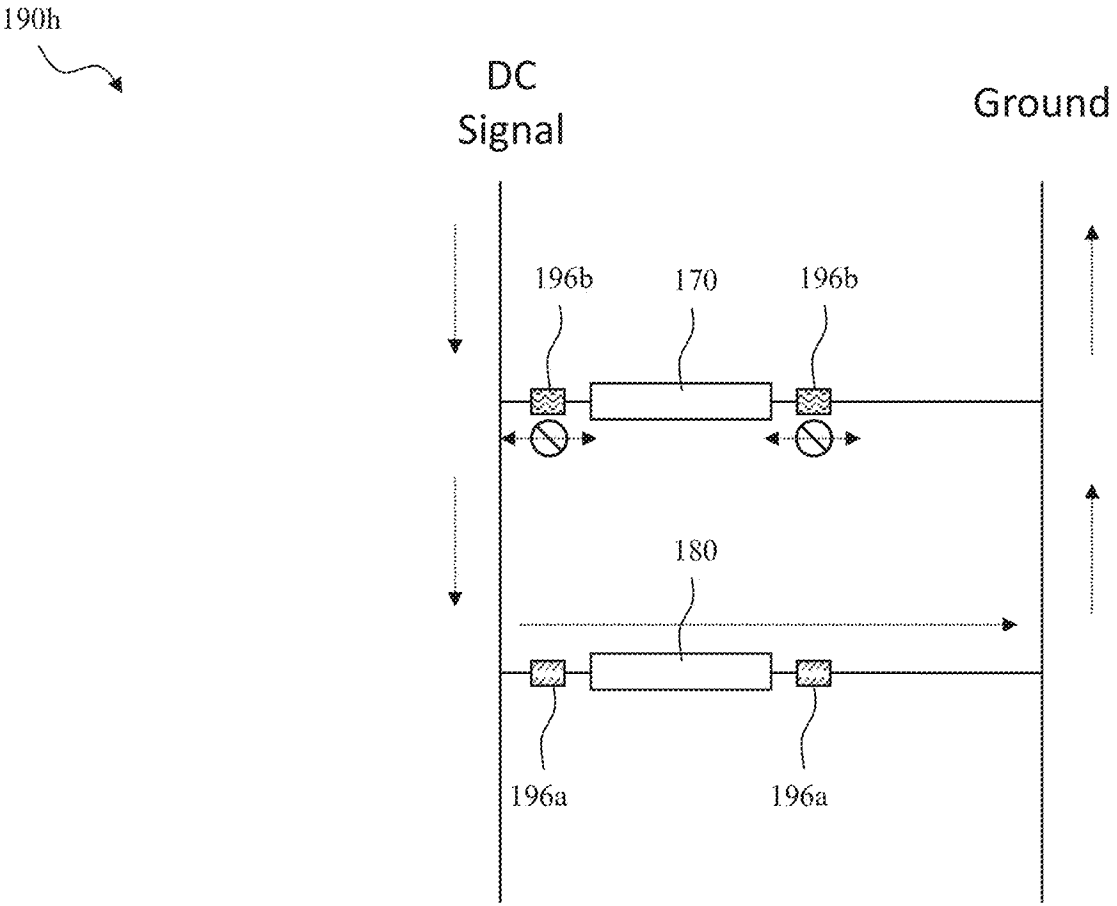

Turning to FIGS. 1H and 1I, illustrated is one embodiment of a switch system 190*h* designed, manufactured and/or operated according to one or more embodiments of the disclosure, as might be used in the well system 100 of FIG. 1A. In the embodiment of FIGS. 1H and 1I, ones (e.g., pairs) of low frequency filters 196*a* surround the second downhole device 180 and ones (e.g., pairs) of high frequency filters 196*b* surround the first downhole device 170. Accordingly, as shown in FIGS. 1H and 1I, a low frequency signal will only power the second downhole device 180 and a high frequency signal will only power the first downhole device 170. Thus, by switching the frequency of the power source, ones of the first downhole device 170 and second downhole device 180 will be powered. Furthermore, while the embodiment of FIGS. 1H and 1I employ ones (e.g., pairs) of low frequency filters 196*a* surrounding the first downhole device 170 or high frequency filters 196*b*, and ones (e.g., pairs) of high frequency filters 196*b* or low frequency filters 196*a* surrounding the second downhole device 180, other embodiments exist wherein a single low frequency filter 196*a* and/or a single high frequency filter 196*b* is positioned on one side or the other of the first downhole device 170 or second downhole device 180 (e.g., as shown in FIGS. 1F and 1G). Furthermore, not all embodiments require both the high frequency filter 196*b* and low frequency filter 196*a*, and thus certain circumstances may arise wherein a single frequency filter (e.g., either the high frequency filter 196*b* or the low frequency filter 196*a*) is employed, but not both. For example, the first output may be coupled to the first electrical component of the first downhole device via the frequency filter or the second output may be coupleable to the second electrical component of the second downhole device via the frequency filter, the frequency filter configured to switch power between the electric control line and the first downhole device or the electric control line and the second downhole device based upon switching a signal of the power source.

It should be noted that the embodiments of FIGS. 1F through 1I employ electromagnetic coupling to power the first downhole device 170 and the second downhole device 180. Nevertheless, other embodiments could be employed wherein direct electrical coupling powers the first downhole device 170 and the second downhole device 180. In yet another embodiment, a combination of electromagnetic coupling and direct coupling could be employed to power the first downhole device 170 and the second downhole device 180.

Figure 1J:
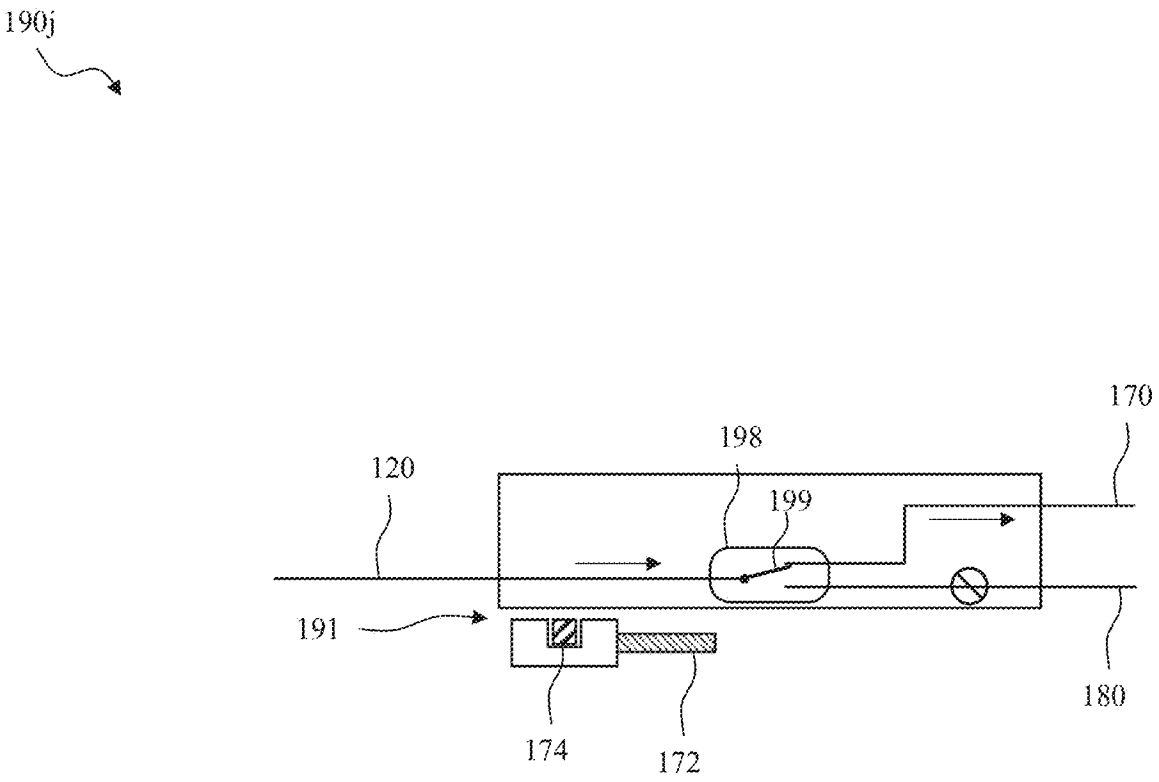
FIGS. 1J and 1K illustrate an alternative embodiment of a switch system designed, manufactured and/or operated according to one or more embodiments of the disclosure, as might be used in the well system of FIG. 1A.
Figure 1K:
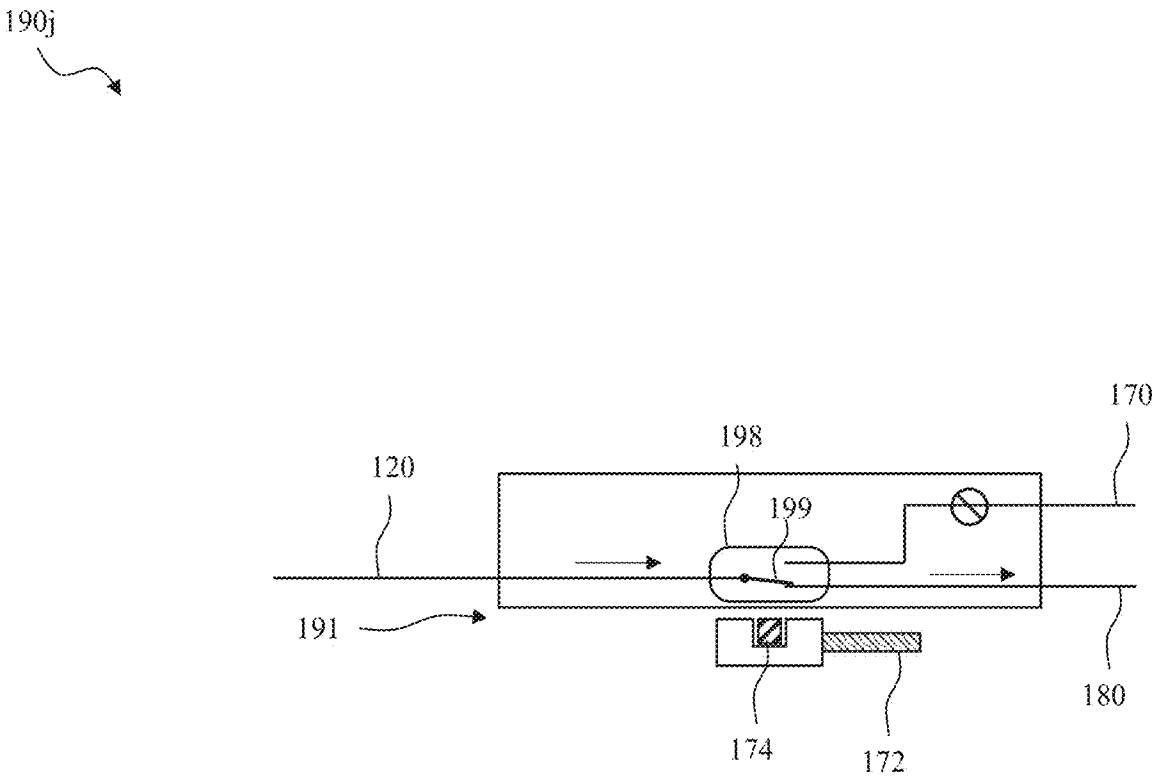

Turning to FIGS. 1J and 1K, illustrated is one embodiment of a switch system 190*j* designed, manufactured and/or operated according to one or more embodiments of the disclosure, as might be used in the well system 100 of FIG. 1A. The switch system 190*j* contains a magnetically activated switch 198. In one embodiment, the magnetically activated switch 198 is a reed switch, as shown in FIGS. 1J and 1K. When there is no magnetic field being subjected to the magnetically activated switch 198, such as shown in FIG. 1J, then the contact 199 in the reed switch is biased (e.g., inherently biased) towards an electrical connection with the first downhole device 170, and thus power (e.g., electrical current) can flow to that tool. When there is a magnetic field being subjected to the magnetically activated switch 198, such as shown in FIG. 1K, then the contact 199 in the reed switch is biased (e.g., mechanically biased) towards an electrical connection with the second downhole device 180, and thus power (e.g., electrical current) can flow to that tool. For example, in FIG. 1K the magnetic target 174 creates a magnetic attraction that pulls the contact 199 towards an electrical connection with the second downhole device 180 and thus power (e.g., electrical current) can flow to that tool. The magnetically activated switch 198 can employ first and second reed switches rather than the double throw switch that is shown, wherein the second reed switch is configured to work in conjunction with the first reed switch to switch power between the electric control line and the first downhole device and the electric control line and the second downhole device. One of the advantages of the reed switch is that it is a mechanically activated switch and contains no electronics. As an alternative embodiment, the magnetically activated switch 198 could be a tunnel magneto-resistance (TMR) switch. A TMR switch contains a magnetic tunnel junction where the resistance of the junction varies with magnetic field. The TMR switch varies between high resistance (open switch) and low resistance (closed switch) with applied magnetic field.

Figure 1L:
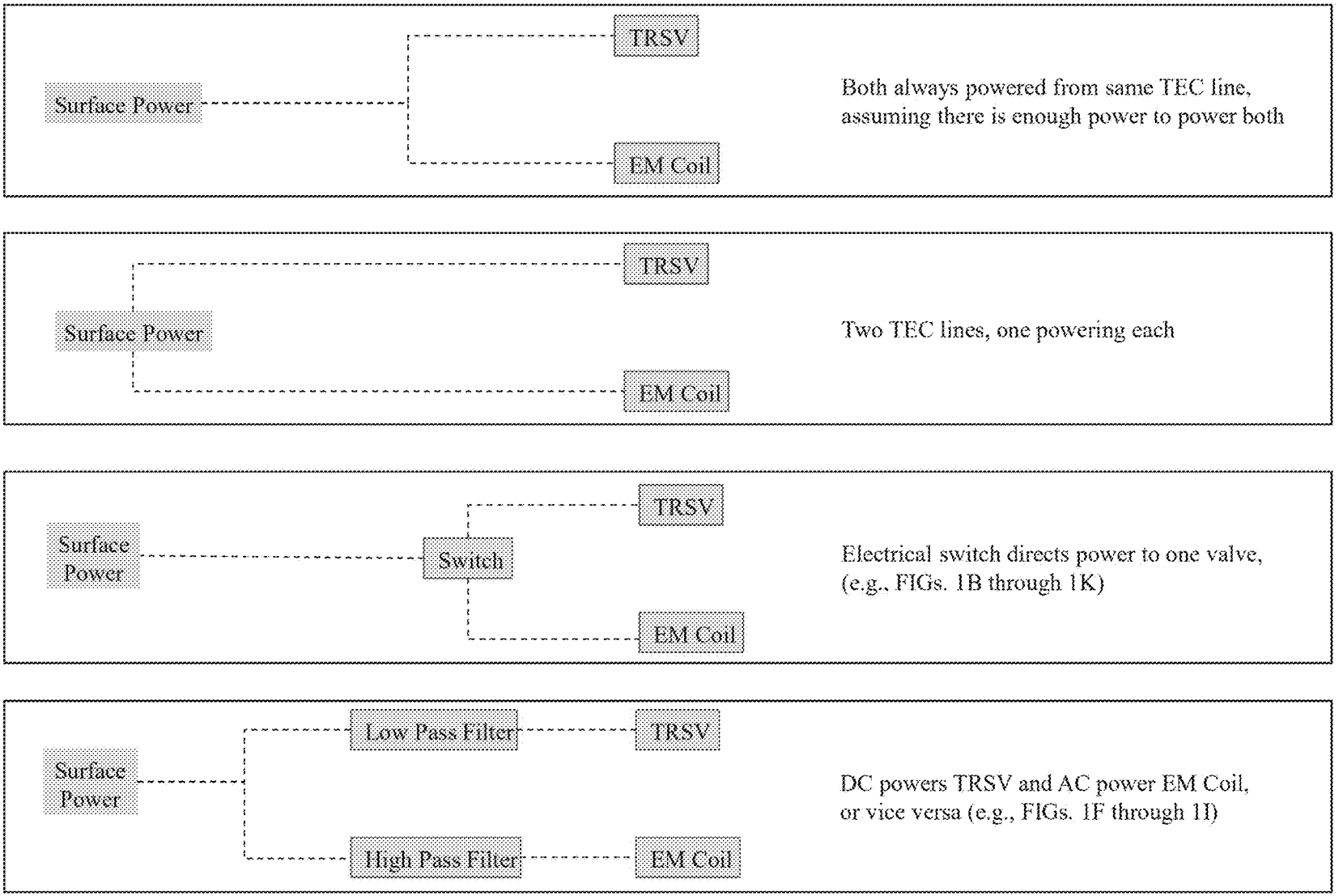
FIG. 1L illustrates a chart showing various different ways that an operator may provide power to a TRSV and/or WLRSV, including using a single electric control line, two dedicated electric control lines, a single electric control line with a switch, as well as a single electric control line with low/high frequency filters.

Turning to FIG. 1L, illustrated is a chart illustrating various different ways that an operator may provide power to the TRSV and/or WLRSV, including using a single electric control line, two dedicated electric control lines, a single electric control line with a switch, as well as a single electric control line with low/high frequency filters.

Figures 2A, 2B, 2C:
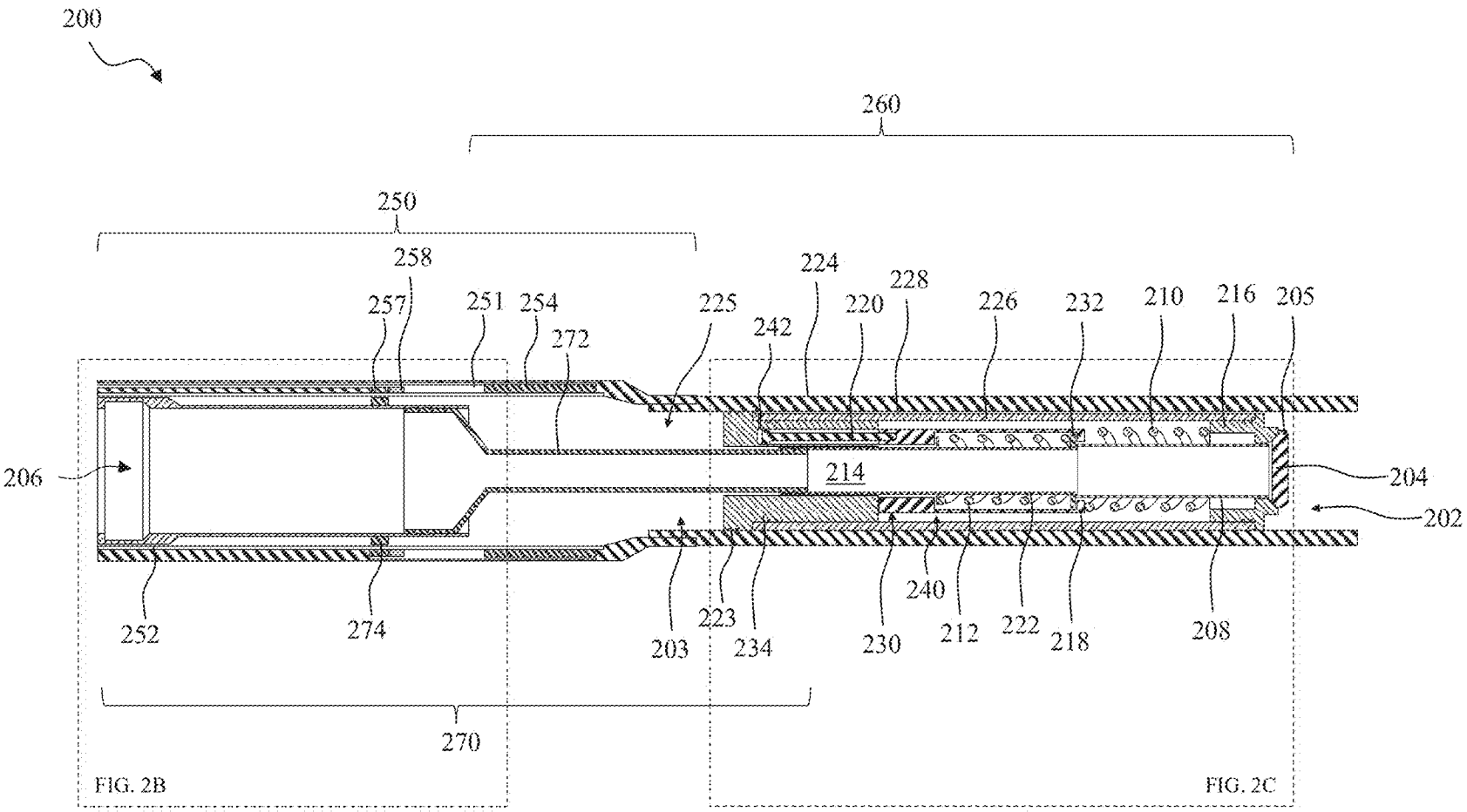
FIGS. 2A through 2F illustrate one embodiment of a safety valve designed, manufactured and/or operated according to one or more embodiments of the disclosure, as might employ first, second and third portions of a WLRSV.
Figure 2B:
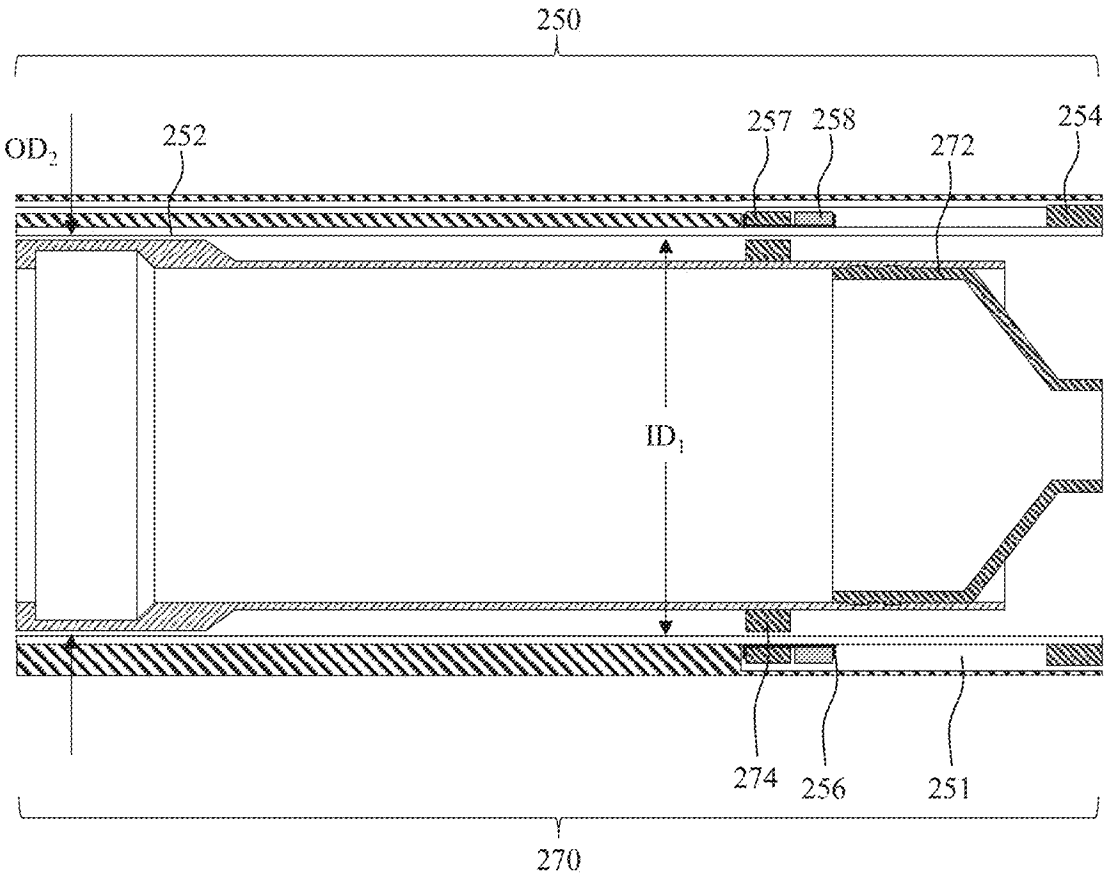
Figure 2C:
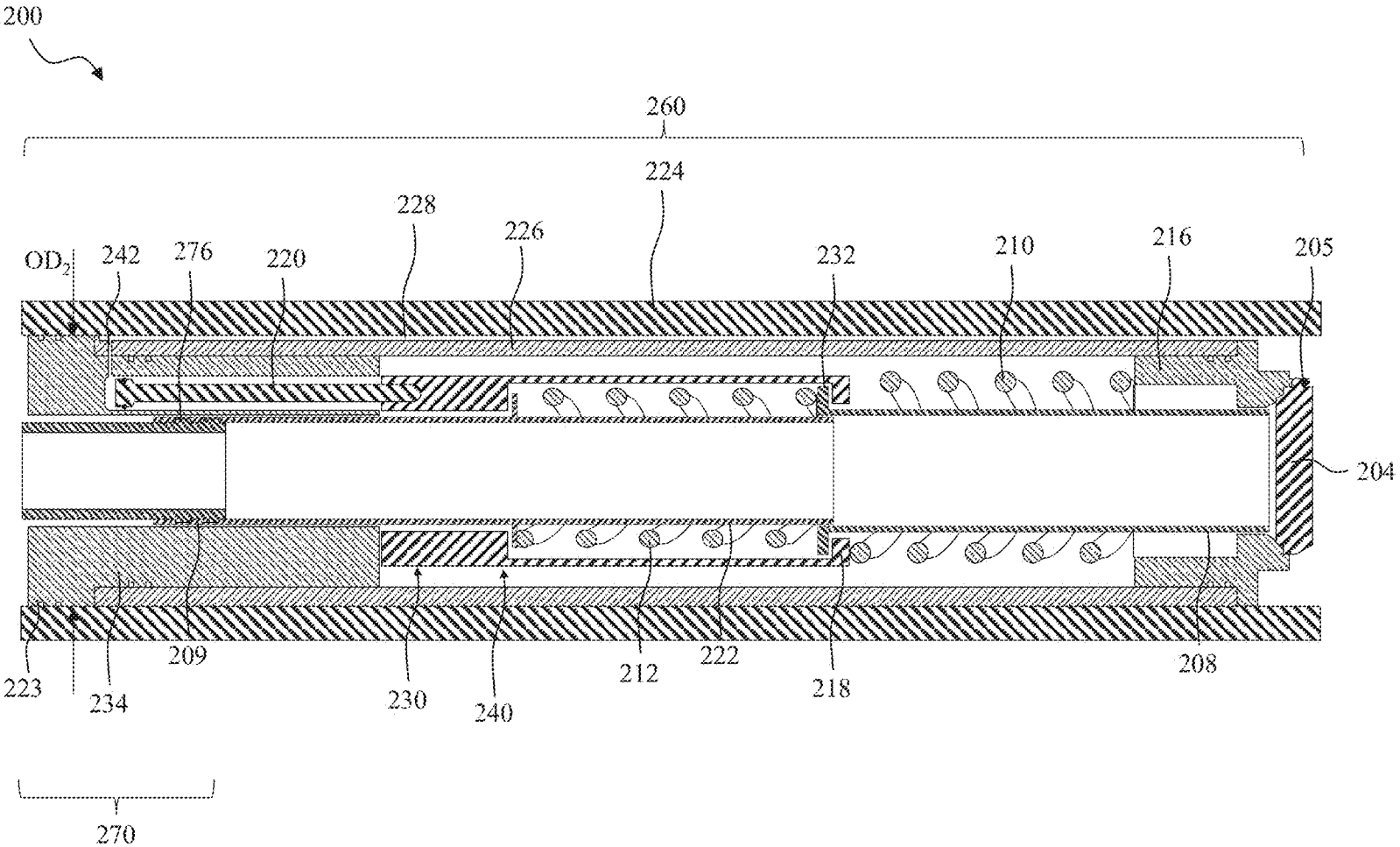
Figure 2D:
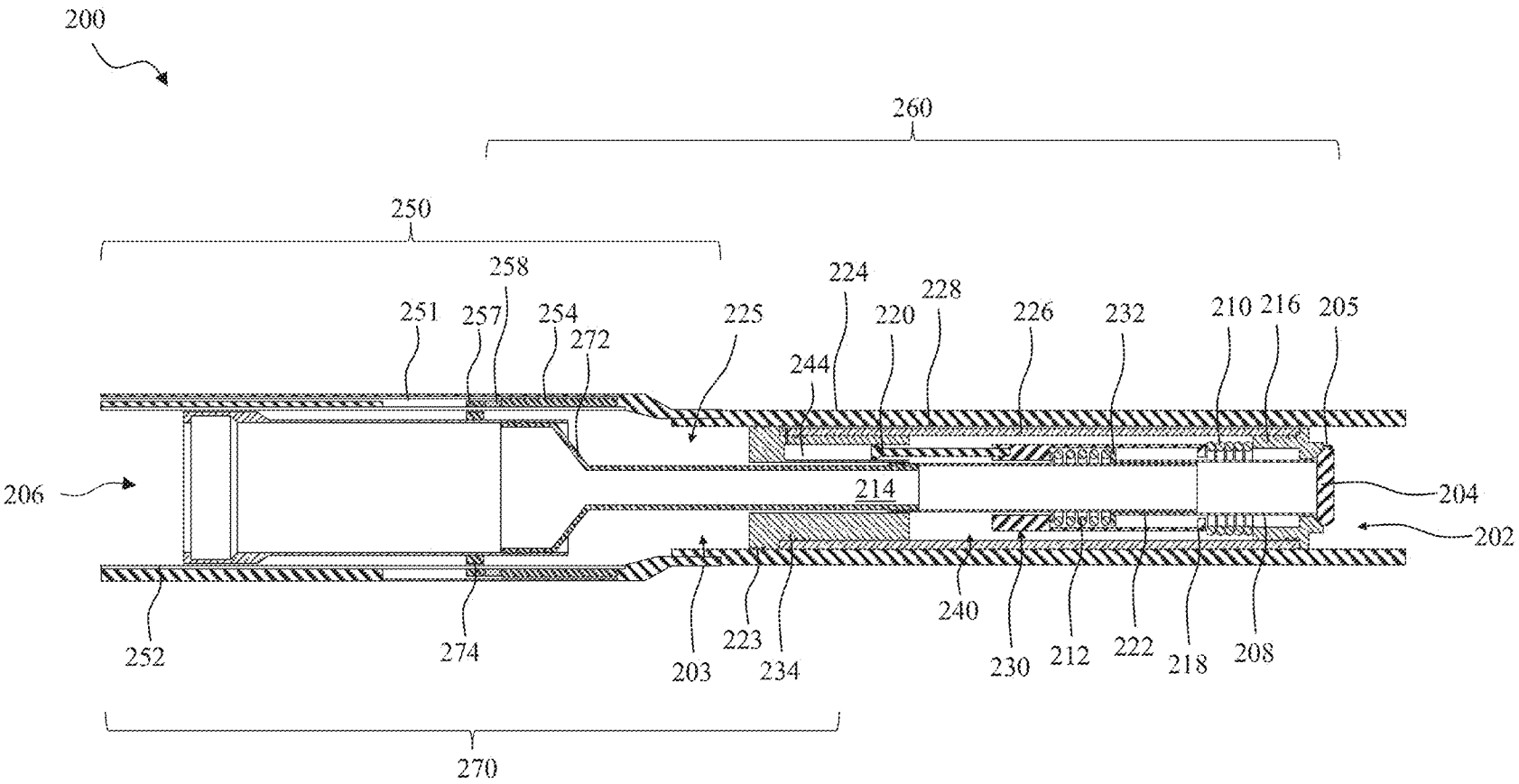
Figure 2E:
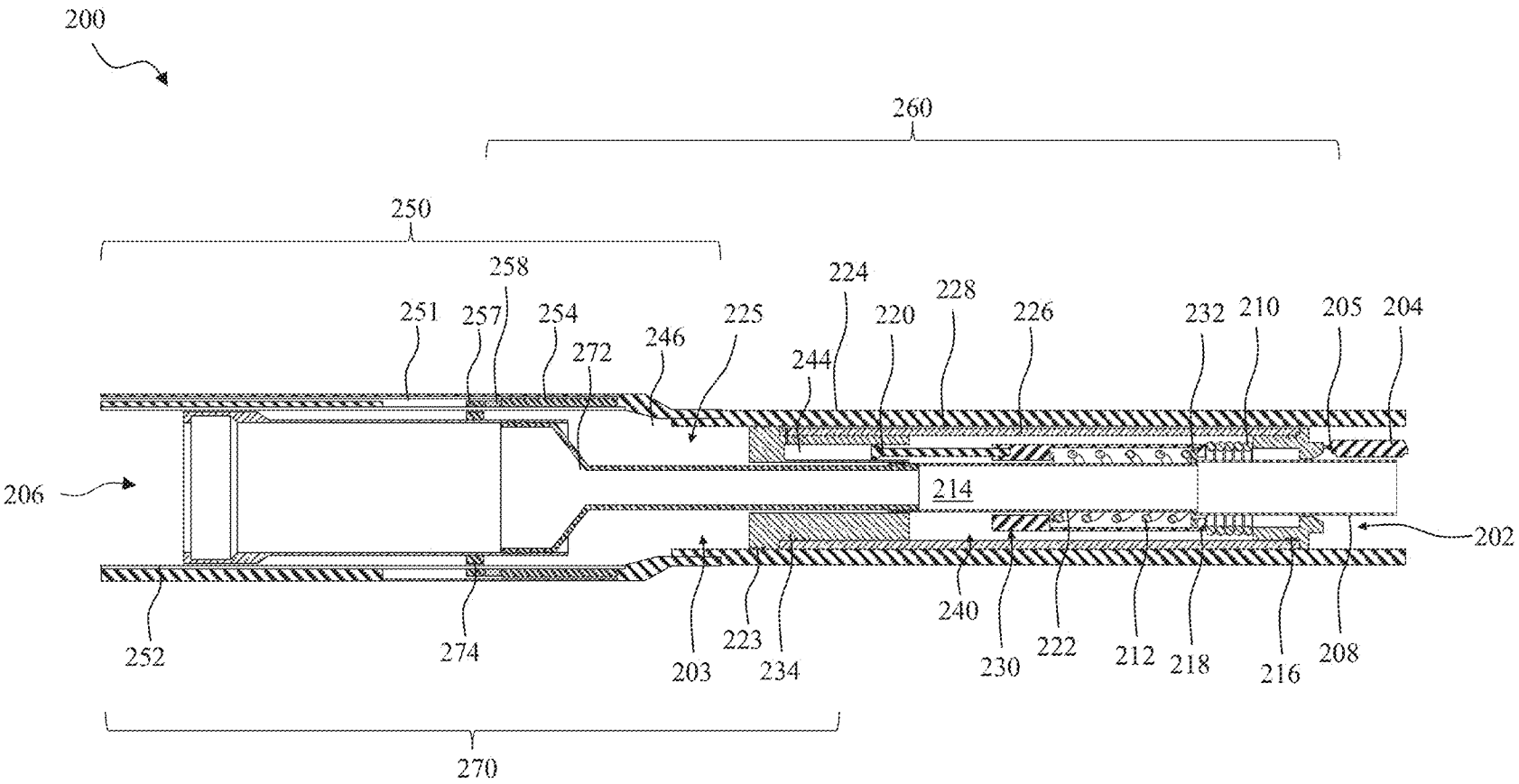
Figure 2F:
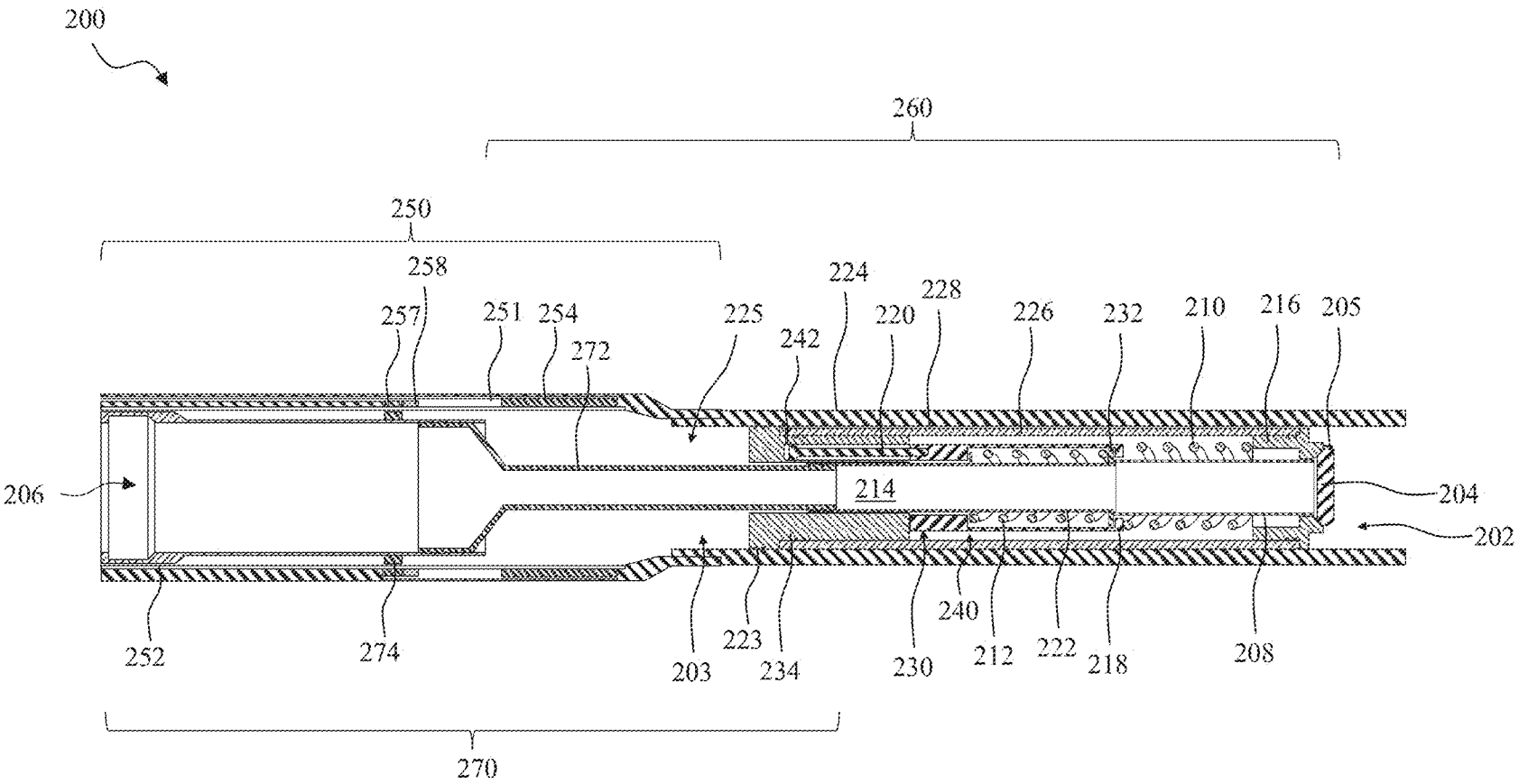
Figure 3A:
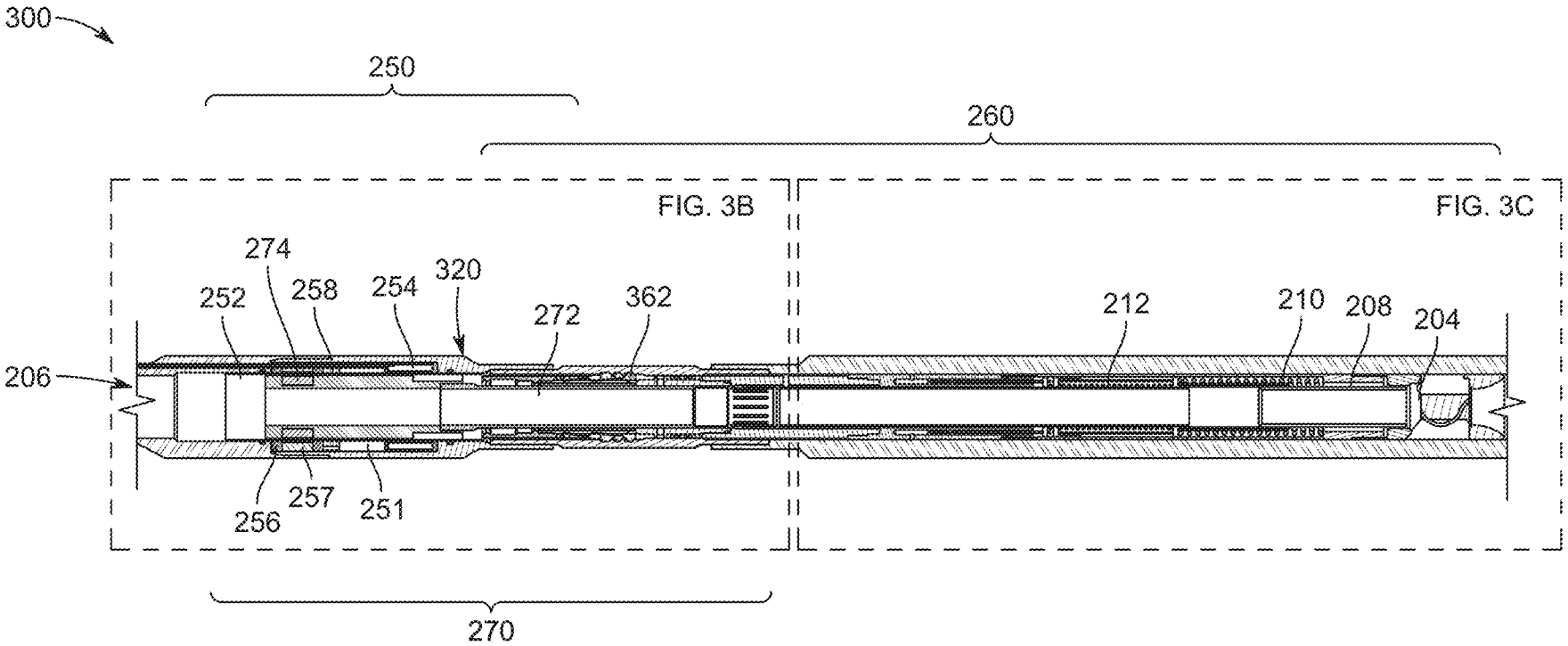
Figure 3B:
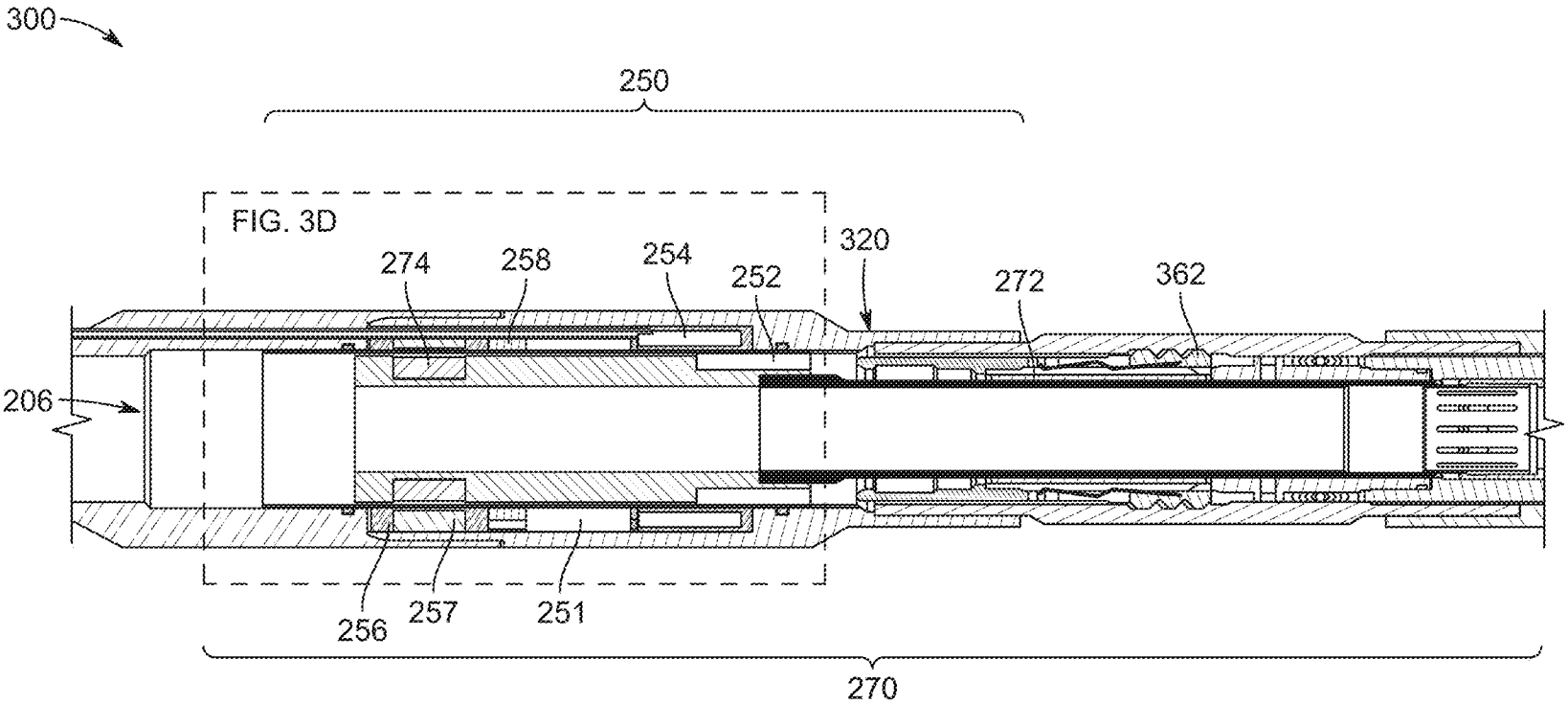
Figure 3C:
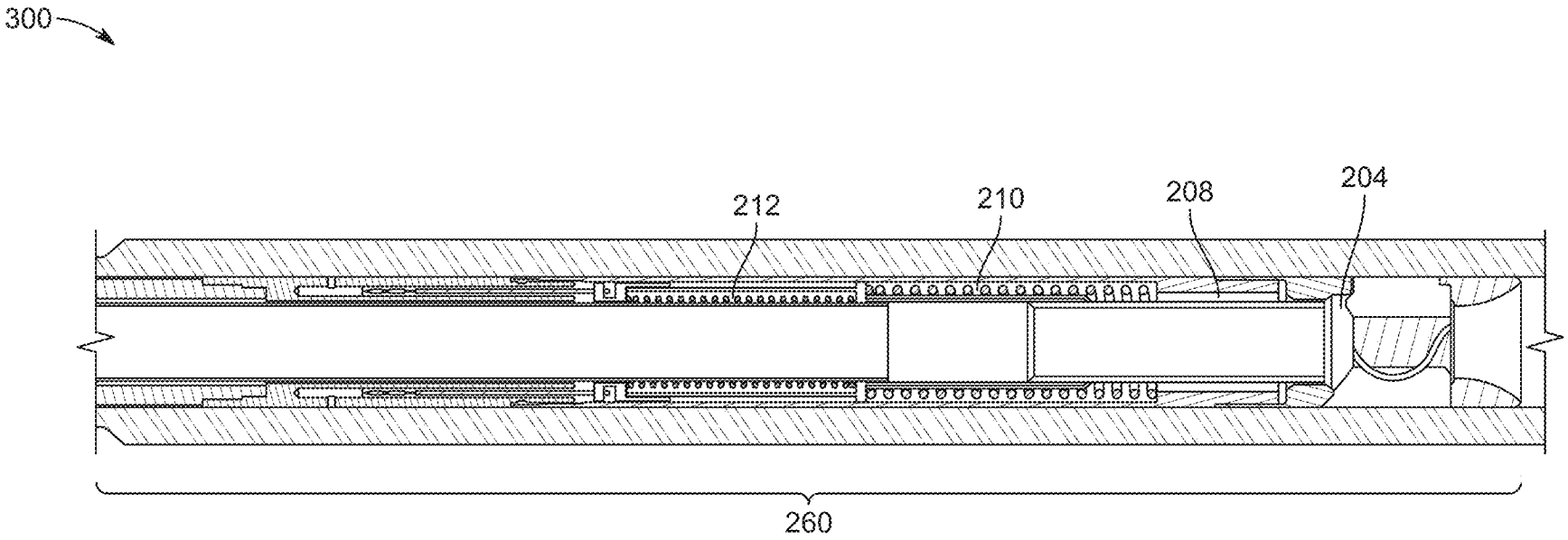
Figure 3D:
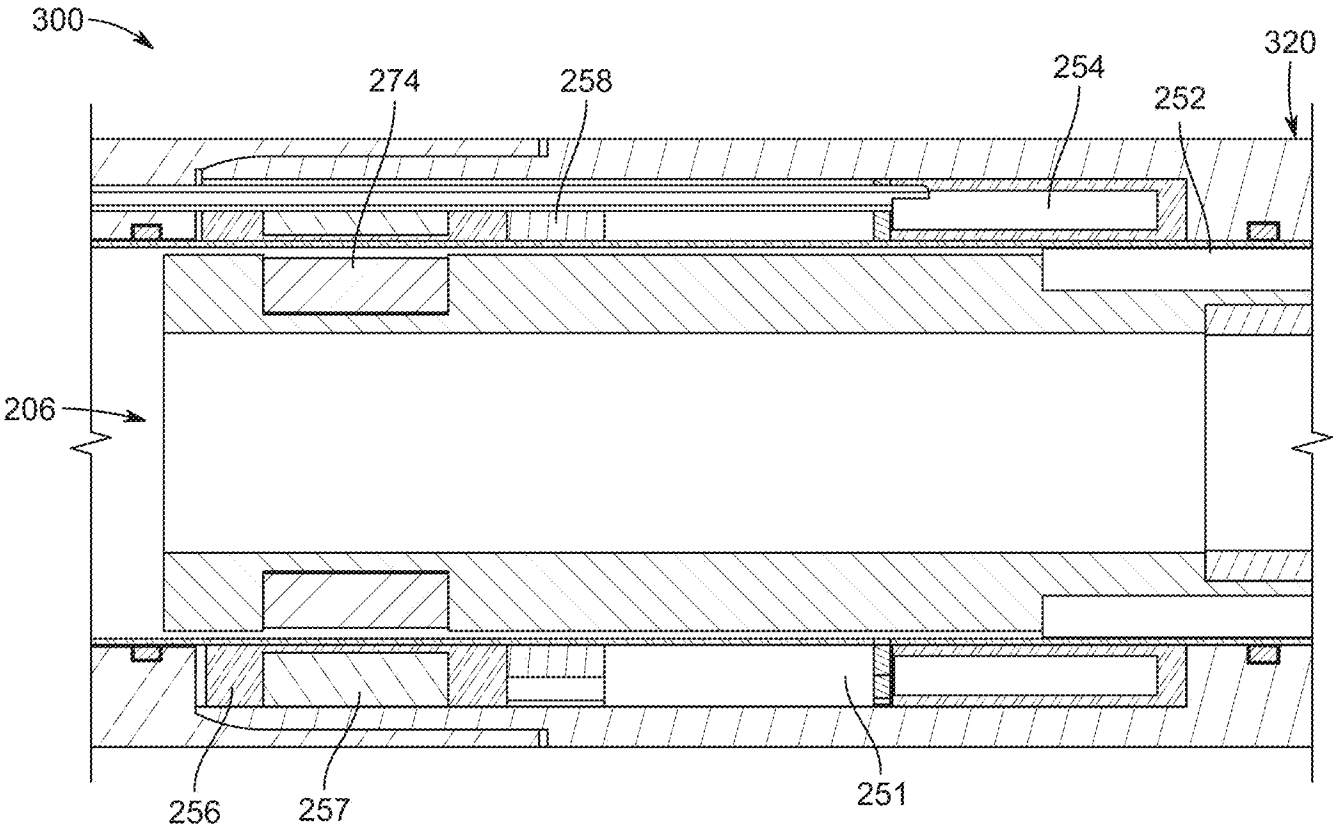
Figure 4A:
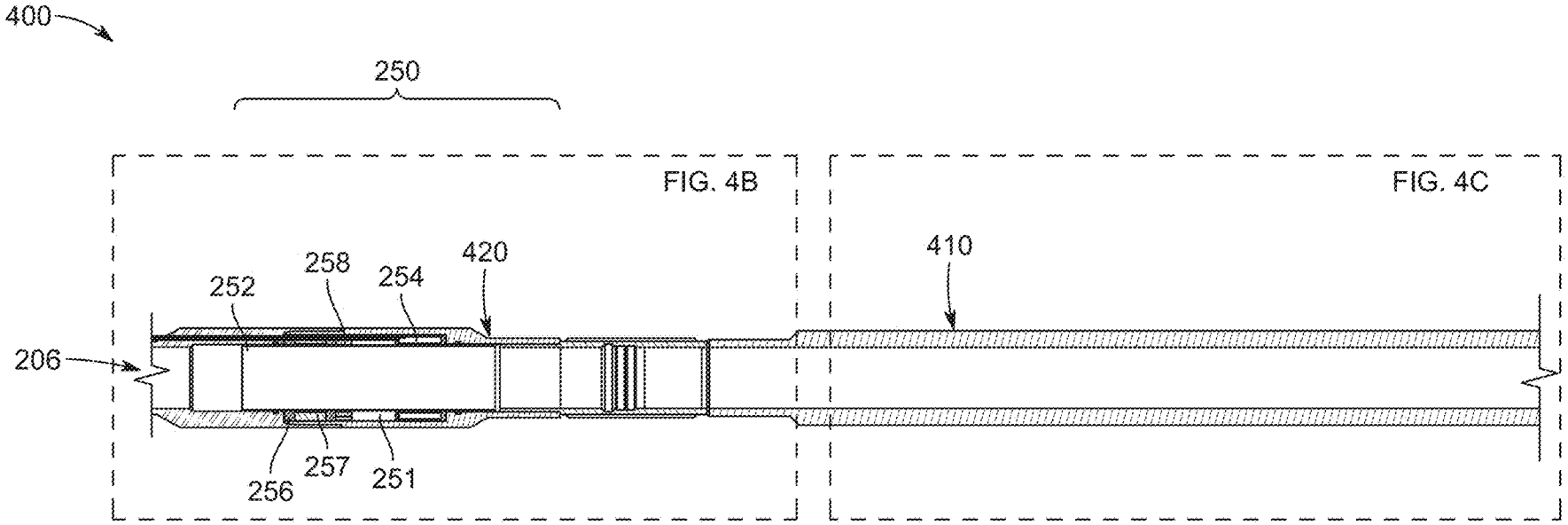
Figure 4B:
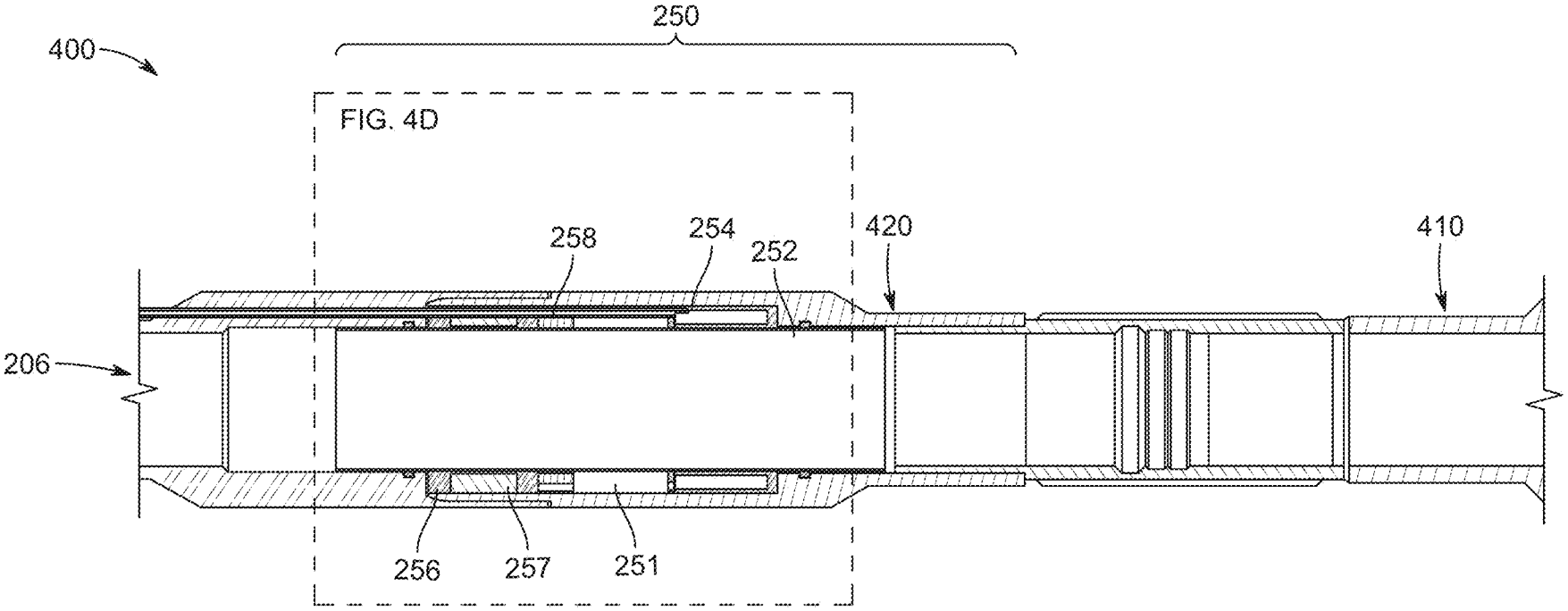
Figure 4C:
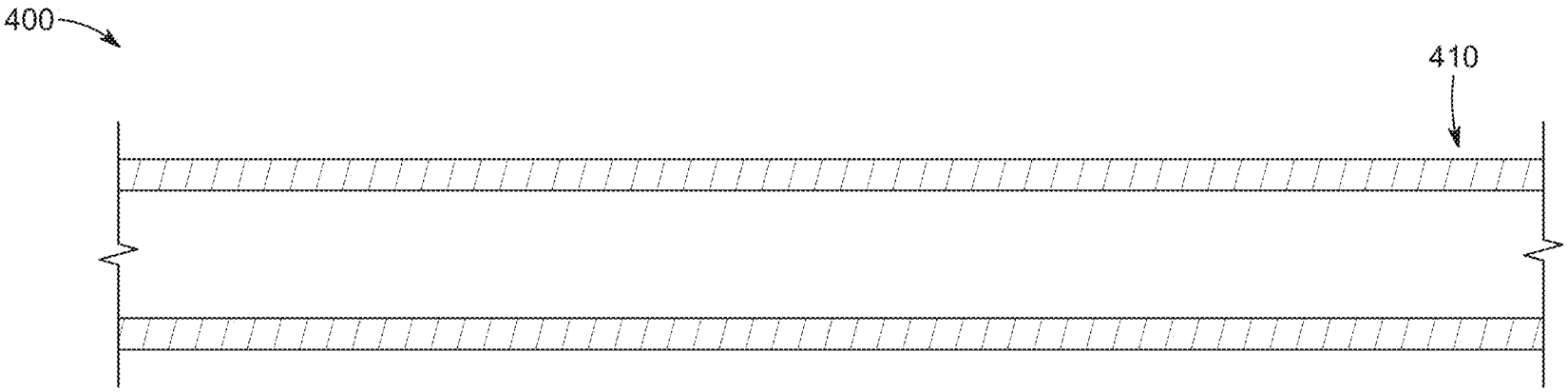
Figure 4D:
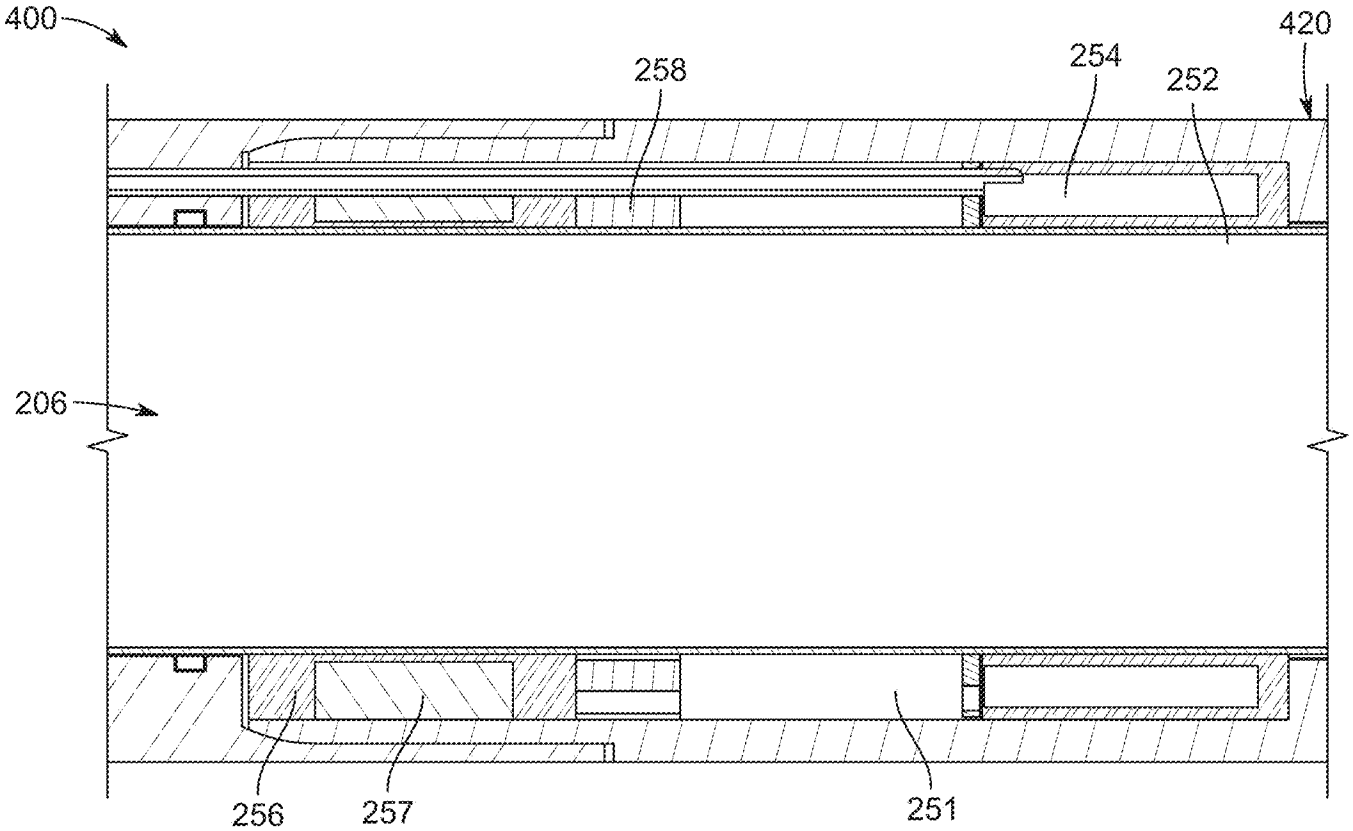
Figure 5A:
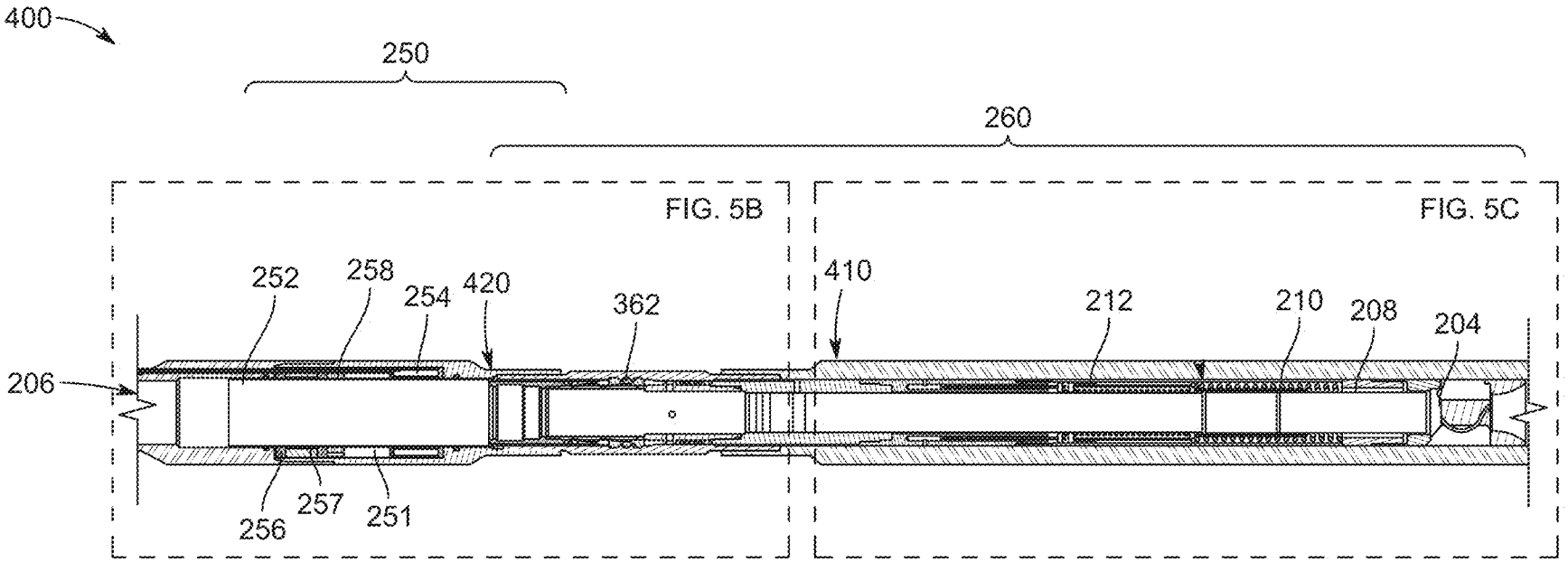
Figure 5B:
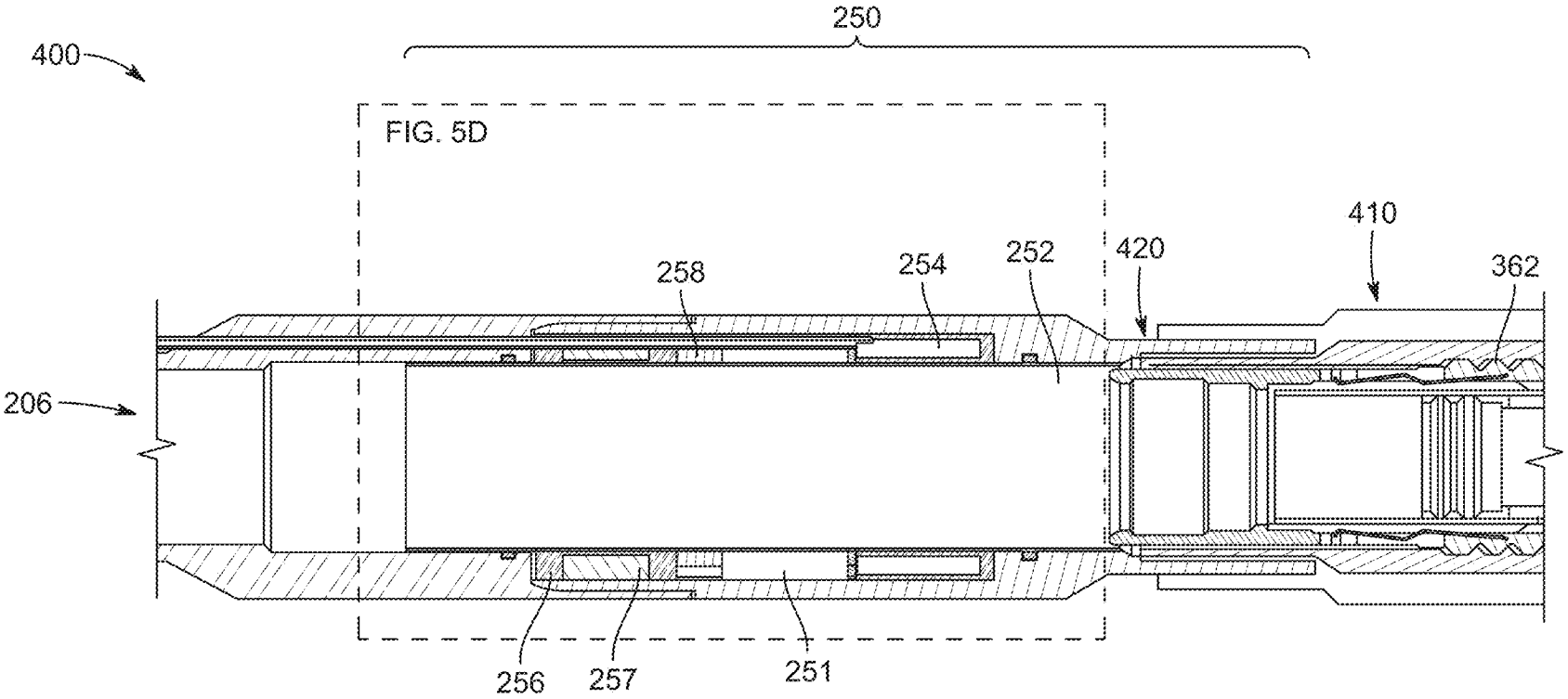
Figure 5C:
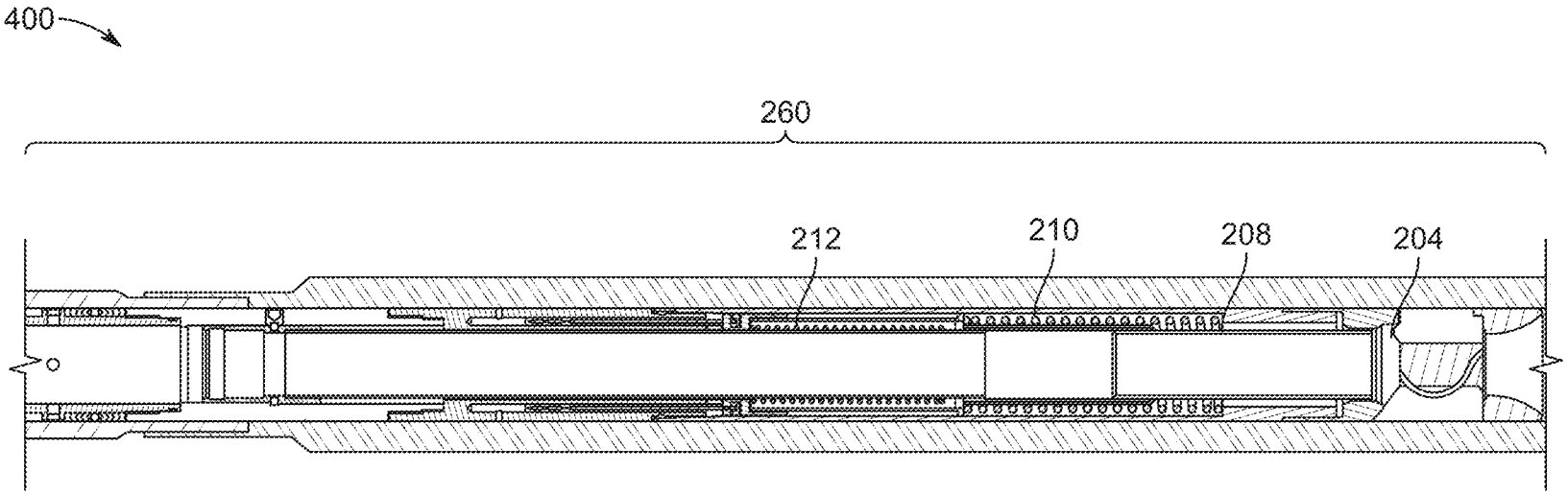
Figure 5D:
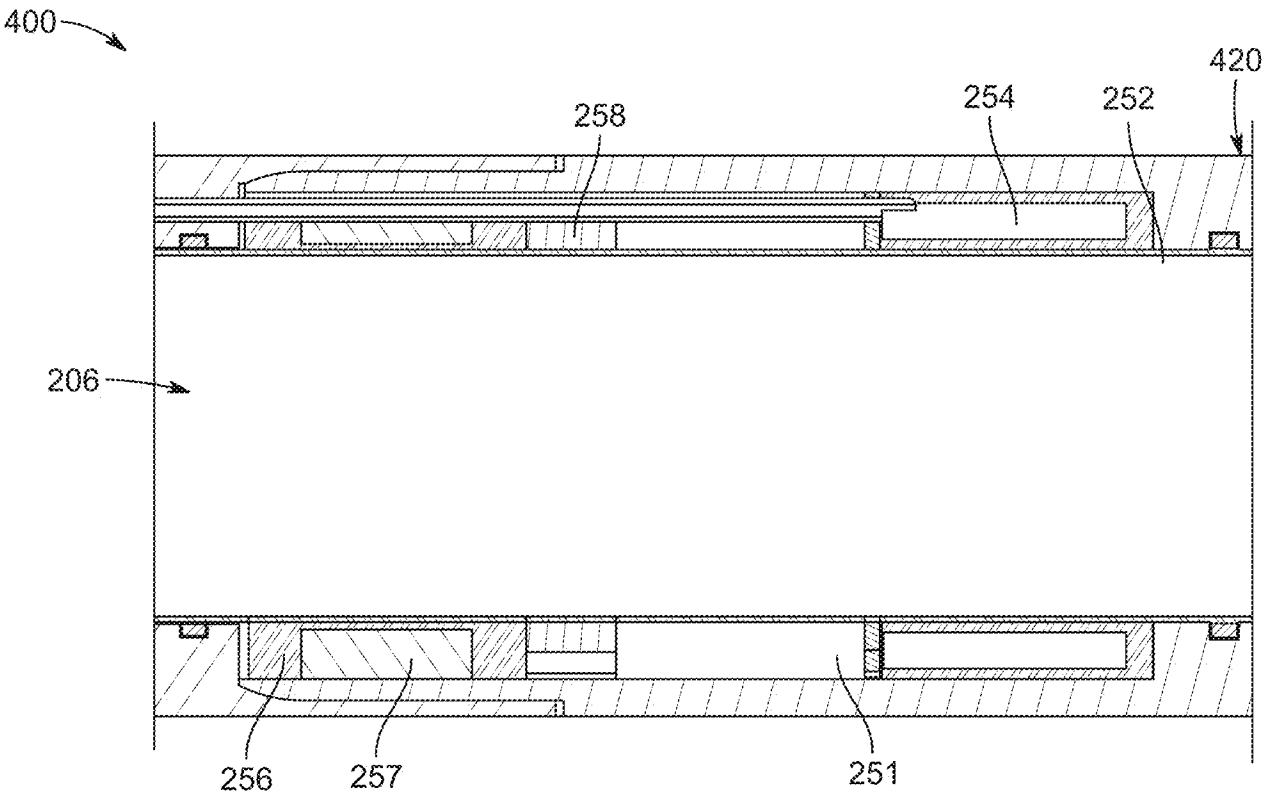
Figure 6A:
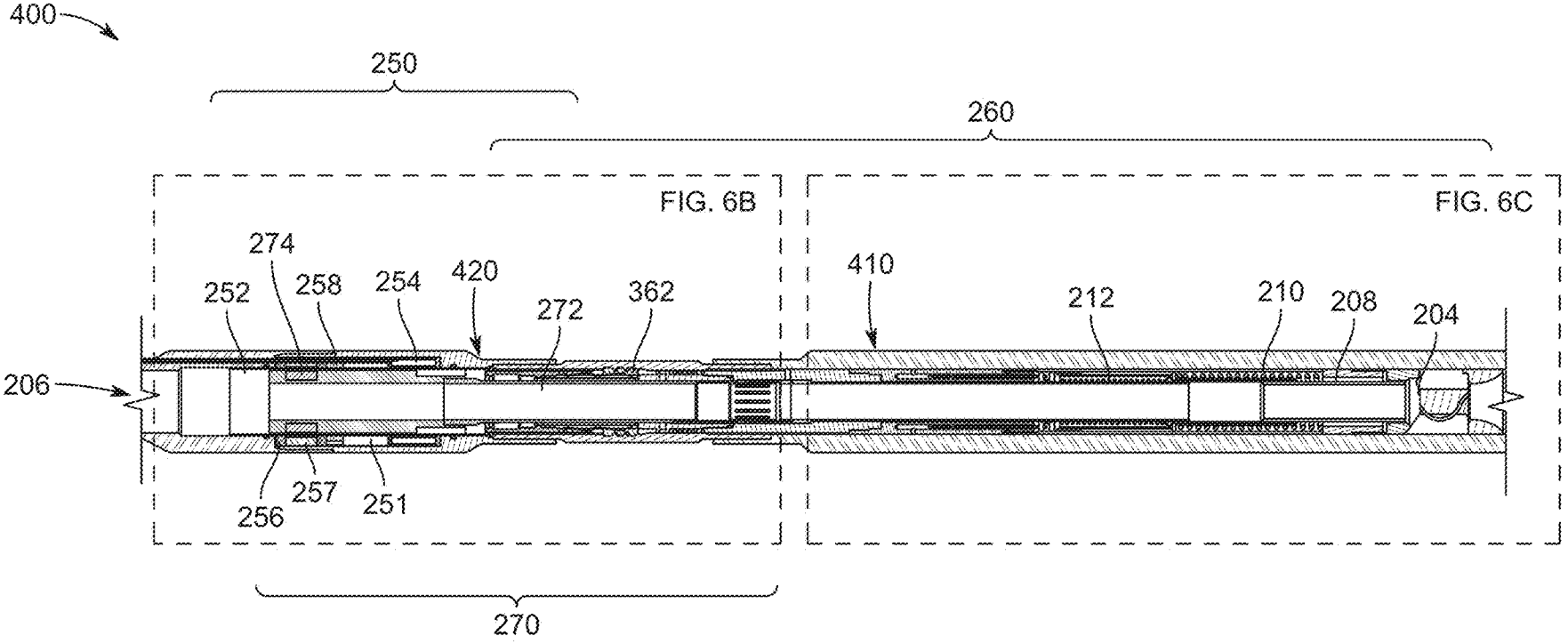
Figure 6B:
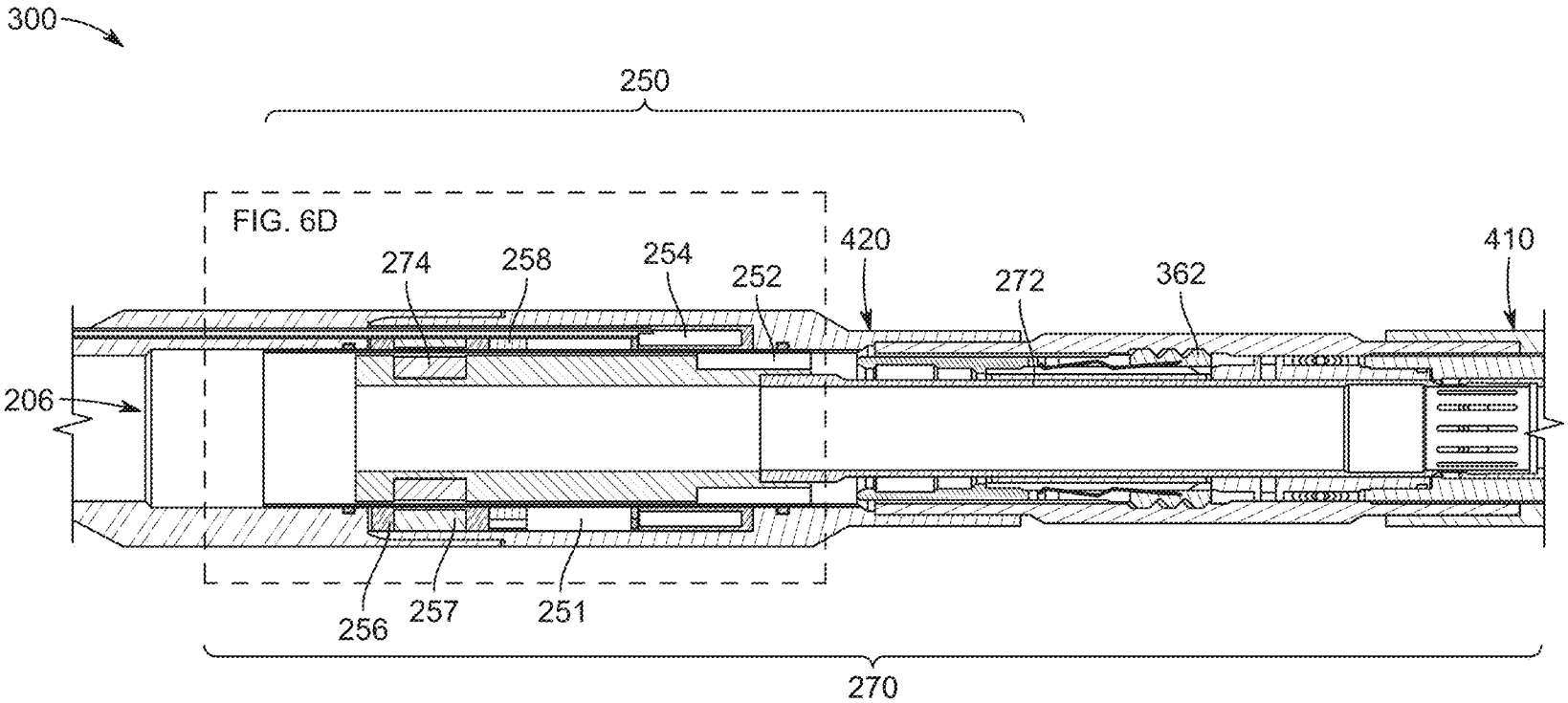
Figure 6C:
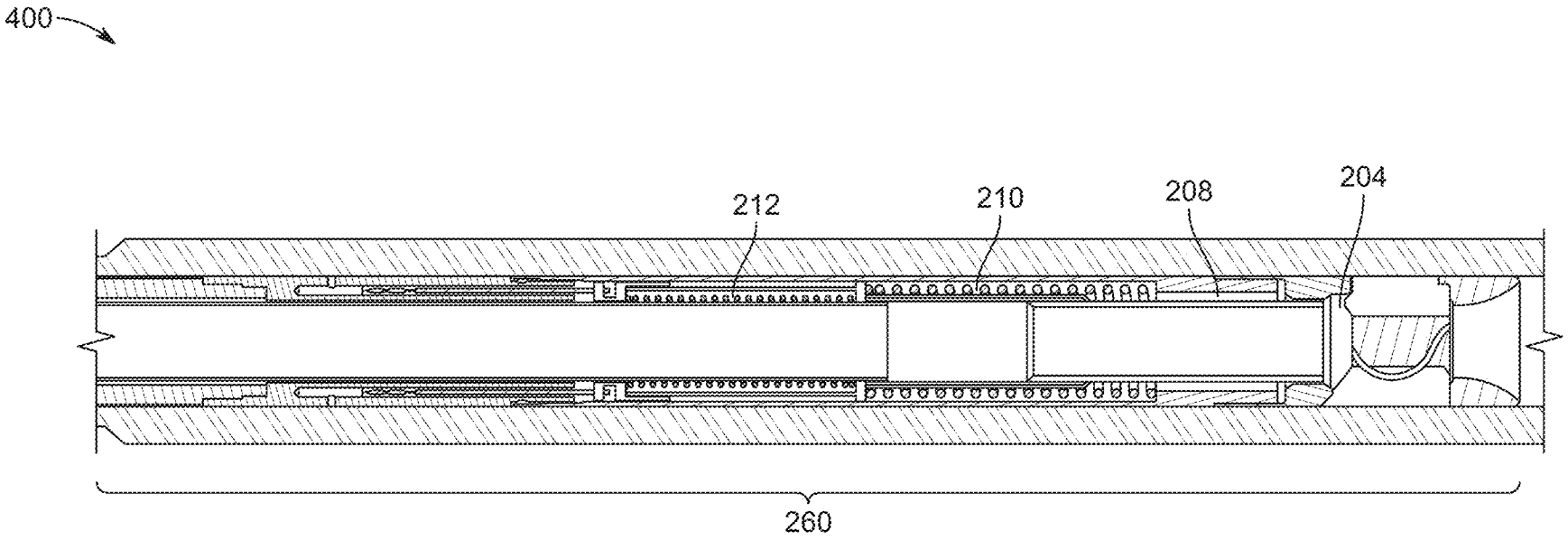
Figure 6D:
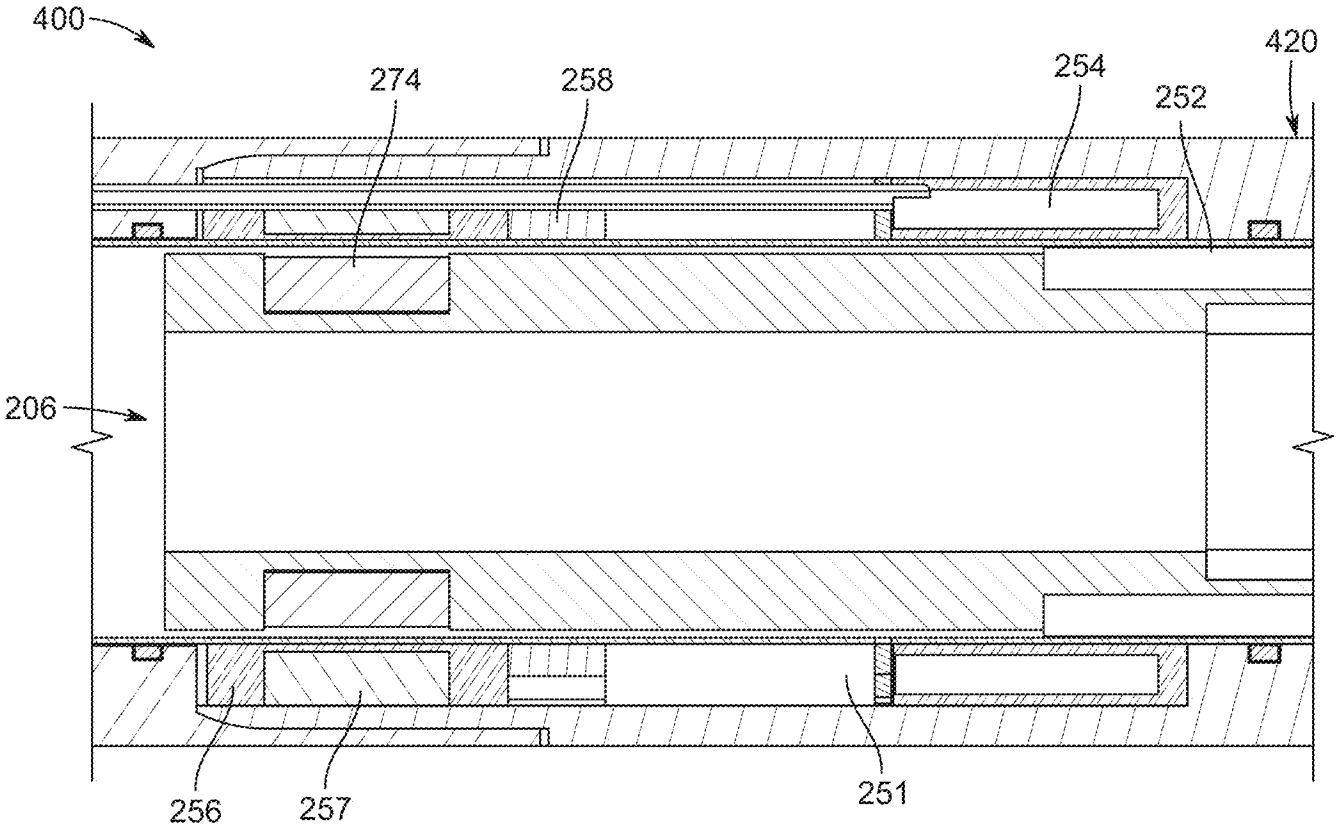
Figure 7A:
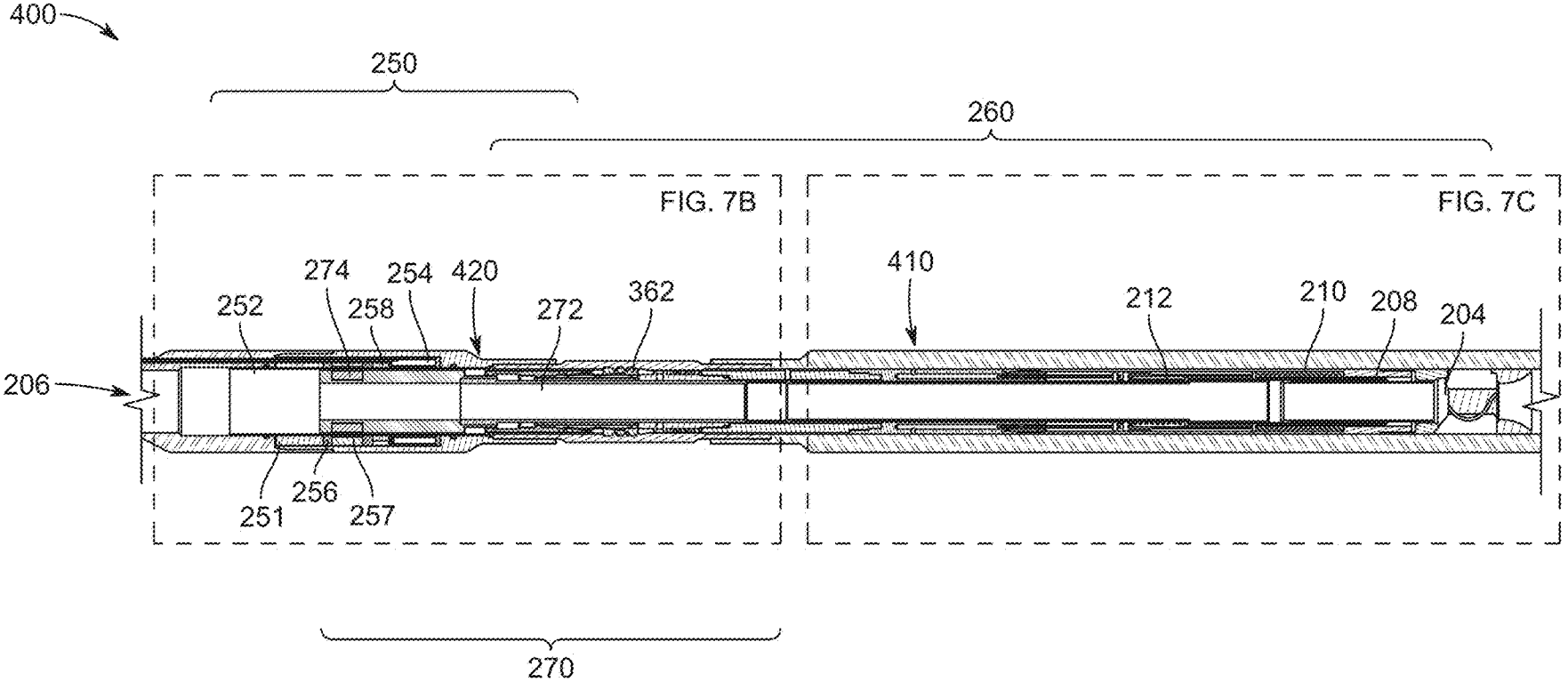
Figure 7B:
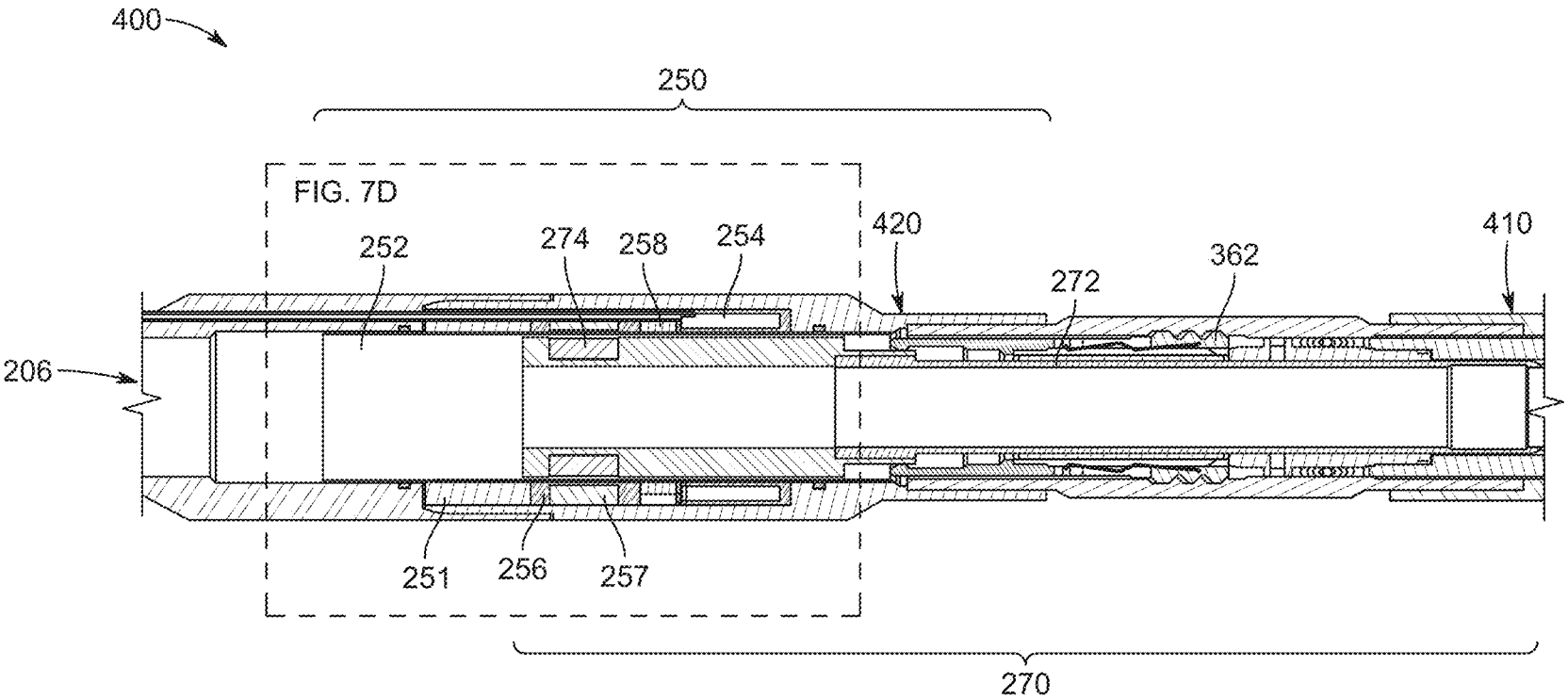
Figure 7C:
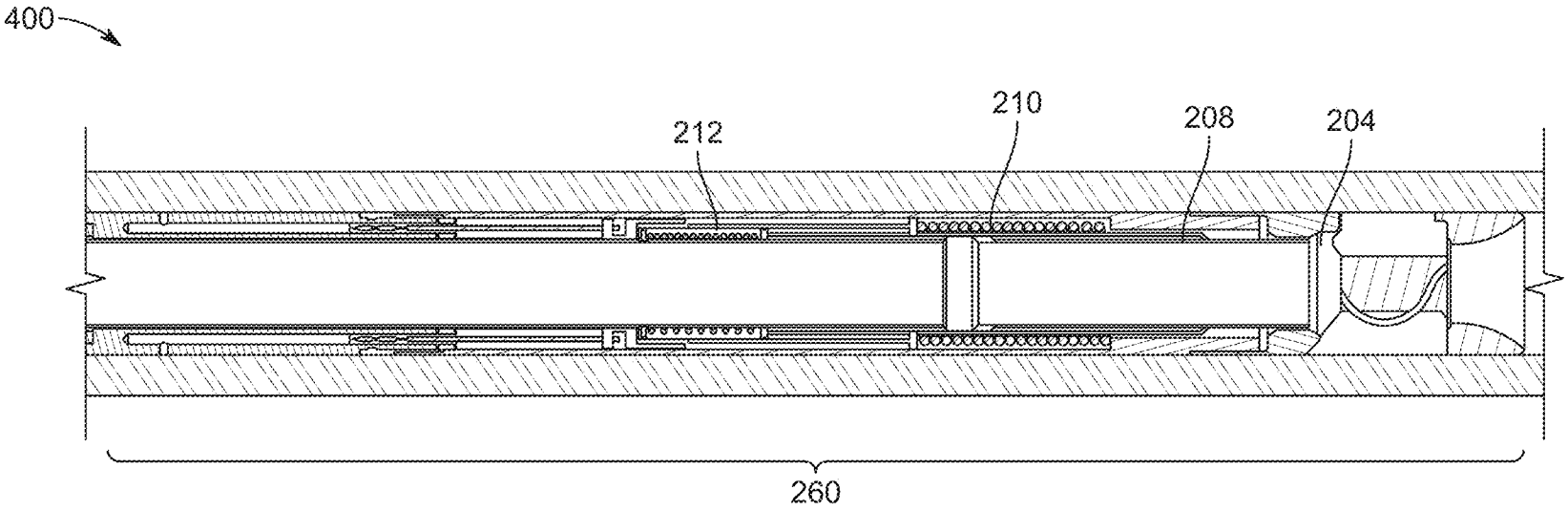
Figure 7D:
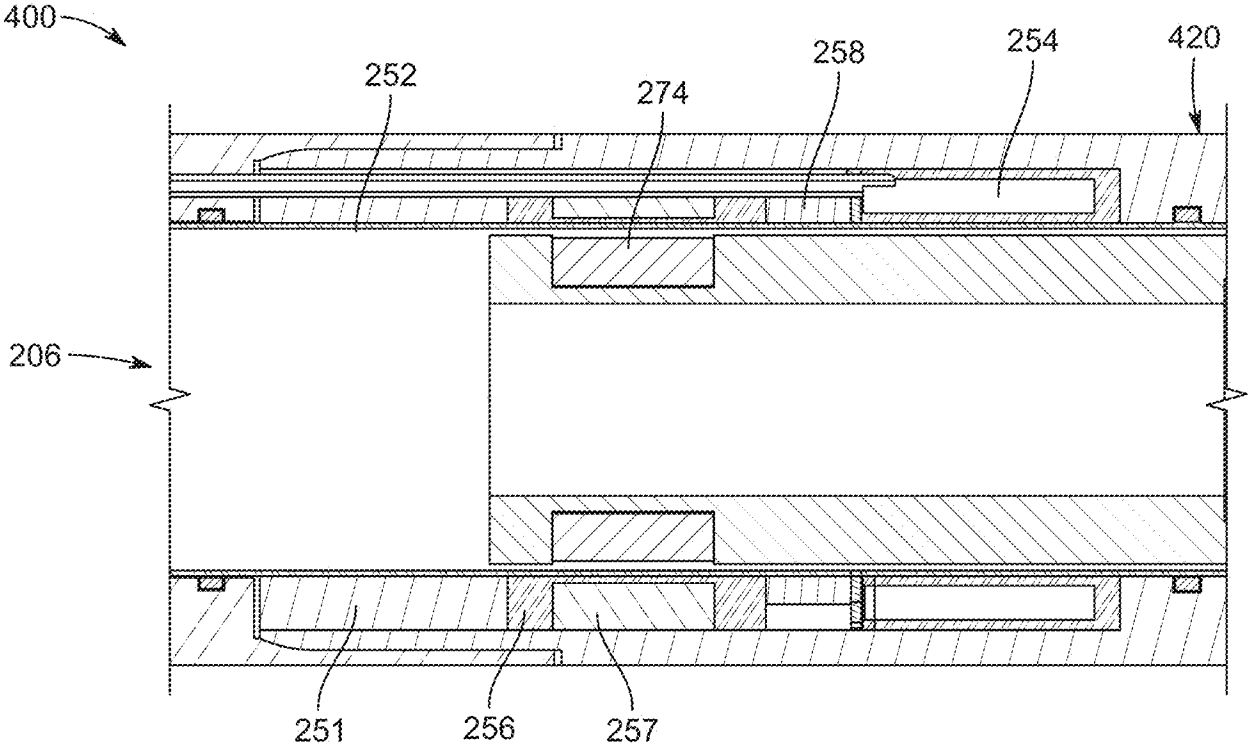
Figure 8A:
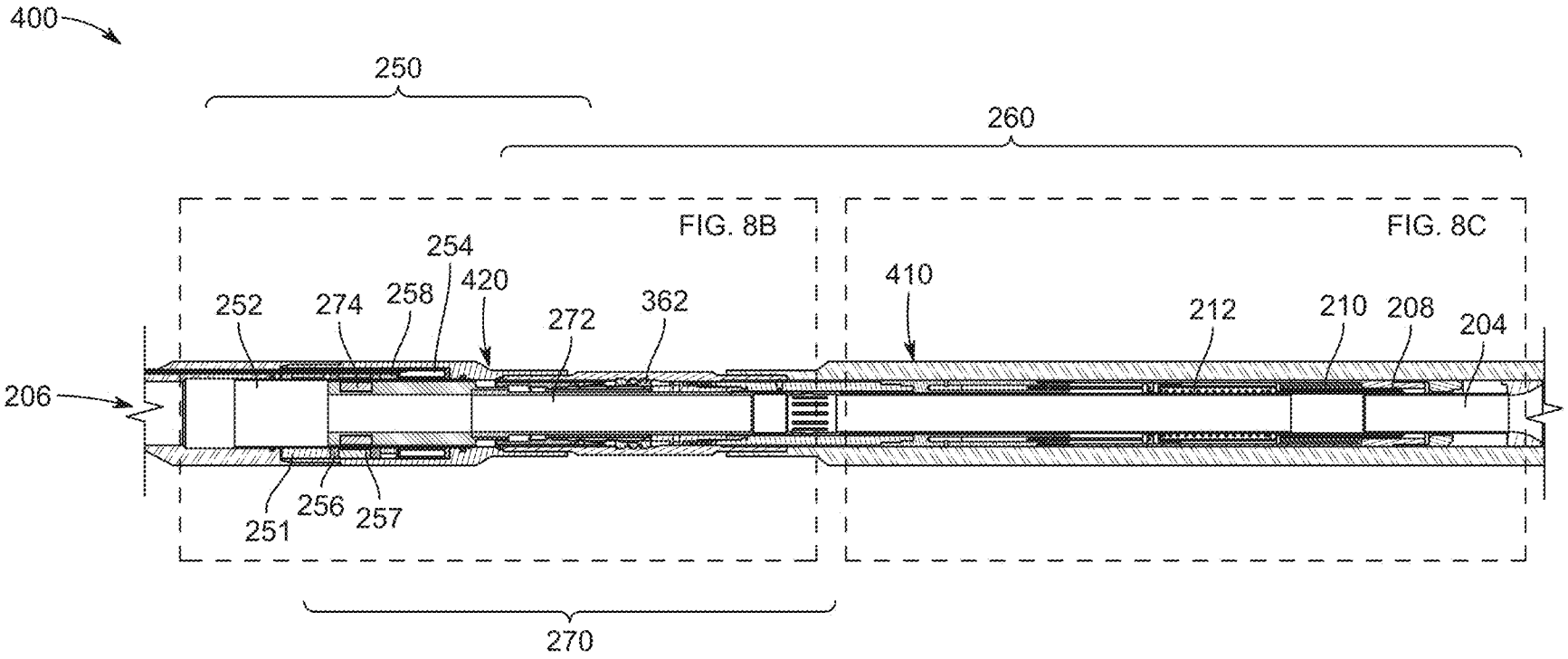
Figure 8B:
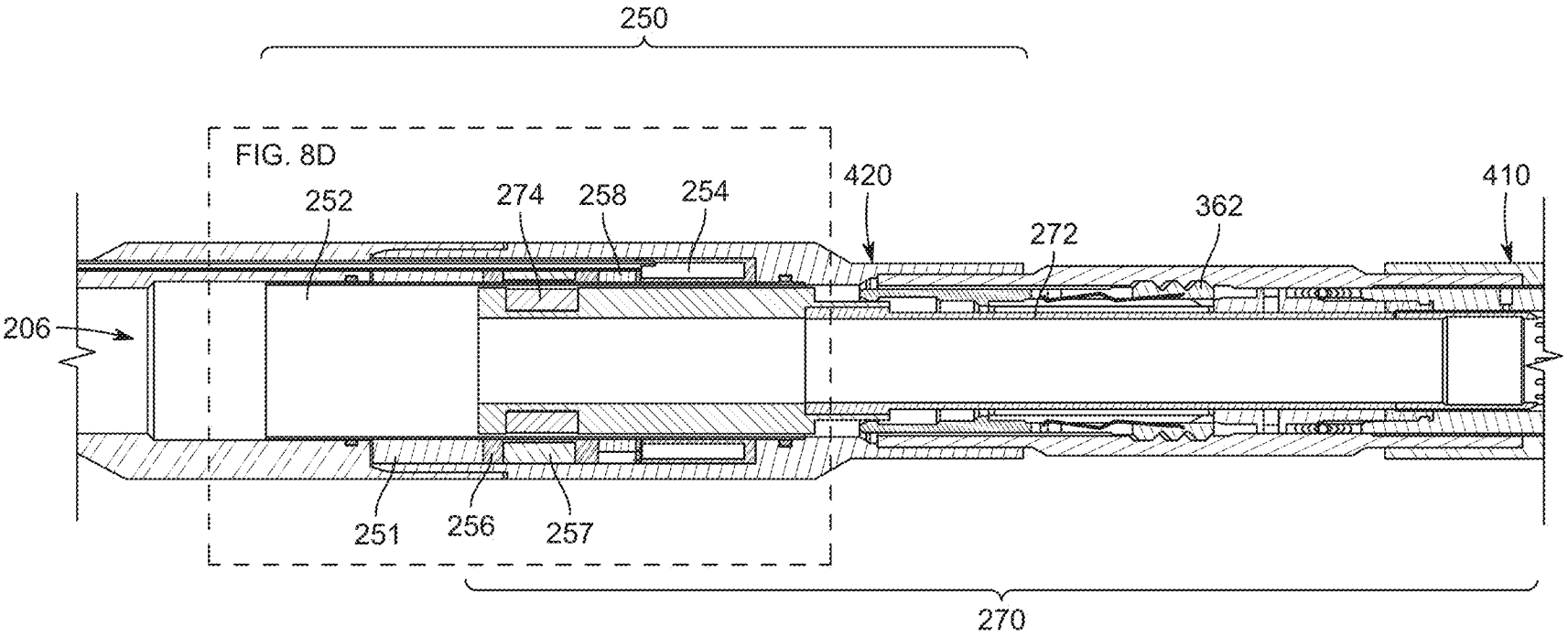
Figure 8C:
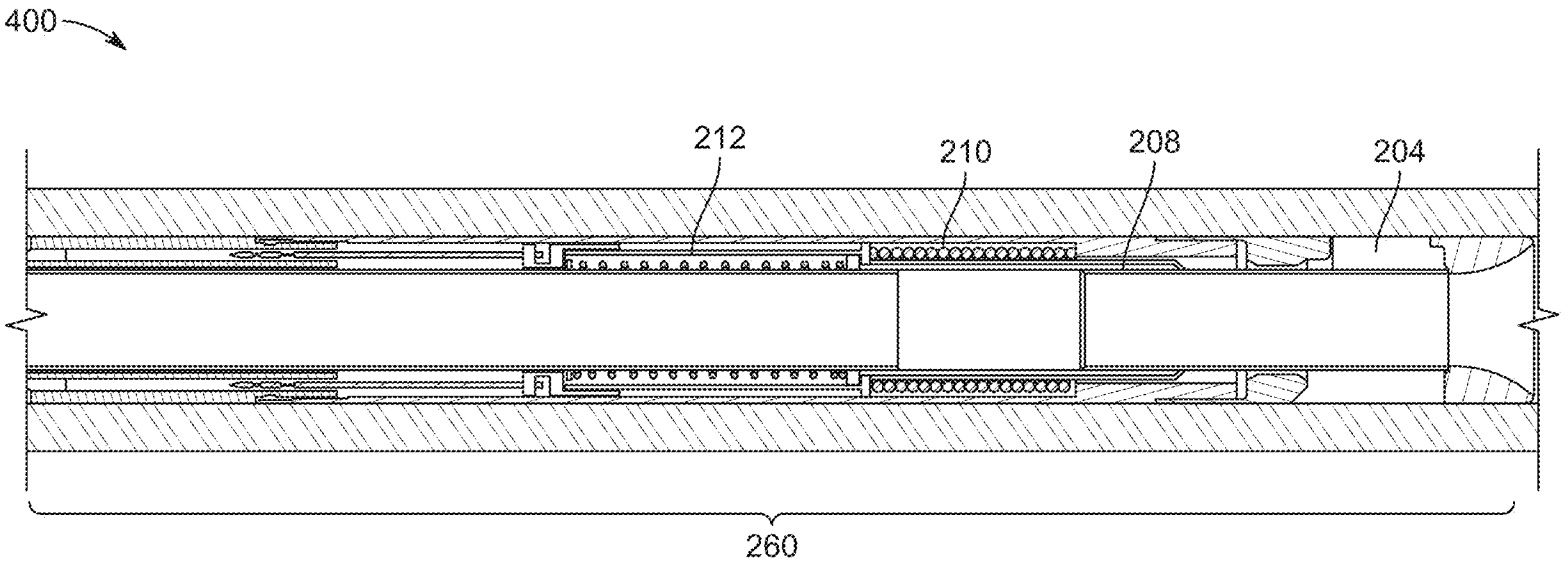
Figure 8D:
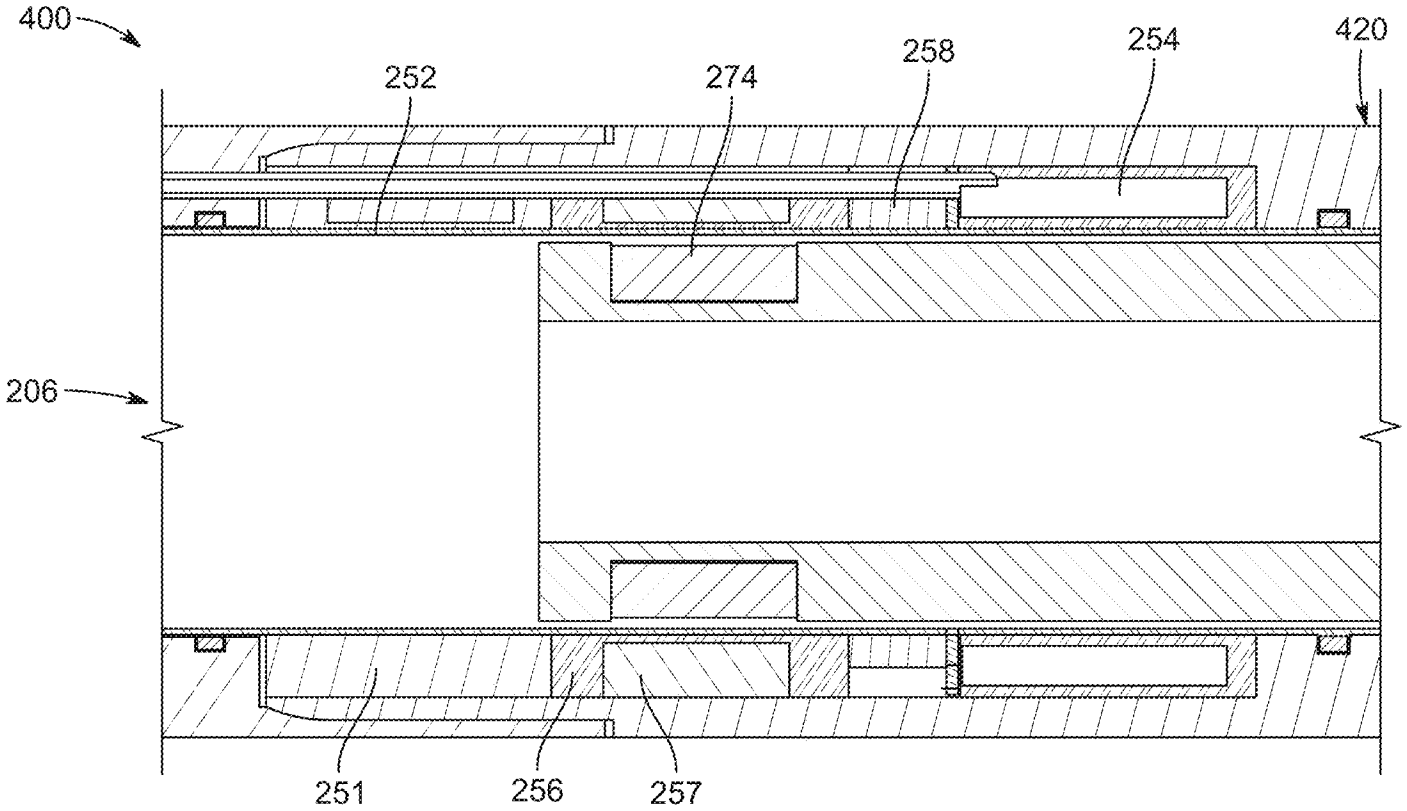
Figure 9A:
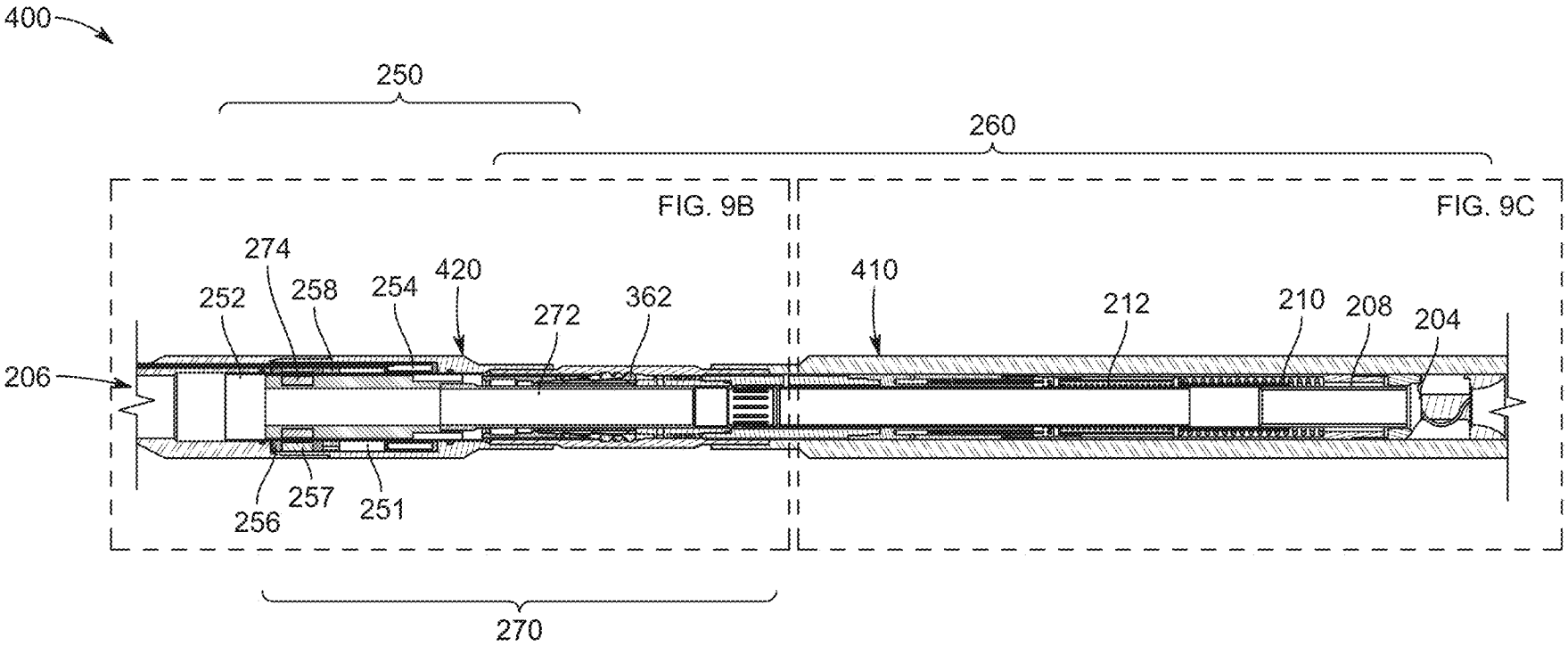
Figure 9B:
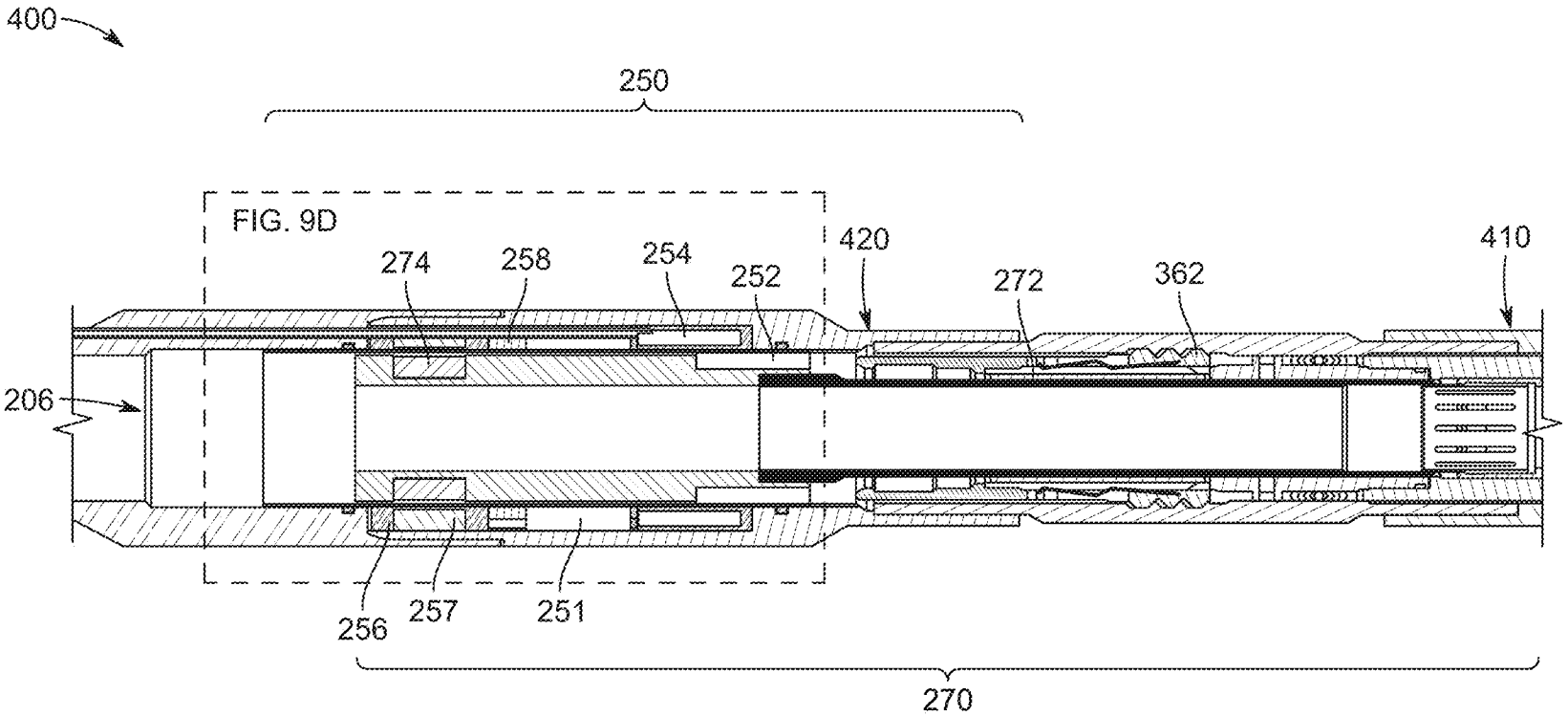
Figure 9C:
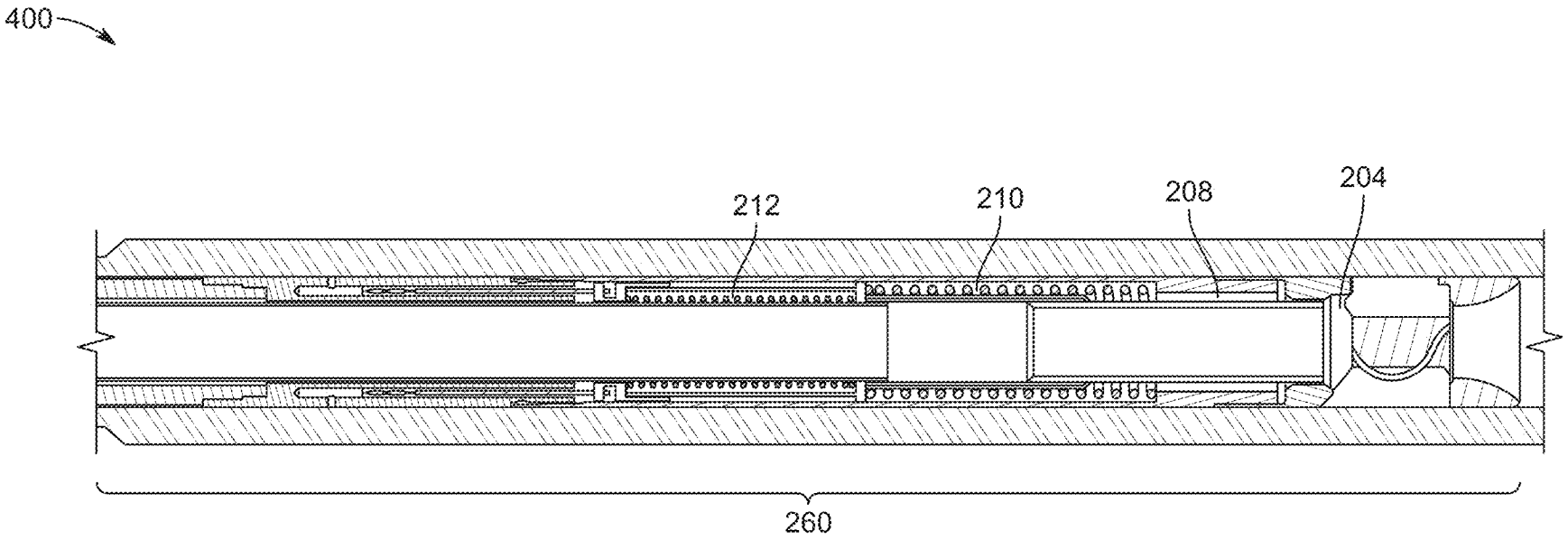
Figure 9D:
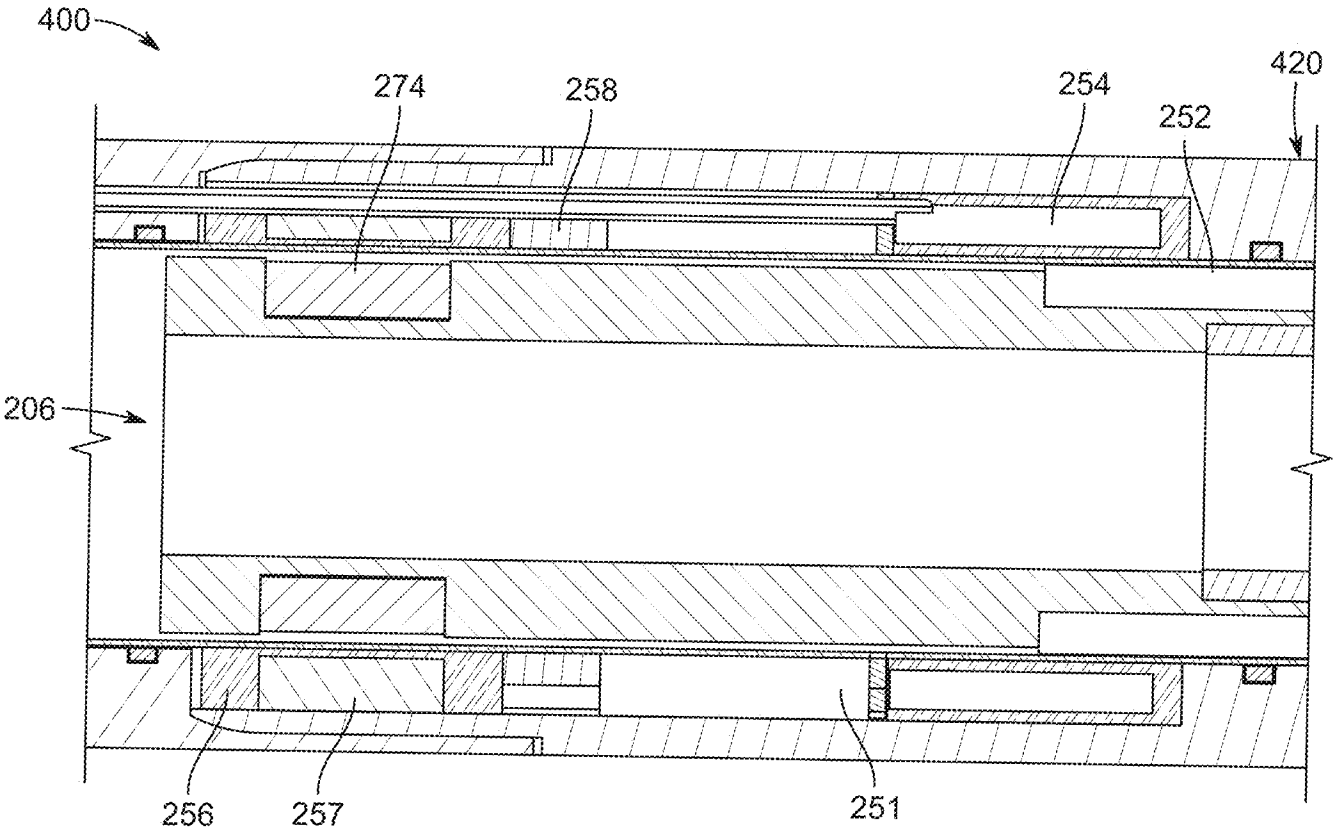

Turning to FIGS. 2A through 2F illustrated is one embodiment of a downhole device, including a safety valve 200 designed, manufactured and/or operated according to one or more embodiments of the disclosure, as might employ the first, second and third portions of the WLRSV, as discussed above. FIGS. 2A through 2C illustrate different views of the safety valve 200 in a first closed position, its unpowered electromagnetic assembly and magnetic target decoupled from one another. FIG. 2D illustrates the safety valve 200 of FIGS. 2A through 2C in a second closed position with power (DC power in this embodiment) supplied to the electromagnetic assembly, thereby coupling the electromagnetic assembly and the magnetic target together. FIG. 2E illustrates the safety valve 200 of FIG. 2D now in an open position, the powered (DC powered) electromagnetic assembly and magnetic target remaining magnetically coupled (e.g., fixedly coupled) with one another. FIG. 2F illustrates the safety valve 200 of FIG. 2E after power (DC power) has been cut to the electromagnetic assembly, and thus the safety valve 200 returns to the first closed position. In yet another embodiment, the safety valve 200 may be indirectly moved back to the first closed position, for example if an electrical logic circuit determines that the electrical power has been interrupted and initiates a closing of the safety valve 200.

Referring initially to FIGS. 2A through 2C, the safety valve 200 is illustrated in the first closed position. The safety valve 200, in one or more embodiments, may include an outer housing 224 (e.g., tubular housing, wellbore tubing, etc.) containing a central bore 225 therein, wherein components of the safety valve 200 may be disposed within the central bore 225. An upper valve assembly 234 (e.g., also the axially fixed ferromagnetic portion in this embodiment) may be attached to the outer housing 224, and may further include one or more sealing elements 223, such that fluid communication from a lower section 202 to an upper section 203 is prevented.

A sleeve 226 may be attached between the upper valve assembly 234 and a lower valve assembly 216. A bore flow management actuator 240 may be disposed within the sleeve 226. The bore flow management actuator 240 may include a translating sleeve 222 and a flow tube main body 208. A flow path 214 may be defined by an interior of the flow tube main body 208. As illustrated in FIGS. 2A through 2C, the flow path 214 may extend from an interior of a conduit 206 through an interior of the flow tube main body 208. As will be discussed in further detail below, when the safety valve 200 is in an open position, the flow path 214 may extend from an interior of the conduit 206 through an interior of the flow tube main body 208 and further into the lower section 202.

The safety valve 200 may further include a power spring 210 disposed between the lower valve assembly 216 and a translating sleeve shoulder 218. As illustrated in FIGS. 2A through 2C, the translating sleeve shoulder 218 and a flow tube shoulder 232 may be in contact when the safety valve 200 is in the first closed position. The power spring 210 may provide a positive spring force against the translating sleeve shoulder 218, which may keep the flow tube main body 208 in a first position. The power spring 210 may also provide a positive spring force to return the flow tube main body 208 and the translating sleeve 222 to the first position (e.g., from a second position), as will be explained below.

The safety valve 200 may further include a nose spring 212 disposed between a translating sleeve assembly 230 and the flow tube shoulder 232. The translating sleeve assembly 230 may be disposed between and attached to a piston 220 and the translating sleeve 222. The power spring 210 and the nose spring 212 are depicted as coil springs in FIGS. 2A through 2F. However, the power spring 210 and the nose spring 212 may comprise any kind of spring and remain within the scope of the present disclosure, such as, for example, coil springs, wave springs, or fluid springs, among others.

In the illustrated embodiment, the translating sleeve assembly 230 may allow a force applied to a distal end of the piston 220 to be transferred into the translating sleeve 222. A force may be applied to the distal end of the piston 220 by way of fluid communication from a channel 228 through an orifice 242. A force applied to the piston 220 may move the translating sleeve 222 from a first position to a second position. The nose spring 212 may provide a positive spring force against the translating sleeve assembly 230 and the flow tube shoulder 232, which may return the translating sleeve 222 from the second position to the first position, as will be discussed in greater detail below.

In the first closed position, the translating sleeve 222 and the flow tube main body 208 are positioned such that the translating sleeve shoulder 218 and the flow tube shoulder 232 are in contact and the power spring 210 and the nose spring 212 are in an extended position. In the first closed position, the translating sleeve 222 may be referred to as being in a first position and the flow tube main body 208 may be referred to as being in a first position.

In at least one embodiment, the bore flow management actuator 240 is configured to slide from a first initial state to a first subsequent state to move a valve closure mechanism 204 between a first closed state and a first open state. In the first closed state, the valve closure mechanism 204 may isolate the lower section 202 from the flow tube main body 208. When the valve closure mechanism 204 is in a first closed state, as in FIGS. 2A through 2C, the valve closure mechanism 204 may prevent formation fluids and pressure from flowing into the flow tube main body 208 from the lower section 202. Although FIGS. 2A through 2C illustrate the valve closure mechanism 204 as a flapper valve, the valve closure mechanism 204 may be any suitable type of valve such as a flapper type valve, a linear stopper type valve, or a ball type valve, for example. As will be illustrated in further detail below, the valve closure mechanism 204 may be actuated into a first open state to allow formation fluids to flow from the lower section 202 through the flow path 214 (e.g., defined by the lower section 202, an interior of the flow tube main body 208 and an interior of the conduit 206).

When the safety valve 200 is in the first closed position, no amount of differential pressure across the valve closure mechanism 204 will allow formation fluids to flow from the lower section 202 into the flow path 214. In the first closed position, the safety valve 200 will only allow fluid flow from conduit 206 into the lower section 202, but not from the lower section 202 into the conduit 206. In the instance that pressure in the conduit 206 is increased, the valve closure mechanism 204 will remain in the closed position until the pressure in the conduit 206 is increased above the pressure in the lower section 202 plus the closing pressure provided by the valve closure mechanism spring 205, sometimes referred to herein as valve opening pressure. When the valve opening pressure is reached, the valve closure mechanism 204 may open and allow fluid communication from the conduit 206 into the lower section 202. In this manner, treatment fluids such as surfactants, scale inhibitors, hydrate treatments, and other suitable treatment fluids may be introduced into the subterranean formation. The configuration of the safety valve 200 may allow treatment fluids to be pumped from a surface, such as a wellhead, into the subterranean formation without actuating a control line or balance line to open the valve. Once pressure in the conduit 206 is decreased below the valve opening pressure, the valve closure mechanism spring 205 will return the valve closure mechanism 204 to the closed position, and thus flow from the conduit 206 into the lower section 202 will cease. When the valve closure mechanism 204 has returned to the closed position, flow from the lower section 202 into the flow path 214 will be prevented. Should a pressure differential across the valve closure mechanism 204 be reversed, such that pressure in the lower section 202 is greater than a pressure in the conduit 206, the valve closure mechanism 204 will remain in a closed position, such that fluids in the lower section 202 are prevented from flowing into the conduit 206.

In the illustrated embodiment, the safety valve 200 includes a first portion 250, a second portion 260 (e.g., the second portion 260 may include those features disclosed in the paragraph above, for example those feature located between the upper valve assembly 234 and the valve closure mechanism 204, and specifically the bore flow management actuator 240 and the valve closure mechanism 204), and a third portion 270. As indicated above, in at least one embodiment, the first portion 250 has a first portion minimum inside diameter ($ID_1$) and is run-in-hole with the TRSV, and the second portion 260 and the third portion 270 are run-in-hole after the TRSV is no longer working properly and/or has failed. For example, in at least one embodiment, the second portion 260 has a second portion maximum outside diameter ($OD_2$), the second portion maximum outside diameter ($OD_2$) being less than the first portion minimum inside diameter ($ID_1$) such that the second portion 260 may be run-in-hole after the first portion 250. Furthermore, the third portion 270 may be run-in-hole in a separate step after the second portion 260.

In one or more embodiments, the first portion 250 includes a pocket 251 formed therein. In at least one embodiment, the pocket 251 has an electromagnetic assembly 254 (e.g., including one or more coils) located therein. The one or more coils, in one or more embodiments, may include an insulated electrical wire that makes loops around a common axis in order to produce a magnetic field when a current passes through the wire. The number of loops may vary, but in at least one embodiment the number of loops is between 10 and 500,000, if not between 100 and 100,00. In one or more other embodiments, the pocket 251 has one or more radial outer magnetic targets 257 and a magnetic target 258, for example positioned on a sliding sleeve 256, located therein. For example, in at least one embodiment the one or more radial outer magnetic targets 257 and the magnetic target 258 are configured to slide within the pocket 251, for example being placed on or in a sliding sleeve (e.g., not shown). Accordingly, the one or more radial outer magnetic targets 257 and the magnetic target 258 may slide within the pocket relative to the electromagnetic assembly 254 (e.g., fixed electromagnetic assembly). In one or more embodiments, a fluid isolation sleeve 252 isolates the electromagnetic assembly 254, one or more radial outer magnetic targets 257, and the magnetic target 258 from fluid and/or debris within the wellbore. The fluid isolation sleeve 252 may be ported to allow pressure balancing. In one embodiment, the fluid isolation sleeve 252 is mechanically connected to the electromagnetic assembly 254. In one embodiment, the fluid isolation sleeve 252 is mechanically connected to the electromagnetic assembly 254. In at least one embodiment, the fluid isolation sleeve 252 is a fixed fluid isolation sleeve, and thus does not readily move once positioned downhole. For example, the fluid isolation sleeve 252 could comprise a composite, a plastic, a ceramic, aluminum, stainless steel, or another non-ferromagnetic material. In yet another embodiment, the fluid isolation sleeve 252 could comprise a ferromagnetic material, but would need to be sufficient thin as to not draw too much of the magnetic force generated by the electromagnetic assembly 254 from achieving its intended use, as discussed below.

In one or more embodiments, the second portion 260 includes the flow tube 208 and the valve 204, and may be located below the first portion 250 (e.g., below the fluid isolation sleeve 252, and the electromagnetic assembly 254). The second portion 260 may additionally include the power spring 210 and/or nose spring 212, as will be further discussed below.

In one or more other embodiments, the third portion 270 includes a mechanical connecting apparatus 272, the mechanical connecting apparatus including one or more radial inner magnetic targets 274 associated therewith. The one or more radial inner magnetic targets 274, in this embodiment, are configured to magnetically couple with the one or more radial outer magnetic targets 257 of the first portion 250 (e.g., through the fluid isolation sleeve 252). The mechanical connecting apparatus 272, in at least one embodiment, axially couples the one or more radial inner magnetic targets 274 of the third portion and the flow tube 208 of the second portion 260, and thus the one or more radial outer magnetic targets 257 of the first portion 250 with the flow tube 208 of the second portion 260.

With reference to FIG. 2D the safety valve 200 is illustrated in a second closed position. In the second closed position, the translating sleeve 222 may be displaced from the first position to a second position, which is relatively closer in proximity to the valve closure mechanism 204. The flow tube main body 208 may remain in the first position, or alternatively only slightly downhole from the first position. When the safety valve 200 is in the second closed position, both the power spring 210 and the nose spring 212 may be in a compressed state.

To move the translating sleeve 222 to the second position, differential pressure across the valve closure mechanism 204 may be increased by lowering the pressure in the conduit 206 or increasing pressure in the lower section 202. Lowering pressure in the conduit 206 or increasing pressure in the lower section 202 may cause fluid from the lower section 202 to flow through the channel 228 defined between the sleeve 226 and the outer housing 224 into the orifice 242. The orifice 242 may allow fluid communication into the piston tube 244, whereby fluid pressure may act on the proximal end of the piston 220. The force exerted by fluid pressure on the proximal end of the piston 220 may displace the piston 220 towards the valve closure mechanism 204 by transferring the force through the piston 220, the translating sleeve assembly 230, and the translating sleeve shoulder 218. The nose spring 212 may provide a spring force against the flow tube shoulder 232 and the translating sleeve assembly 230, and the power spring 210 may provide a spring force against the translating sleeve shoulder 218 and the lower valve assembly 216.

Although not illustrated in FIGS. 2A through 2F, the flow tube main body 208 may include channels that allow pressure and/or fluid communication between the flow path 214 and an interior of the sleeve 226. Collectively the spring forces from the power spring 210 and the nose spring 212 may resist the movement of the piston 220 until the differential pressure across the valve closure mechanism 204 is increased beyond the spring force provided from the power spring 210 and the nose spring 212. Increasing differential pressure may include decreasing pressure in the conduit 206 such that the pressure in the lower section 202 is relatively higher than the pressure in the conduit 206. When the differential pressure across the valve closure mechanism 204 is increased, the differential pressure across the piston 220 also increases. When the differential pressure across the valve closure mechanism 204 is increased beyond the spring force provided by the nose spring 212 and the power spring 210, the nose spring 212 and the power spring 210 may compress and allow the translating sleeve 222 to move into the second position. Differential pressure across the valve closure mechanism 204 may be increased by pumping fluid out of the conduit 206, for example. In the instance that the lower section 202 is fluidically coupled to a non-perforated section of pipe or where there is a plug in a conduit 206 fluidically coupled to the lower section 202 that prevents pressure being transmitted from the lower section 202 to the piston 220, a pressure differential across the valve closure mechanism 204 may be induced through pipe swell.

In the second closed position, the safety valve 200 remains safe as no fluids from the lower section 202 can flow into the flow path 214. In the second closed position no amount of differential pressure across the valve closure mechanism 204, the differential pressure being relatively higher pressure in the lower section 202 and relatively lower pressure in the conduit 206, should cause the valve closure mechanism 204 to open to allow fluids from the lower section 202 to flow into the flow path 214, as the pressure from the lower section 202 is acting on the valve closure mechanism 204. If pressure is increased in the conduit 206, the differential pressure across the valve closure mechanism 204 decreases and the translating sleeve 222 may move back to the first position illustrated in FIGS. 2A through 2C. Unlike conventional safety valves that generally require a control line to supply pressure to actuate a piston to move a translating sleeve, the safety valve 200 may only require pressure supplied by the wellbore fluids in the lower section 202 to move the translating sleeve.

With continued reference to FIG. 2D, the piston 220 may be fixedly attached to the translating sleeve assembly 230. Although illustrated as a single piston in FIGS. 2A through 2F, the piston 220 may comprise a plurality of pistons and remain within the scope of the disclosure.

As illustrated, when the translating sleeve 222 is moved from the first position to the second position, the piston 220 may also be moved. Before, during or after the translating sleeve 222 is allowed to come to the second position as described above, the electromagnetic assembly 254 may be powered on. The powering on of the electromagnetic assembly 254 may cause the electromagnetic assembly 254 to hold the magnetic target 258, which is axially fixed to the one or more radial outer magnetic targets 257 (e.g., via the sliding sleeve 256), and the one or more radial inner magnetic targets 274 of the third portion 270 in their axial downhole position. As the one or more radial inner magnetic targets 274 are rigidly coupled to the flow tube 208 (e.g., via the mechanical connecting apparatus 272), the flow tube 208 is also held in its axial downhole position, as shown in FIG. 2D.

In FIGS. 2A through 2F, the electromagnetic assembly 254 is depicted as one coil circumscribing the tubular, but there may be any number of coils in any orientation to fix the sliding sleeve 226, and thus bore flow management actuator 240 in place. The electromagnetic assembly 254 may apply a force in a substantially radial or axial direction, for example. The force applied by the electromagnetic assembly 254 may be any amount of force, including but not limited to, a force in a range of about 45 Newtons to about 45000 Newtons. The electromagnetic assembly 254 may provide a means to hold the sliding sleeve 226 and the bore flow management actuator 240 at any well depth. Hydraulic systems used in previous wellbore safety valves generally require control and balance lines to actuate and hold a valve open which may have pressure limitations. The limitations experienced by hydraulic systems may be overcome by using the electromagnetic assembly 254 described herein, as only well pressure is required to open the safety valve 200. Again, when the translating sleeve 222 is in the second position either when the electromagnetic assembly 254 is switched on or switched off, no amount of differential pressure across the valve closure mechanism 204 will open the valve closure mechanism 204, the differential pressure being a pressure difference between a relatively higher pressure in the section 202 and a relatively lower pressure in the conduit 206.

With reference to FIG. 2E, the safety valve 200 is illustrated in an open position. When the safety valve 200 is in the open position, the translating sleeve 222 may be fixed in place in the second position, as in FIGS. 2D and 2E, through the force provided by the electromagnetic assembly 254, the force being transferred through the mechanical connecting apparatus 272 to the bore flow management actuator 240, for example via the translating sleeve 222. The flow tube main body 208 is illustrated as being axially shifted from the first position illustrated in FIGS. 2A through 2D to a second position in FIG. 2E. When the flow tube main body 208 is in the second position, the flow tube shoulder 232 and the translating sleeve shoulder 218 may be in contact and the flow tube main body 208 may have displaced the valve closure mechanism 204 into an open position. The nose spring 212 may be in an uncompressed state, while the power spring 210 may be in a compressed state.

The flow tube main body 208 may be moved from the first position to the second position when the translating sleeve 222 is fixed in place in the second position by the electromagnetic assembly 254, as described above. When the translating sleeve 222 is fixed in the second position through the force provided by the electromagnetic assembly 254, the nose spring 212 may provide a positive spring force against the flow tube shoulder 232 and the translating sleeve assembly 230. The positive spring force from the nose spring 212 may be transferred through the flow tube main body 208 into the valve closure mechanism 204. The flow tube main body 208 will not move to the second position until differential pressure across the valve closure mechanism 204 exists and the translating sleeve 222 is fixed in position. The differential pressure may be decreased by pumping into the conduit 206, thereby increasing the pressure in the conduit 206. The pressure may be increased in the conduit 206 until the differential pressure across the valve closure mechanism 204 is decreased to a point where the positive spring force from the nose spring 212 is greater than the differential pressure across the valve closure mechanism 204. Thereafter, the nose spring 212 may extend and move the flow tube main body 208 into the second position by acting on the translating sleeve assembly 230 and the flow tube shoulder 232, which are held in place via the electromagnetic assembly 254 and one or more other features. When the flow tube main body 208 is in the second position, fluids such as oil and gas in the lower section 202 may be able to flow into the flow path 214 and to a surface of the wellbore such as to a wellhead. Safety valve 200 may remain in the open position defined by the translating sleeve 222 being in the second position and the flow tube main body 208 being in the second position, as long as the electromagnetic assembly 254 remains powered on.

The safety valve 200 may be moved back to the first closed position, as illustrated in FIG. 2F, by powering off the electromagnetic assembly 254. As previously discussed, the electromagnetic assembly 254 may fix the one or more radial inner magnetic targets 274 and the flow tube 208 in place in the second position when the electromagnetic assembly 254 remains powered on. When the electromagnetic assembly 254 is powered off, the one or more radial inner magnetic targets 274 and the flow tube 208 may no longer be fixed in place. The electromagnetic assembly 254 may alternate the direction of the wrapping of the coil. Alternating the direction of the wrapping will result in alternating directions of the magnetic field. The result is multiple magnetic reversals in the coils of the electromagnetic assembly 254 that would magnetically connect with the one or more radial inner magnetic targets 274. The power spring 210 may provide a positive spring force against the lower valve assembly 216, translating the sleeve shoulder 218 and the flow tube shoulder 232 uphole. The positive spring force from the power spring 210 may axially displace the translating sleeve 222 to the first position and the flow tube main body 208 to the first position, thereby returning the safety valve 200 to the first closed position illustrated in FIGS. 2A through 2C, and 2F. The positive spring force from the power spring 210 may also axially displace the one or more radial inner magnetic targets 274 to the position illustrated in FIGS. 2A through 2C, and 2F, by transmitting the positive spring force through the mechanical connecting apparatus 272.

Turning now to FIGS. 3A through 3D, illustrated are different views of a safety valve 300 designed, manufactured and/or operated according to one or more alternative embodiments of the disclosure. The safety valve 300 of FIGS. 3A through 3D, is similar in many respects to the safety valve 200 of FIGS. 2A through 2C. Accordingly, like reference numbers have been used to illustrate similar, if not identical, features. FIGS. 3A through 3D illustrate the safety valve 300 in its operational state, thus each of the first portion 250, the second portion 260 and the third portion 270 are coupled together and fixed within the tubular. For example, as illustrated, a latching mechanism 362 of the second portion 260 axially fixes the second portion 260 within the tubular. Furthermore, the mechanical connecting apparatus 272 of the third portion 270 axially fixes the one or more radial inner magnetic targets 274 of the third portion 270 to the bore flow management actuator 240 (e.g., translating sleeve assembly 230) of the second portion 260. Thus, any axial movement of the flow tube 208, as discussed above, with result in a similar axial movement of the one or more radial inner magnetic targets 274. Additionally, the electromagnetic assembly 254, one or more radial outer magnetic targets 257, magnetic target 258, and sliding sleeve 256, in the illustrated embodiment, are located in the pocket 251 in a safety valve sub 320. Further to this embodiment, the fluid isolation sleeve 252 separates the electromagnetic assembly 254, one or more radial outer magnetic targets 257, magnetic target 258, and sliding sleeve 256 located in the pocket 251, from fluid within the wellbore, and thus from the mechanical connecting apparatus 272.

Turning now to FIGS. 4A through 9D, illustrated are various different installation and/or operational states, each with various different views, of a safety valve 400 designed, manufactured and/or operated according to one or more alternative embodiments of the disclosure. The safety valve 400 of FIGS. 4A through 9D, is similar in many respects to the safety valve 300 of FIGS. 3A through 3D. Accordingly, like reference numbers have been used to illustrate similar, if not identical, features.

FIGS. 4A through 4D illustrate the safety valve 400 in its original run-in-hole state, and thus at this stage the safety valve 400 only includes a safety valve sub 420 coupled to the TRSV 410. The safety valve sub 420, in this embodiment, includes a first portion 250 (e.g., having the electromagnetic assembly 254, sliding sleeve 256, electromagnetic assembly 254, one or more radial outer magnetic targets 257, and magnetic target 258, all of which are located in the pocket 251 and protected by the fluid isolation sleeve 252). In contrast, FIGS. 5A through 5D illustrate the safety valve 400 after the TRSV 410 is no longer working properly and/or has failed. Accordingly, the safety valve 400 of FIGS.

5A through 5D additionally includes the second portion 260, for example including the flow tube main body 208 and valve closure mechanism 204.

Turning to FIGS. 6A through 6D, illustrated is the safety valve 400 of FIGS. 5A through 5D after inserting the third portion 270 therein. In the illustrated embodiment, the third portion 270 includes the mechanical connecting apparatus 272 and one or more radial inner magnetic targets 274. The third portion 270, in this embodiment, axially couples with the flow tube 208 of the second portion 260. Accordingly, in the embodiment of FIGS. 6A through 6D, the third portion 270 is coupled to the flow tube 208 of the second portion 260, and thus the one or more radial inner magnetic targets 274 are axially fixed to the flow tube 208. Furthermore, the one or more radial inner magnetic targets 274 are magnetically coupled with the one or more radial outer magnetic targets 257, for example across the fluid isolation sleeve 252. The progression of FIGS. 4A through 6D illustrates how the safety valve 400 could be installed in accordance with one or more embodiments of the disclosure.

Turning now to FIGS. 7A through 9D, illustrated are certain embodiments how the safety valve 400 of FIGS. 6A through 6D could be operated. Specifically, FIGS. 7A through 7D illustrate the safety valve 400 of FIGS. 6A through 6D when the safety valve 400 has tubing pressure below the valve closure mechanism 204. In this instance, the pressure below the valve closure mechanism 204 has compressed the power spring 210 and nose spring 212, and in doing so may have slightly moved the flow tube 208 and associated mechanical connecting apparatus 272 downhole. For example, the flow tube 208 has moved downhole into contact with the valve closure mechanism 204.

Turning to FIGS. 8A through 8D, illustrated is the safety valve 400 of FIGS. 7A through 7D after the pressure is balanced across the valve closure mechanism 204, and thus the flow tube 208 is allowed to move axially down to open the valve closure mechanism 204. At this stage, the electromagnetic assembly 254 and the magnetic target 258 are located proximate one another. If and/or when the electromagnetic assembly 254 is powered on, the electromagnetic assembly 254 will engage with the magnetic target 258, and thus with the one or more radial outer magnetic targets 257 and associated one or more inner radial permanent magnets 274 axially hold the flow tube 208 in this open state.

Turning now to FIGS. 9A through 9D, illustrated is the safety valve 400 of FIGS. 8A through 8D after the electromagnetic assembly 254 loses power, and thus the power spring 210 of the second portion 260 pushes the flow tube main body 208 uphole, allowing the valve closure mechanism 204 to close.

Aspects disclosed herein include:

A. A safety valve, the safety valve including: 1) a first portion, the first portion including a safety valve sub having an electromagnetic assembly, the first portion configured to be run-in-hole as part of wellbore tubing; 2) second portion, the second portion including a valve closure mechanism and a bore flow management actuator, the bore flow management actuator configured to slide from a first initial state to a first subsequent state to move the valve closure mechanism between a first closed state and a first open state; and 3) third portion, the third portion including a mechanical connecting apparatus having one or more magnetic targets associated therewith, the third portion configured to engage with at least a portion of the bore flow management actuator, the one or more magnetic targets configured to magnetically engage with the electromagnetic assembly when the electromagnetic assembly is in an energized state to axially fix the bore flow management actuator in the first subsequent state B. A well system, the well system including: 1) a wellbore extending through one or more subterranean formations; 2) production tubing disposed in the wellbore; and 3) a safety valve disposed in the wellbore, the safety valve including: a) a first portion, the first portion including a safety valve sub having an electromagnetic assembly, the first portion configured to be run-in-hole as part of wellbore tubing; b) a second portion, the second portion including a valve closure mechanism and a bore flow management actuator, the bore flow management actuator configured to slide from a first initial state to a first subsequent state to move the valve closure mechanism between a first closed state and a first open state; and c) a third portion, the third portion including a mechanical connecting apparatus having one or more magnetic targets associated therewith, the third portion configured to engage with at least a portion of the bore flow management actuator, the one or more magnetic targets configured to magnetically engage with the electromagnetic assembly when the electromagnetic assembly is in an energized state to axially fix the bore flow management actuator in the first subsequent state.

C. A method, the method including: 1) positioning a first portion within a wellbore extending through one or more subterranean formations, the first portion including a safety valve sub having an electromagnetic assembly; 2) positioning a second portion within the wellbore, the second portion including a valve closure mechanism and a bore flow management actuator, the bore flow management actuator configured to slide from a first initial state to a first subsequent state to move the valve closure mechanism between a first closed state and a first open state, the second portion configured to be run-in-hole after the first portion; and 3) positioning a third portion within the wellbore, the third portion including a mechanical connecting apparatus having one or more magnetic targets associated therewith, the third portion configured to be run-in-hole after the second portion to engage with at least a portion of the bore flow management actuator, the one or more magnetic targets configured to magnetically engage with the electromagnetic assembly when the electromagnetic assembly is in an energized state to axially fix the bore flow management actuator in the first subsequent state.

D. A safety valve, the safety valve including: 1) a first portion, the first portion including a safety valve sub having an electromagnetic assembly; 2) a second portion, the second portion including a valve closure mechanism and a bore flow management actuator, the bore flow management actuator configured to slide from a first initial state to a first subsequent state to move the valve closure mechanism between a first closed state and a first open state; 3) an axially fixed magnetic target portion, the axially fixed magnetic target portion and the electromagnetic assembly configured to create a magnetic flux when the electromagnetic assembly is energized; and 4) a third portion, the third portion including a mechanical connecting apparatus having one or more magnetic targets associated therewith, the third portion configured to engage with at least a portion of the bore flow management actuator, the one or more magnetic targets configured to magnetically engage with the axially fixed magnetic target portion via the magnetic flux to axially fix the bore flow management actuator in the first subsequent state.

E. A well system, the well system including: 1) a wellbore extending through one or more subterranean formations; 2) production tubing disposed in the wellbore; and 3) a safety valve disposed in the wellbore, the safety valve including: a) a first portion, the first portion including a safety valve sub having an electromagnetic assembly; b) a second portion, the second portion including a valve closure mechanism and a bore flow management actuator, the bore flow management actuator configured to slide from a first initial state to a first subsequent state to move the valve closure mechanism between a first closed state and a first open state; c) an axially fixed magnetic target portion, the axially fixed magnetic target portion and the electromagnetic assembly configured to create a magnetic flux when the electromagnetic assembly is energized; and d) a third portion, the third portion including a mechanical connecting apparatus having one or more magnetic targets associated therewith, the third portion configured to engage with at least a portion of the bore flow management actuator, the one or more magnetic targets configured to magnetically engage with the axially fixed magnetic target portion via the magnetic flux to axially fix the bore flow management actuator in the first subsequent state.

F. A method, the method including: 1) positioning a first portion within a wellbore extending through one or more subterranean formations, the first portion including a safety valve sub having an electromagnetic assembly; 2) positioning a second portion within the wellbore, the second portion including a valve closure mechanism and a bore flow management actuator, the bore flow management actuator configured to slide from a first initial state to a first subsequent state to move the valve closure mechanism between a first closed state and a first open state; 3) positioning an axially fixed magnetic target portion within the wellbore, the axially fixed magnetic target portion and the electromagnetic assembly configured to create a magnetic flux when the electromagnetic assembly is energized; and 4) positioning a third portion within the wellbore, the third portion including a mechanical connecting apparatus having one or more magnetic targets associated therewith, the third portion configured to engage with at least a portion of the bore flow management actuator, the one or more magnetic targets configured to magnetically engage with the axially fixed magnetic target portion via the magnetic flux to axially fix the bore flow management actuator in the first subsequent state.

G. A safety valve, the safety valve including: 1) a first portion, the first portion including a safety valve sub having a pocket therein, the pocket including an electromagnetic assembly, one or more radial outer magnetic targets, and a magnetic target located therein; 2) a second portion, the second portion including a valve closure mechanism and a bore flow management actuator, the bore flow management actuator configured to slide from a first initial state to a first subsequent state to move the valve closure mechanism between a first closed state and a first open state; and 3) a third portion, the third portion including a mechanical connecting apparatus having one or more radial inner magnetic targets associated therewith and configured to magnetically engage with the one or more radial outer magnetic targets, wherein at least one of the one or more radial inner magnetic targets or the one or more radial inner magnetic targets are one or more permanent magnets, the third portion configured to engage with at least a portion of the bore flow management actuator such that when the bore flow management actuator moves to the first subsequent state the magnetic target moves proximate the electromagnetic assembly, and further wherein when the magnetic target is located proximate an energized electromagnetic assembly the bore flow management actuator is fixed in the first subsequent state.

H. A well system, the well system including: 1) a wellbore extending through one or more subterranean formations; 2) production tubing disposed in the wellbore; and 3) a safety valve disposed in the wellbore, the safety valve including: a) a first portion, the first portion including a safety valve sub having a pocket therein, the pocket including an electromagnetic assembly, one or more radial outer magnetic targets, and a magnetic target located therein; b) a second portion, the second portion including a valve closure mechanism and a bore flow management actuator, the bore flow management actuator configured to slide from a first initial state to a first subsequent state to move the valve closure mechanism between a first closed state and a first open state; and c) a third portion, the third portion including a mechanical connecting apparatus having one or more radial inner magnetic targets associated therewith and configured to magnetically engage with the one or more radial outer magnetic targets, wherein at least one of the one or more radial inner magnetic targets or the one or more radial inner magnetic targets are one or more permanent magnets, the third portion configured to engage with at least a portion of the bore flow management actuator such that when the bore flow management actuator moves to the first subsequent state the magnetic target moves proximate the electromagnetic assembly, and further wherein when the magnetic target is located proximate an energized electromagnetic assembly the bore flow management actuator is fixed in the first subsequent state.

I. A method, the method including: 1) positioning a first portion within a wellbore extending through one or more subterranean formations, the first portion including a safety valve sub having a pocket therein, the pocket including an electromagnetic assembly, one or more radial outer magnetic targets, and a magnetic target located therein; 2) positioning a second portion within the wellbore, the second portion including a valve closure mechanism and a bore flow management actuator, the bore flow management actuator configured to slide from a first initial state to a first subsequent state to move the valve closure mechanism between a first closed state and a first open state; and 3) positioning a third portion within the wellbore, the third portion including a mechanical connecting apparatus having one or more radial inner magnetic targets associated therewith and configured to magnetically engage with the one or more radial outer magnetic targets, wherein at least one of the one or more radial inner magnetic targets or the one or more radial inner magnetic targets are one or more permanent magnets, the third portion configured to engage with at least a portion of the bore flow management actuator such that when the bore flow management actuator moves to the first subsequent state the magnetic target moves proximate the electromagnetic assembly, and further wherein when the magnetic target is located proximate an energized electromagnetic assembly the bore flow management actuator is fixed in the first subsequent state.

J. A downhole tool, the downhole tool including: 1) a first downhole device; and 2) a switch system electrically coupled with the first downhole device, the switch system including: a) an input coupleable to a power source via an electric control line; b) an output coupled to a first electrical component of the first downhole device and coupleable to a second electrical component of a second downhole device; and c) a frequency filter, wherein the output is coupled to the first electrical component of the first downhole device via the frequency filter or the output is coupleable to the second electrical component of the second downhole device via the frequency filter, the frequency filter configured to filter power to one of the first downhole device or the second downhole device upon switching a signal of the power source.

K. A well system, the well system including: 1) a wellbore extending through one or more subterranean formations; 2) production tubing disposed in the wellbore; 3) a downhole tool disposed in the wellbore, the downhole tool including: a) a first downhole device; and b) a switch system electrically coupled with the first downhole device, the switch system including: i) an input coupleable to a power source via an electric control line; ii) an output coupled to a first electrical component of the first downhole device and coupleable to a second electrical component of a second downhole device; and iii) a frequency filter, wherein the output is coupled to the first electrical component of the first downhole device via the frequency filter or the output is coupleable to the second electrical component of the second downhole device via the frequency filter, the frequency filter configured to filter power to one of the first downhole device or the second downhole device upon switching a signal of the power source.

L. A method, the method including: 1) positioning a first downhole device in a wellbore; 2) positioning a second downhole device in the wellbore, wherein a switch system is coupled with the first and second downhole devices, the switch system including: a) an input coupleable to a power source via an electric control line; b) an output coupled to a first electrical component of the first downhole device and coupleable to a second electrical component of a second downhole device; and c) a frequency filter, wherein the output is coupled to the first electrical component of the first downhole device via the frequency filter or the output is coupleable to the second electrical component of the second downhole device via the frequency filter, the frequency filter configured to filter power to one of the first downhole device or the second downhole device upon switching a signal of the power source; and 3) switching a signal of the power source to operate ones of the first downhole device or the second downhole device.

Aspects A, B, C, D, E, F, G, H, I, J, K and L may have one or more of the following additional elements in combination: Element 1: wherein the electromagnetic assembly is located in a pocket in the safety valve sub. Element 2: wherein the first portion further includes a fluid isolation sleeve separating the electromagnetic assembly located in the pocket from the mechanical connecting apparatus. Element 3: wherein the fluid isolation sleeve is non-ferromagnetic. Element 4: wherein the fluid isolation sleeve is an axially fixed fluid isolation sleeve. Element 5: wherein the one or more magnetic targets are one or more permanent magnets. Element 6: wherein the bore flow management actuator includes a bore flow management actuator profile and the mechanical connecting apparatus includes a downhole mechanical connecting apparatus profile, and further wherein the downhole mechanical connecting apparatus profile is configured to couple with the bore flow management actuator profile to axially couple the at least a portion of the bore flow management actuator and the mechanical connecting apparatus. Element 7: wherein the bore flow management actuator includes a flow tube main body and a translating sleeve assembly including a translating sleeve, and further wherein the downhole mechanical connecting apparatus profile is configured to couple with the translating sleeve of the second portion to axially fix together the one or more magnetic targets and the translating sleeve. Element 8: wherein the second portion further includes a lower valve assembly located proximate the valve closure mechanism and an upper valve assembly positioned distal the valve closure mechanism, and further wherein the bore flow management actuator includes a power spring disposed between the lower valve assembly and a translating sleeve shoulder of the translating sleeve. Element 9: wherein the first portion is configured to be run-in-hole as part of wellbore tubing, the second portion is configured to be run-in-hole after the first portion, and the third portion is configured to be run-in-hole after the second portion. Element 10: wherein the electromagnetic assembly is located in a pocket in the safety valve sub. Element 11: wherein the first portion further includes a fluid isolation sleeve separating the electromagnetic assembly located in the pocket from the mechanical connecting apparatus. Element 12: wherein the fluid isolation sleeve is non-ferromagnetic. Element 13: wherein the fluid isolation sleeve is an axially fixed fluid isolation sleeve. Element 14: wherein the axially fixed magnetic target portion forms at least a portion of the second portion. Element 15: wherein the bore flow management actuator includes a bore flow management actuator profile and the mechanical connecting apparatus includes a downhole mechanical connecting apparatus profile, and further wherein the downhole mechanical connecting apparatus profile is configured to couple with the bore flow management actuator profile to axially couple the at least a portion of the bore flow management actuator and the mechanical connecting apparatus. Element 16: wherein the bore flow management actuator includes a flow tube main body and a translating sleeve assembly including a translating sleeve, and further wherein the downhole mechanical connecting apparatus profile is configured to couple with the translating sleeve of the second portion to axially fix together the one or more magnetic targets and the translating sleeve. Element 17: wherein the second portion further includes a lower valve assembly located proximate the valve closure mechanism and an upper valve assembly positioned distal the valve closure mechanism, and further wherein the bore flow management actuator includes a power spring disposed between the lower valve assembly and a translating sleeve shoulder of the translating sleeve. Element 18: wherein the first portion is configured to be run-in-hole as part of wellbore tubing, the second portion is configured to be run-in-hole after the first portion, and the third portion is configured to be run-in-hole after the second portion. Element 19: wherein the first portion is configured to be run-in-hole as part of wellbore tubing, the second portion is configured to be run-in-hole after the first portion, and the third portion is configured to be run-in-hole after the second portion. Element 20: wherein the one or more radial outer magnetic targets and the magnetic target are axially fixed relative to one another. Element 21: wherein at least one of the one or more radial outer magnetic targets and the magnetic target are located in a sliding sleeve in the pocket. Element 22: wherein the one or more radial outer magnetic targets are located in the sliding sleeve in the pocket. Element 23: wherein the safety valve sub has an uphole end and a downhole end, the one or more radial outer magnetic targets located more near the uphole end and the electromagnetic assembly located more near the downhole end, and further wherein the magnetic target is located between the one or more radial outer magnetic targets and the electromagnetic assembly. Element 24: wherein the first portion further includes a fluid isolation sleeve separating the electromagnetic assembly, one or more radial outer magnetic targets, and the magnetic target located in the pocket from the mechanical connecting apparatus. Element 25: wherein the fluid isolation sleeve is non-ferromagnetic. Element 26: wherein the fluid isolation sleeve is an axially fixed fluid isolation sleeve. Element 27: wherein the bore flow management actuator includes a bore flow management actuator profile and the mechanical connecting apparatus includes a downhole mechanical connecting apparatus profile, and further wherein the downhole mechanical connecting apparatus profile is configured to couple with the bore flow management actuator profile to axially couple the at least a portion of the bore flow management actuator and the mechanical connecting apparatus. Element 28: wherein the frequency filter is a first frequency filter, and further wherein the first output is coupled to the first electrical component of the first downhole device via the first frequency filter and the second output is coupleable to the second electrical component of the second downhole device via a second frequency filter, the first and second frequency filters configured to switch power between the electric control line and the first downhole device and the electric control line and the second downhole device based upon switching a frequency of the power source. Element 29: wherein the first frequency filter is a low frequency filter configured to pass a low frequency signal of the power source and block a high frequency signal of the power source, and the second frequency filter is a high frequency filter configured to pass the high frequency signal of the power source and block the low frequency signal of the power source. Element 30: wherein the first frequency filter is a high frequency filter configured to pass a high frequency signal of the power source and block a low frequency signal of the power source, and the second frequency filter is a low frequency filter configured to pass the low frequency signal of the power source and block the high frequency signal of the power source. Element 31: wherein the first downhole device further includes a first valve closure mechanism coupled to the first outer housing within the first central bore, and a first bore flow management actuator disposed in the first central bore, the first bore flow management actuator configured to slide from a first initial state to a first subsequent state to move the first valve closure mechanism between a first closed state and a first open state. Element 32: wherein the first downhole device is a tubing retrievable safety valve (TRSV) and the second downhole device is a wireline retrievable safety valve (WLRSV). Element 33: wherein the switch system is configured to switch power between the electric control line and the tubing retrievable safety valve (TRSV) and the electric control line and the wireline retrievable safety valve (WLRSV) before or after the wireline retrievable safety valve (WLRSV) is insert within a wellbore. Element 34: wherein the switch system is configured to switch power between the electric control line and the tubing retrievable safety valve (TRSV) and the electric control line and the wireline retrievable safety valve (WLRSV) as the wireline retrievable safety valve (WLRSV) is being insert within a wellbore. Element 35: wherein the first frequency filter is one of a pair of first frequency filters surrounding the first downhole device, and the second frequency filter is one of a pair of second frequency filters surrounding the second downhole device. Element 36: wherein the first electrical component of the first downhole device is a first electromagnetic assembly and the second electrical component of the second downhole device is a second electromagnetic assembly. Element 37: wherein the first electrical component is an electric motor or pump, a piezoelectric actuator, or a solenoid valve. Element 38: wherein the output is a first output coupled to the first electrical component of the first downhole device and a second output coupled to the second electrical component of the second downhole device, and further wherein the first output is coupled to the first electrical component of the first downhole device via the frequency filter or the second output is coupleable to the second electrical component of the second downhole device via the frequency filter, the frequency filter configured to switch power between the electric control line and the first downhole device or the electric control line and the second downhole device based upon switching a signal of the power source.

Those skilled in the art to which this application relates will appreciate that other and further additions, deletions, substitutions and modifications may be made to the described embodiments.

What is claimed is:

1. A downhole tool, comprising:

a first downhole device; and a switch system electrically coupled with the first downhole device, the switch system including:

an input coupleable to a power source via an electric control line;

an output coupled to a first electrical component of the first downhole device and coupleable to a second electrical component of a second downhole device; and a frequency filter, wherein the output is coupled to the first electrical component of the first downhole device via the frequency filter or the output is coupleable to the second electrical component of the second downhole device via the frequency filter, wherein the frequency filter is configured to selectively pass a first frequency band to energize only the first downhole device and selectively pass a second, non-overlapping frequency band to energize only the second downhole device, such that power is routed between the first and second downhole devices in response to changes in the frequency of the power signal.

2. The downhole tool as recited in claim 1, wherein the output is a first output coupled to the first electrical component of the first downhole device and a second output coupled to the second electrical component of the second downhole device, and further wherein the first output is coupled to the first electrical component of the first downhole device via the frequency filter or the second output is coupleable to the second electrical component of the second downhole device via the frequency filter, the frequency filter configured to switch power between the electric control line and the first downhole device or the electric control line and the second downhole device based upon switching a signal of the power source.

3. The downhole tool as recited in claim 2, wherein the frequency filter is a first frequency filter, and further wherein the first output is coupled to the first electrical component of the first downhole device via the first frequency filter and the second output is coupleable to the second electrical component of the second downhole device via a second frequency filter, the first and second frequency filters configured to switch power between the electric control line and the first downhole device and the electric control line and the second downhole device based upon switching a frequency of the power source, wherein the first and second frequency filters are spatially separated and individually tuned to distinct, non-overlapping frequency bands to provide actuation level electrical power to their respective downhole devices.

4. The downhole tool as recited in claim 3, wherein the first frequency filter is a low frequency filter configured to pass a low frequency signal of the power source and block a high frequency signal of the power source, and the second frequency filter is a high frequency filter configured to pass the high frequency signal of the power source and block the low frequency signal of the power source.

5. The downhole tool as recited in claim 3, wherein the first frequency filter is a high frequency filter configured to pass a high frequency signal of the power source and block a low frequency signal of the power source, and the second frequency filter is a low frequency filter configured to pass the low frequency signal of the power source and block the high frequency signal of the power source.

6. The downhole tool as recited in claim 3, wherein the first downhole device further includes a first valve closure mechanism coupled to a first outer housing within a first central bore, and a first bore flow management actuator disposed in the first central bore, the first bore flow management actuator configured to slide from a first initial state to a first subsequent state to move the first valve closure mechanism between a first closed state and a first open state.

7. The downhole tool as recited in claim 6, wherein the first downhole device is a tubing retrievable safety valve (TRSV) and the second downhole device is a wireline retrievable safety valve (WLRSV).

8. The downhole tool as recited in claim 7, wherein the switch system is configured to switch power between the electric control line and the tubing retrievable safety valve (TRSV) and the electric control line and the wireline retrievable safety valve (WLRSV) before or after the wireline retrievable safety valve (WLRSV) is insert within a wellbore.

9. The downhole tool as recited in claim 7, wherein the switch system is configured to switch power between the electric control line and the tubing retrievable safety valve (TRSV) and the electric control line and the wireline retrievable safety valve (WLRSV) as the wireline retrievable safety valve (WLRSV) is being insert within a wellbore.

10. The downhole tool as recited in claim 3, wherein the first frequency filter is one of a pair of first frequency filters surrounding the first downhole device, and the second frequency filter is one of a pair of second frequency filters surrounding the second downhole device.

11. The downhole tool as recited in claim 1, wherein the first electrical component of the first downhole device is a first electromagnetic assembly and the second electrical component of the second downhole device is a second electromagnetic assembly.

12. A well system, comprising:

a wellbore extending through one or more subterranean formations;

production tubing disposed in the wellbore;

a downhole tool disposed in the wellbore, the downhole tool including:

a first downhole device; and a switch system electrically coupled with the first downhole device, the switch system including:

an input coupleable to a power source via an electric control line;

an output coupled to a first electrical component of the first downhole device and coupleable to a second electrical component of a second downhole device; and a frequency filter, wherein the output is coupled to the first electrical component of the first downhole device via the frequency filter or the output is coupleable to the second electrical component of the second downhole device via the frequency filter, wherein the frequency filter is configured to selectively pass a first frequency band to energize only the first downhole device and selectively pass a second, non-overlapping frequency band to energize only the second downhole device, such that power is routed between the first and second downhole devices in response to changes in the frequency of the power signal.

13. The well system as recited in claim 12, wherein the output is a first output coupled to the first electrical component of the first downhole device and a second output coupled to the second electrical component of the second downhole device, and further wherein the first output is coupled to the first electrical component of the first downhole device via the frequency filter or the second output is coupleable to the second electrical component of the second downhole device via the frequency filter, the frequency filter configured to switch power between the electric control line and the first downhole device or the electric control line and the second downhole device based upon switching a signal of the power source.

14. The well system as recited in claim 13, wherein the frequency filter is a first frequency filter, and further wherein the first output is coupled to the first electrical component of the first downhole device via the first frequency filter and the second output is coupleable to the second electrical component of the second downhole device via a second frequency filter, the first and second frequency filters configured to switch power between the electric control line and the first downhole device and the electric control line and the second downhole device based upon switching a frequency of the power source, wherein the first and second frequency filters are spatially separated and individually tuned to distinct, non-overlapping frequency bands to provide actuation level electrical power to their respective downhole devices.

15. The well system as recited in claim 14, wherein the first frequency filter is a low frequency filter configured to pass a low frequency signal of the power source and block a high frequency signal of the power source, and the second frequency filter is a high frequency filter configured to pass the high frequency signal of the power source and block the low frequency signal of the power source.

16. The well system as recited in claim 14, wherein the first frequency filter is a high frequency filter configured to pass a high frequency signal of the power source and block a low frequency signal of the power source, and the second frequency filter is a low frequency filter configured to pass the low frequency signal of the power source and block the high frequency signal of the power source.

17. The well system as recited in claim 14, wherein the first downhole device further includes a first valve closure mechanism coupled to a first outer housing within a first central bore, and a first bore flow management actuator disposed in the first central bore, the first bore flow management actuator configured to slide from a first initial state to a first subsequent state to move the first valve closure mechanism between a first closed state and a first open state.

18. The well system as recited in claim 17, wherein the first downhole device is a tubing retrievable safety valve (TRSV) and the second downhole device is a wireline retrievable safety valve (WLRSV).

19. The well system as recited in claim 18, wherein the switch system is configured to switch power between the electric control line and the tubing retrievable safety valve (TRSV) and the electric control line and the wireline retrievable safety valve (WLRSV) before or after the wireline retrievable safety valve (WLRSV) is insert within a wellbore.

20. The well system as recited in claim 18, wherein the switch system is configured to switch power between the electric control line and the tubing retrievable safety valve (TRSV) and the electric control line and the wireline retrievable safety valve (WLRSV) as the wireline retrievable safety valve (WLRSV) is being insert within a wellbore.

21. The well system as recited in claim 14, wherein the first frequency filter is one of a pair of first frequency filters surrounding the first downhole device, and the second frequency filter is one of a pair of second frequency filters surrounding the second downhole device.

22. The well system as recited in claim 12, wherein the first electrical component of the first downhole device is a first electromagnetic assembly and the second electrical component of the second downhole device is a second electromagnetic assembly.

23. A method, comprising:

positioning a first downhole device in a wellbore;

positioning a second downhole device in the wellbore, wherein a switch system is coupled with the first and second downhole devices, the switch system including:

an input coupleable to a power source via an electric control line;

an output coupled to a first electrical component of the first downhole device and coupleable to a second electrical component of a second downhole device; and a frequency filter, wherein the output is coupled to the first electrical component of the first downhole device via the frequency filter or the output is coupleable to the second electrical component of the second downhole device via the frequency filter, wherein the frequency filter is configured to selectively pass a first frequency band to energize only the first downhole device and selectively pass a second, non-overlapping frequency band to energize only the second downhole device, such that power is routed between the first and second downhole devices in response to changes in the frequency of the power signal; and switching a signal of the power source to change an operation of the first downhole device or second downhole device.

24. The method as recited in claim 23, wherein the output is a first output coupled to the first electrical component of the first downhole device and a second output coupled to the second electrical component of the second downhole device, and further wherein the first output is coupled to the first electrical component of the first downhole device via the frequency filter or the second output is coupleable to the second electrical component of the second downhole device via the frequency filter, the frequency filter configured to switch power between the electric control line and the first downhole device or the electric control line and the second downhole device based upon switching a signal of the power source.

25. The method as recited in claim 24, wherein the frequency filter is a first frequency filter, and further wherein the first output is coupled to the first electrical component of the first downhole device via the first frequency filter and the second output is coupleable to the second electrical component of the second downhole device via a second frequency filter, the first and second frequency filters configured to switch power between the electric control line and the first downhole device and the electric control line and the second downhole device based upon switching a frequency of the power source, wherein the first and second frequency filters are spatially separated and individually tuned to distinct, non-overlapping frequency bands to provide actuation level electrical power to their respective downhole devices.

26. The method as recited in claim 23, wherein the first downhole device includes a first outer housing including a first central bore extending axially through the first outer housing, the first central bore operable to convey subsurface production fluids there through, and the second downhole device includes a second outer housing including a second central bore extending axially through the second outer housing, the second central bore operable to convey subsurface production fluids there through.

* * * * *